US010266352B2

(12) United States Patent
Inoue et al.

(10) Patent No.: US 10,266,352 B2
(45) **Date of Patent: *Apr. 23, 2019**

(54) SHEET CONVEYING DEVICE AND IMAGE FORMING APPARATUS

(71) Applicant: Brother Kogyo Kabushiki Kaisha, Nagoya-shi, Aichi-ken (JP)

(72) Inventors: Masafumi Inoue, Tajimi (JP); Yoshiyuki Tsujimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/927,176

(22) Filed: Mar. 21, 2018

(65) Prior Publication Data

US 2018/0282084 A1 Oct. 4, 2018

(30) Foreign Application Priority Data

Mar. 30, 2017 (JP) ..... 2017-068844
May 29, 2017 (JP) ..... 2017-105818

(51) Int. Cl.
*B65H 7/02* (2006.01)
*B65H 1/18* (2006.01)
(Continued)

(52) U.S. Cl.
CPC ..... *B65H 1/18* (2013.01); *B65H 1/12* (2013.01); *B65H 3/0661* (2013.01); *B65H 7/04* (2013.01);
(Continued)

(58) Field of Classification Search
CPC ..... B65H 2553/20; B65H 2553/232; B65H 7/02; B65H 2553/612; B65H 2553/25; B65H 2553/81
See application file for complete search history.

(56) References Cited

U.S. PATENT DOCUMENTS 5,398,108 A * 3/1995 Morinaga ..... B65H 1/04 271/127
5,572,630 A * 11/1996 Azuma ..... B41J 13/0018 358/1.12
(Continued)

FOREIGN PATENT DOCUMENTS

JP 2000-289861 A 10/2000
JP 2002-149500 A 5/2002
(Continued)

OTHER PUBLICATIONS

Feb. 8, 2018—Co-pending U.S. Appl. No. 15/892,066.
Sep. 21, 2018—U.S. Non-Final Office Action—U.S. Appl. No. 15/892,066.

*Primary Examiner* — Howard J Sanders
(74) *Attorney, Agent, or Firm* — Banner & Witcoff, Ltd.

(57) ABSTRACT

A sheet conveying device includes: a sheet cassette including a first housing, a pressing plate, a raising plate, a first resilient member, and a second resilient member; a second housing; a sheet-cassette accommodating portion; a first electrode; a second electrode; a sheet conveyor; a driver; a first output device that outputs a first signal and a second signal; a second output device that outputs a rotation pulse signal; and a controller that receives the first signal, the second signal, and the rotation pulse signal. The controller counts pulses of the rotation pulse signal received from the second output device, determines the number of pulses of the rotation pulse signal, and determines an amount of upward movement of the pressing plate based on the number of pulses of the rotation pulse signal.

21 Claims, 34 Drawing Sheets

(51) Int. Cl.

| | |
|---|---|
| ***B65H 3/06*** | (2006.01) |
| ***B65H 7/14*** | (2006.01) |
| ***B65H 7/04*** | (2006.01) |
| ***B65H 1/12*** | (2006.01) |

(52) U.S. Cl.
CPC ..... *B65H 7/14* (2013.01); *B65H 7/02* (2013.01); *B65H 2553/20* (2013.01); *B65H 2553/232* (2013.01)

(56) References Cited

U.S. PATENT DOCUMENTS

| | | | | |
|---|---|---|---|---|
| 5,853,171 | A * | 12/1998 | Halpenny | B65H 7/00 271/126 |
| 8,025,284 | B2 * | 9/2011 | Ikeuchi | B65H 1/14 271/110 |
| 8,167,300 | B1 * | 5/2012 | Blair | B65H 1/14 271/157 |
| 8,876,105 | B2 * | 11/2014 | Ohtani | B65H 1/04 271/110 |
| 9,056,732 | B2 * | 6/2015 | Miyamae | B65H 7/02 |
| 2010/0059929 | A1 * | 3/2010 | Okumura | B65H 1/14 271/117 |
| 2016/0101955 | A1 * | 4/2016 | Koseki | B65H 7/04 271/265.02 |
| 2017/0341889 | A1 * | 11/2017 | Kikuta | G03G 15/6511 |
| 2018/0143576 | A1 * | 5/2018 | Nishioka | B65H 1/04 |
| 2018/0237244 | A1 * | 8/2018 | Hashimoto | B65H 7/02 |

FOREIGN PATENT DOCUMENTS

| | | | |
|---|---|---|---|
| JP | 2007-106539 | A | 4/2007 |
| JP | 2007-168908 | A | 7/2007 |
| JP | 2015-202954 | A | 11/2015 |

* cited by examiner

SHEET CASSETTE BEING IN FOURTH STATE
(SHEET PLACED, NOT INSERTED OR REMOVED, AND NO FAILURE)

SHEET CASSETTE BEING IN FIFTH STATE
(SHEET NOT PLACED, NOT INSERTED OR REMOVED, AND NO FAILURE)

SHEET CONVEYING DEVICE AND IMAGE FORMING APPARATUS

CROSS REFERENCE TO RELATED APPLICATION

The present application claims priority from Japanese Patent Application Nos. 2017-068844 filed on Mar. 30, 2017, and 2017-105818 filed on May 29, 2017, the disclosure of which is herein incorporated by reference in its entirety.

BACKGROUND

The following disclosure relates to a sheet conveying device and an image forming apparatus capable of detecting the height of sheets on a pressing plate.

There is conventionally known a sheet conveying device including: a pressing plate movable upward and downward while supporting a sheet; and a motor configured to move the pressing plate upward to a suppliable position at which the sheet is in contact with a supply roller and a separating roller. This sheet conveying device calculates the number of sheets supported on the pressing plate, i.e., a sheet remaining amount, based on a driving time and/or a rotation amount of the motor which is required for the pressing plate to move from the lowest position to the suppliable position.

In this sheet conveying device, a driving mechanism including a plurality of gears transmits a driving force from the motor to the pressing plate. However, there are backlash in the gears and looseness between a shaft and a bearing of the gear in the driving mechanism, for example. Thus, variations are caused in a length of time and a rotation amount of the motor from the start of driving of the motor to the start of actual upward movement of the pressing plate. These variations in the length of time and the rotation amount may cause an error in calculation of the number of sheets supported on the pressing plate.

To solve this problem, it has been developed a technique of using a sensor to detect a start of operation of a raising plate for moving the pressing plate upward, then determining the driving time and/or the rotation amount of the motor from the detection of the start of operation of the raising plate to a point in time when the pressing plate moved upward from the lowest position reaches the suppliable position, and then calculating the number of sheets based on this determined value.

Since the number of sheets is calculated as described above based on the driving time and/or the rotation amount of the motor from the start of operation of the raising plate for moving the pressing plate upward, it is possible to remove the variations in the driving time and the rotation amount of the motor which are caused in a period from the start of driving of the motor to the start of operation of the raising plate. This removal reduces an error in the calculated number of the sheets.

SUMMARY

However, the above-described sheet conveying device requires a specific sensor for detecting a start of operation of the raising plate, and a controller of the sheet conveying device requires a specific port for receiving an output of the sensor. This complicates a configuration of the sheet conveying device and leads to increased cost.

Accordingly, an aspect of the disclosure relates to a sheet conveying device and an image forming apparatus capable of detecting a start of upward movement of a pressing plate without using a specific sensor when calculating the number of sheets on the pressing plate based on a driving time and a rotation amount of a motor.

Furthermore, the above-described sheet conveying device can reduce an error in the calculated number of sheets, but in the event of a failure in a mechanism for moving a raising plate and a pressing plate, for example, in the event of a failure in which the pressing plate is not normally moved upward when the raising plate is operated, the above-described sheet conveying device cannot detect the failure.

Accordingly, another aspect of the disclosure relates to a sheet conveying device and an image forming apparatus capable of detecting whether there is a failure in a mechanism for moving a raising plate and a pressing plate when calculating the number of sheets on the pressing plate.

In one aspect of the disclosure, a sheet conveying device includes: a sheet cassette including: (i) a first housing configured to accommodate sheets; (ii) a pressing plate formed of a conductive material, provided at the first housing, and movable between a first position and a second position while supporting the sheets, the first position being a lowest position of the pressing plate, the second position being located above the first position; (iii) a raising plate formed of a conductive material, provided at the first housing, and configured to move the pressing plate between the first position and the second position while being in constant contact with the pressing plate; (iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing; a second housing; a sheet-cassette accommodating portion provided at the second housing and configured to accommodate the sheet cassette; a first electrode provided at the sheet-cassette accommodating portion and configured to be in contact with the second end portion of the first resilient member when the sheet cassette is accommodated in the sheet-cassette accommodating portion; a second electrode provided at the sheet-cassette accommodating portion and configured to be in contact with the second end portion of the second resilient member when the sheet cassette is accommodated in the sheet-cassette accommodating portion; a sheet conveyor provided at the second housing and configured to convey the sheets from the pressing plate; a driver provided at the second housing and configured to move the raising plate, the driver including (a) a motor configured to supply a driving force and (b) a transmission mechanism configured to transmit the driving force supplied from the motor to the raising plate when the sheet cassette is accommodated in the sheet-cassette accommodating portion; a first output device including a detector configured to detect that an uppermost sheet of the sheets supported on the pressing plate reaches a particular position by upward movement of the pressing plate, the first output device being configured to: output a first signal when the first electrode and the second electrode are electrically connected to each other by contact between the pressing plate and the first end portion of the first resilient member and the detector does not detect that the uppermost sheet reaches the particular position; output a second signal when the first electrode and the second electrode are electrically connected to each other by contact between the pressing plate and the first end portion of the first resilient member, and the detector detects that the uppermost sheet reaches the particular position; and output the second signal when the first electrode and the second electrode are not electrically connected to each other by separation between the pressing plate and the first end portion of the first resilient member; a second output device configured to output a rotation pulse signal indicating an amount of rotation of the motor; and a controller configured to receive the first signal, the second signal, and the rotation pulse signal, wherein the controller is configured to: start counting pulses of the rotation pulse signal received from the second output device at a first timing when a signal received from the first output device is switched from the second signal to the first signal; end counting pulses of the rotation pulse signal received from the second output device at a second timing when the signal received from the first output device is switched from the first signal to the second signal; determine the number of pulses of the rotation pulse signal counted between the first timing and the second timing; and determine an amount of upward movement of the pressing plate based on the number of pulses of the rotation pulse signal.

In another aspect of the disclosure, a sheet conveying device includes: a sheet cassette including: (i) a first housing configured to accommodate sheets; (ii) a pressing plate formed of a conductive material, provided at the first housing, and movable between a first position and a second position while supporting the sheets, the first position being a lowest position of the pressing plate, the second position being located above the first position; (iii) a raising plate formed of a conductive material, provided at the first housing, and configured to move the pressing plate between the first position and the second position while being in constant contact with the pressing plate; (iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing; a second housing; a sheet-cassette accommodating portion provided at the second housing and configured to accommodate the sheet cassette; a first electrode provided at the sheet-cassette accommodating portion and configured to be in contact with the second end portion of the first resilient member when the sheet cassette is accommodated in the sheet-cassette accommodating portion; a second electrode provided at the sheet-cassette accommodating portion and configured to be in contact with the second end portion of the second resilient member when the sheet cassette is accommodated in the sheet-cassette accommodating portion; a sheet conveyor provided at the second housing and configured to convey the sheets from the pressing plate; a driver provided at the second housing and configured to move the raising plate, the driver including (i) a motor configured to supply a driving force and (ii) a transmission mechanism configured to transmit the driving force supplied from the motor to the raising plate when the sheet cassette is accommodated in the sheet-cassette accommodating portion; a first output device including a detector configured to detect that an uppermost sheet of the sheets supported on the pressing plate reaches a particular position by upward movement of the pressing plate, the detector including (i) a light emitter configured to emit light when receiving electric power, (ii) a light receiver configured to receive the light emitted from the light emitter, and (iii) an actuator being located between the light emitter and the light receiver to intercept the light emitted from the light emitter when the actuator is being moved in contact with the sheet supported on the pressing plate, the actuator being not located between the light emitter and the light receiver to allow the light receiver to receive the light emitted from the light emitter when the actuator is not in contact with the sheet, the first output device being configured to: output a first signal when the light emitter is receiving electric power and the actuator is not located between the light emitter and the light receiver; output a second signal when the light emitter is receiving electric power and the actuator is located between the light emitter and the light receiver; and output the second signal when the light emitter is not receiving electric power; a controller configured to receive the first signal and the second signal, the controller being configured to output a supply command to supply electric power to the light emitter of the first output device; and a power supply circuit configured to: receive the supply command from the controller when the first electrode and the second electrode are not electrically connected to each other by separation between the pressing plate and the first end portion of the first resilient member; supply electric power to the light emitter of the first output device when the power supply circuit receives the supply command from the controller; supply no electric power to the light emitter when the power supply circuit does not receive the supply command from the controller; and supply electric power to the light emitter when the first electrode and the second electrode are electrically connected to each other by contact between the pressing plate and the first end portion of the first resilient member, wherein the controller is configured to: receive the first signal from the first output device in response to transmitting the supply command to the power supply circuit; stop transmitting the supply command to the power supply circuit in response to receiving the first signal from the first output device; receive the second signal from the first output device in response to stopping transmitting the supply command to the power supply circuit; and provide a notification about a failure when the controller does not receive the first signal when a particular length of time is elapsed from a stop of transmission of the supply command.

In still another aspect of the disclosure, a sheet conveying device includes: a sheet cassette including: (i) a first housing configured to accommodate sheets; (ii) a pressing plate formed of a conductive material, provided at the first housing, and movable between a first position and a second position while supporting the sheets, the first position being a lowest position of the pressing plate, the second position being located above the first position; (iii) a raising plate formed of a conductive material, provided at the first housing, and configured to move the pressing plate between the first position and the second position while being in constant contact with the pressing plate; (iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing; a second housing; a sheet-cassette accommodating portion provided at the second housing and configured to accommodate the sheet cassette; a first electrode provided at the sheet-cassette accommodating portion and configured to be in contact with the second end portion of the first resilient member when the sheet cassette is accommodated in the sheet-cassette accommodating portion; a second electrode provided at the sheet-cassette accommodating portion and configured to be in contact with the second end portion of the second resilient member when the sheet cassette is accommodated in the sheet-cassette accommodating portion; a sheet conveyor provided at the second housing and configured to convey the sheets from the pressing plate; a driver provided at the second housing and configured to move the raising plate, the driver including (i) a motor configured to supply a driving force and (ii) a transmission mechanism configured to transmit the driving force supplied from the motor, to the raising plate when the sheet cassette is accommodated in the sheet-cassette accommodating portion; a first output device including a detector configured to detect that an uppermost sheet of the sheets supported on the pressing plate reaches a particular position by upward movement of the pressing plate, the detector including (i) a light emitter configured to emit light when receiving electric power, (ii) a light receiver configured to receive the light emitted from the light emitter, and (iii) an actuator being located between the light emitter and the light receiver to intercept the light emitted from the light emitter when the actuator is being moved in contact with the sheet supported on the pressing plate, the actuator being not located between the light emitter and the light receiver to allow the light receiver to receive the light emitted from the light emitter when the actuator is not in contact with the sheet, the first output device being configured to: output a first signal when the light emitter is receiving electric power and the actuator is not located between the light emitter and the light receiver; output a second signal when the light emitter is receiving electric power, and the actuator is located between the light emitter and the light receiver; and output the second signal when the light emitter is not receiving electric power; a third output device configured to output a clock pulse signal on a particular cycle; a controller configured to receive the first signal and the second signal; and a power supply circuit configured to: receive the clock pulse signal from the third output device when the first electrode and the second electrode are not electrically connected to each other by separation between the pressing plate and the first end portion of the first resilient member; supply electric power to the light emitter in synchronization with the clock pulse signal to cause the light emitter to intermittently emit light when the power supply circuit receives the clock pulse signal; supply no electric power to the light emitter when the power supply circuit does not receive the clock pulse signal; and supply electric power to the light emitter when the first electrode and the second electrode are electrically connected to each other by contact between the pressing plate and the first end portion of the first resilient member, wherein the controller is configured to: intermittently receive the first signal from the first output device in accordance with the clock pulse signal received by the power supply circuit; control the driver to move the raising plate to move the pressing plate upward in response to intermittently receiving the first signal from the first output device; and provide a notification about a failure when the controller does not continuously receive the first signal from the first output device even when a particular length of time is elapsed from a start of upward movement of the pressing plate.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 17 is a flow chart representing steps at S201-S212 in a process for updating the number of sheets when a power source is turned on;

FIG. 18 is a flow chart representing steps at S213-S220 in the process for updating the number of sheets when the power source is turned on;

FIG. 30 is a flow chart representing steps at S501-S539 in a process for updating the number of sheets when the power source is turned on;

FIG. 31 is a flow chart representing steps at S541-S555 in the process for updating the number of sheets when the power source is turned on;

DETAILED DESCRIPTION OF THE EMBODIMENTS

Hereinafter, there will be described embodiments by reference to the drawings.

First Embodiment

Overall Configuration of Image Forming Apparatus

Figure 1:
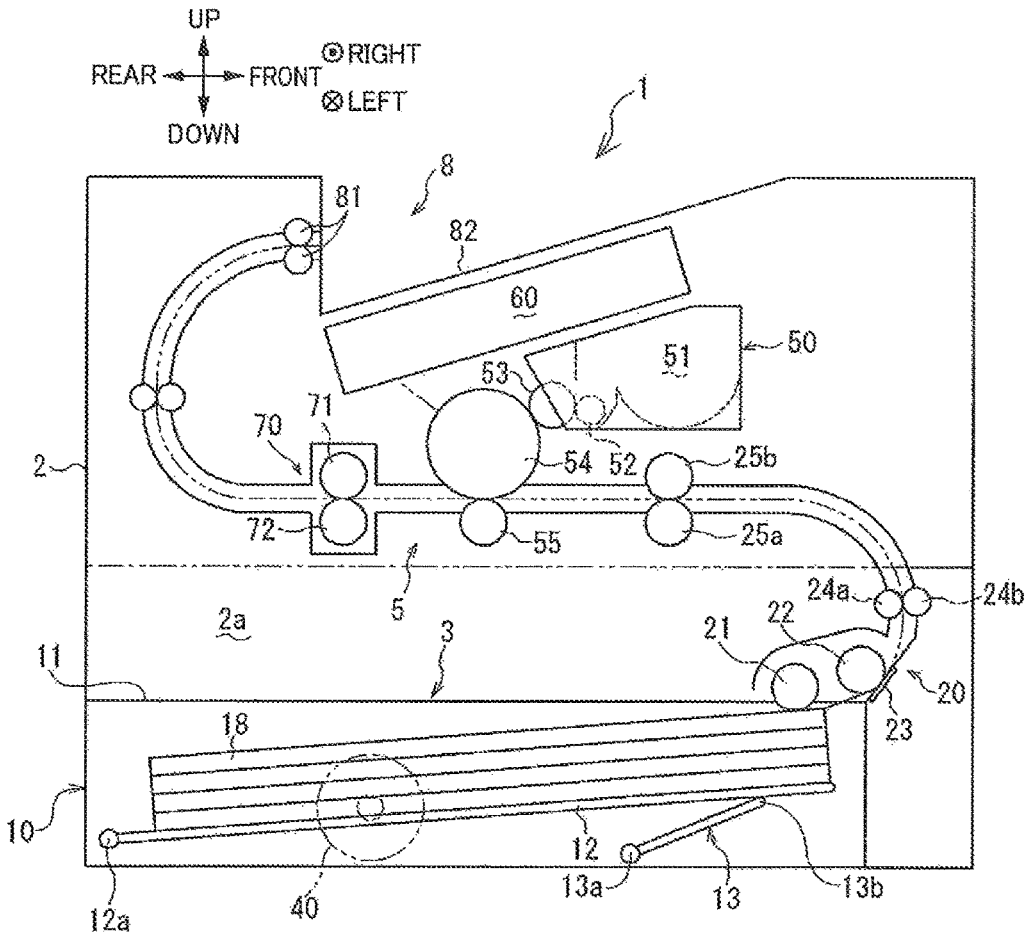
FIG. 1 is a cross-sectional view of a central portion of an image forming apparatus.

FIG. 1 illustrates an image forming apparatus 1 including a sheet conveying device according to a first embodiment. The image forming apparatus 1 includes: a body housing 2; a supply unit 3 including a sheet cassette 10 and a sheet conveyor 20; a sheet-cassette accommodating portion 2*a* provided in the body housing 2 to accommodate the sheet cassette 10; an image forming unit 5; a driver 4 (see FIG. 2) including a motor 40 configured to supply a driving force and a transmission mechanism 41 configured to transmit the driving force supplied from the motor 40; and a controller 6 (see FIG. 6). The sheet conveying device is constituted by devices and components including the body housing 2, the sheet cassette 10, the sheet conveyor 20, the sheet-cassette accommodating portion 2*a*, the driver 4, and the controller 6.

In the following description, a left side and a right side in FIG. 1, and a front side and a back side of the sheet of FIG. 1 are respectively defined as a rear side, a front side, a-right side, and a left side of the image forming apparatus 1. Furthermore, an upper side and a lower side in FIG. 1 are respectively defined as an upper side and a lower side of the image forming apparatus 1.

The body housing 2 is a box having a substantially rectangular parallelepiped shape. The body housing 2 accommodates the supply unit 3, the image forming unit 5, the driver 4, and the controller 6. A lower portion of the body housing 2 serves as the sheet-cassette accommodating portion 2*a*. The sheet cassette 10 is insertable in and removable from the sheet-cassette accommodating portion 2*a*. The body housing 2 is one example of a second housing.

The supply unit 3 is disposed in a lower portion of the image forming apparatus 1. The sheet conveyor 20 of the supply unit 3 conveys each of sheets 18 from the sheet cassette 10 to the image forming unit 5.

The sheet cassette 10 is movable between aft accommodated position and a separated position. At the accommodated position, the sheet cassette 10 is accommodated in the sheet-cassette accommodating portion 2*a* at a predetermined position. At the separated position, the sheet cassette 10 is separated from the sheet-cassette accommodating portion 2*a* and is not accommodated in the sheet-cassette accommodating portion 2*a*. The sheet cassette 10 located at the accommodated position is moved frontward to the separated position. The sheet cassette 10 located at the separated position is moved rearward to the accommodated position. The supply unit 3 includes a cassette sensor 94 (see FIG. 6)

configured to detect whether the sheet cassette 10 is accommodated in the sheet-cassette accommodating portion 2*a*.

Figure 2:
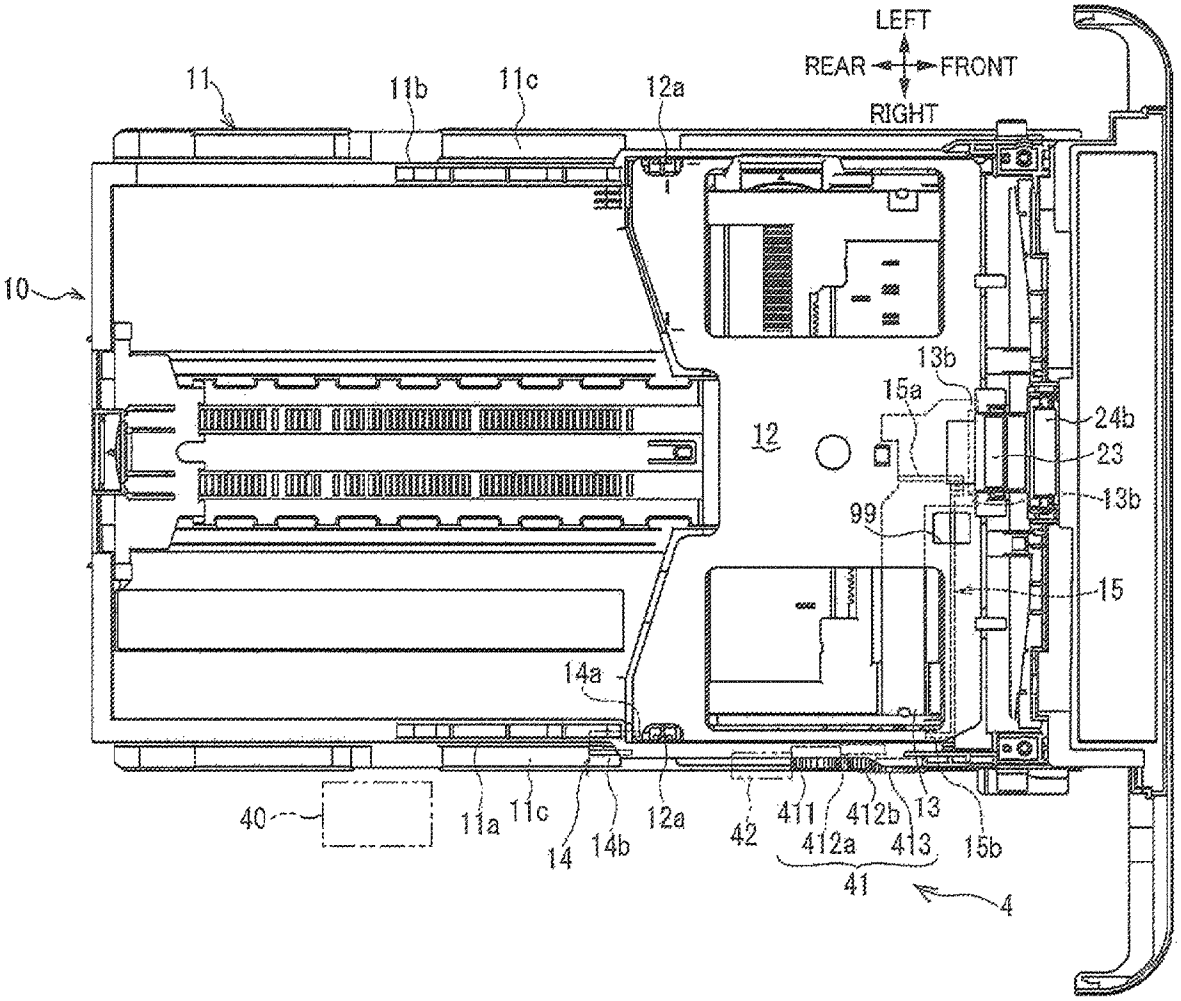
FIG. 2 is a plan view of a sheet cassette.

As illustrated in FIGS. 1 and 2, the sheet cassette 10 includes a cassette body 11, a pressing plate 12, and a raising plate 13. The cassette body 11 is capable of storing the sheets 18. The pressing plate 12 is disposed in the cassette body 11 and configured to support the sheets 18. The pressing plate 12 is movable in the up and down direction between a first position as a lowest position of the pressing plate 12 and a second position located above the first position. The raising plate 13 is disposed in the cassette body 11 at a position located under the pressing plate 12. The raising plate 13 is configured to move the pressing plate 12 in the up and down direction between the first position and the second position while kept in contact with the pressing plate 12. The cassette body 11 is one example of a first housing.

The pressing plate 12 is supported by the cassette body 11 so as to be pivotable about a pivot axis 12*a* located at a rear end portion of the pressing plate 12. The pivotal movement of the pressing plate 12 about the pivot axis 12*a* moves a front end portion of the pressing plate 12 in the up and down direction.

The raising plate 13 is supported by the cassette body 11 so as to be pivotable about a pivot axis 13*a* located at a rear end portion of the raising plate 13. The pivotal movement of the raising plate 13 about the pivot axis 13*a* causes the pressing plate 12 to move in the up and down direction between the first position and the second position. A front end portion of the raising plate 13 serves as a contact portion 13*b* contactable with a lower surface of the pressing plate 12. The raising plate 13 is driven by the driving force supplied from the motor 40. The pressing plate 12 and the raising plate 13 are formed of galvanized sheet iron. That is, each of the pressing plate 12 and the raising plate 13 is a conductor of electricity. It is noted that the pressing plate 12 and the raising plate 13 need not be formed of galvanized sheet iron and may be formed of another conducting material such as another kind of metal and conductive resin.

The transmission mechanism 41 is configured to transmit the driving force supplied from the motor 40, to the raising plate 13. As illustrated in FIG. 2, the transmission mechanism 41 is disposed on a right outer surface 11*a* of the cassette body 11. The transmission mechanism 41 includes: a pressing-plate moving gear 411 engageable with a pressing-plate driving gear 42 connected to the motor 40; a gear 412*a* disposed downstream of the pressing-plate moving gear 411 in a driving-force transmitting direction and engaged with the pressing-plate moving gear 411; a gear 412*b* disposed coaxially with the gear 412*a* and rotated with the gear 412*a*; and a gear 413 disposed downstream of the gear 412*b* in the driving-force transmitting direction and engaged with the gear 412*b*. The gear 413 is connected to the raising plate 13.

The driving force supplied from the motor 40 is input to the pressing-plate moving gear 411 via the pressing-plate driving gear 42. The driving force input to the pressing-plate driving gear 42 is transmitted to the raising plate 13 via the gear 412*a*, the gear 412*b*, and the gear 413 to drive the raising plate 13.

When the raising plate 13 is driven by the motor 40 and pivots upward in the state in which the pressing plate 12 is located at the first position, the raising plate 13 moves the pressing plate 12 upward in a state in which the contact portion 13*b* and the lower surface of the pressing plate 12 are kept in contact with each other. The pressing plate 12 located at the lowest position is moved upward by the raising plate 13 to a sheet suppliable position at which the sheets 18 supported on the pressing plate 12 become suppliable. It is noted that this state is illustrated in FIG. 1, and the sheet suppliable position may be hereinafter used also for the sheets 18.

Figure 3:
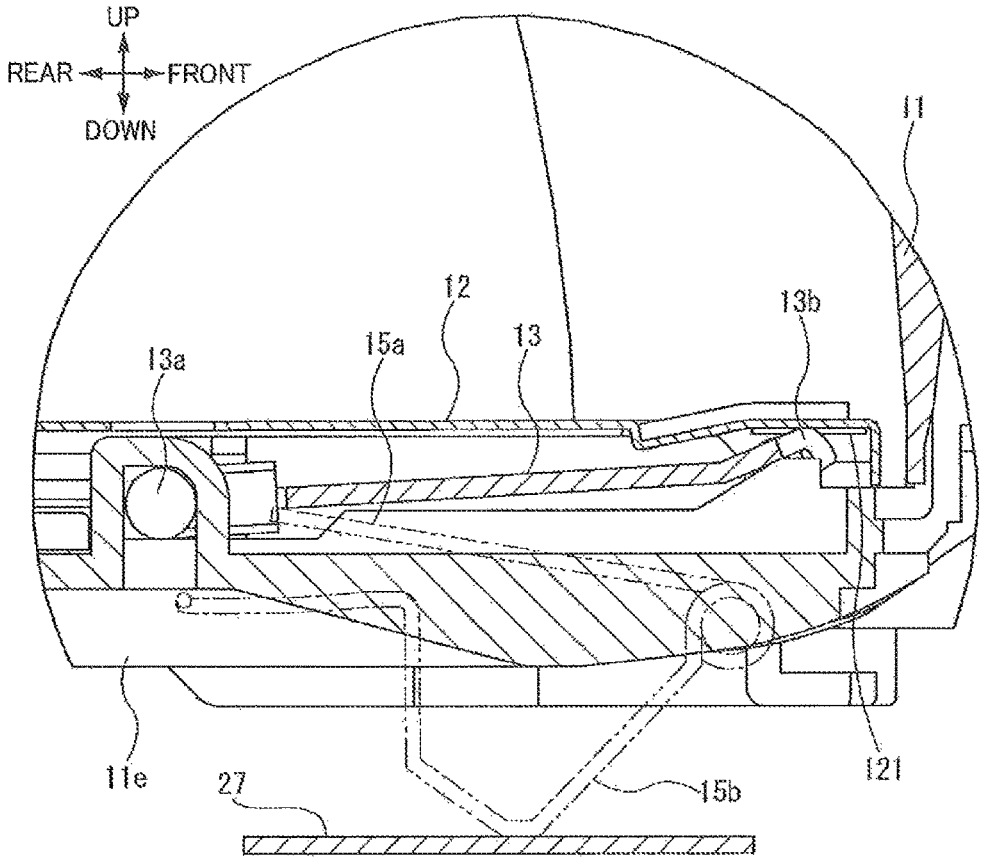
FIG. 3 is a side elevational view in cross section, illustrating an area of contact between a pressing plate and a raising plate.

As illustrated in FIG. 3, the raising plate 13 is always in contact with the pressing plate 12 regardless of a pivotal position of the pressing plate 12, so that the raising plate 13 and the pressing plate 12 are electrically connected to each other. A portion of the pressing plate 12 which is in contact with the raising plate 13 is coated with conductive grease 121. That is, the lower surface of the pressing plate 12 is coated with the conductive grease 121, and the contact portion 13*b* of the raising plate 13 is held in contact with the portion of the pressing plate 12 to which the conductive grease 121 is applied. Since the portion of the pressing plate 12 which is in contact with the raising plate 13 is coated with the conductive grease 121, the pressing plate 12 and the raising plate 13 are electrically connected to each other stably.

The pressing-plate driving gear 42 is provided at the body housing 2. When the sheet cassette 10 is located at the accommodated position, the pressing-plate driving gear 42 and the pressing-plate moving gear 411 of the transmission mechanism 41 are engaged with each other, so that the driving force supplied from the motor 40 is input to the transmission mechanism 41. When the sheet cassette 10 is located at the separated position, the pressing-plate driving gear 42 and the pressing-plate moving gear 411 disengage from each other, so that the driving force supplied from the motor 40 is not input to the transmission mechanism 41.

When the sheet cassette 10 is located at the accommodated position, after the pressing plate 12 located at the first position is moved upward to the second position by the raising plate 13, reverse rotation of the pressing-plate driving gear 42 is prevented by a reverse-rotation preventing mechanism provided between the motor 40 and the pressing-plate driving gear 42. Thus, even when rotation of the motor 40 is stopped, the pressing plate 12 is kept at the second position. When the sheet cassette 10 is moved from the accommodated position to the separated position in the state in which the pressing plate 12 moved upward by the raising plate 13 is located at the second position, the pressing-plate driving gear 42 and the pressing-plate moving gear 411 disengage from each other. Thus, the pressing plate 12 moves downward to the first position as the lowest position.

The sheet conveyor 20 is a mechanism configured to separate an uppermost one of the sheets 18 stored in the sheet cassette 10 from the others and convey the uppermost sheet 18 toward the image forming unit 5. The sheet conveyor 20 includes a pickup roller 21, a separating roller 22, a separator pad 23, a conveying roller 24*a*, and a registering roller 25*a*.

The pickup roller 21 picks up the sheets 18 moved upward to the sheet suppliable position by the pressing plate 12. The pickup roller 21 is disposed above the front end portion of the pressing plate 12. In a state in which the sheets 18 placed on the pressing plate 12 are located at the sheet suppliable position, the sheets 18 are suppliable with an upper end thereof kept in pressing contact with the pickup roller 21 at an appropriate pressure.

In the case where sheets 18 are supported on the pressing plate 12 being moved upward by the raising plate 13, when the pressing plate 12 is moved to the sheet suppliable position at which an upper end of the uppermost sheet of the sheets 18 is in pressing contact with the pickup roller 21, the upward movement of the pressing plate 12 is stopped.

In the case where the sheets 18 are not supported on the pressing plate 12, when the pressing plate 12 reaches the highest position in a movable area of the pressing plate 12 in the up and down direction, the upward movement of the pressing plate 12 is stopped. The highest position in the movable area of the pressing plate 12 in the up and down direction is set at a position at which the pressing plate 12 is in pressing contact with the pickup roller 21, for example.

The separating roller 22 is disposed downstream of the pickup roller 21 in a sheet conveying direction in which the sheet 18 is conveyed. The separator pad 23 is opposed to the separating roller 22 and urged toward the separating roller 22. The sheets 18 picked up by the pickup roller 21 are supplied toward the separating roller 22 and separated from one another between the separating roller 22 and the separator pad 23, and the separated sheet 18 is conveyed toward the conveying roller 24*a*.

The conveying roller 24*a* applies a conveyance force to the sheet 18 and is disposed downstream of the separating roller 22 in the sheet conveying direction. A sheet-dust removing roller 24*b* is opposed to the conveying roller 24*a*. The sheet 18 conveyed toward the conveying roller 24*a* is nipped by the conveying roller 24*a* and the sheet-dust removing roller 24*b* and conveyed toward the registering roller 25*a*.

The registering roller 25*a* is disposed downstream of the conveying roller 24*a* in the sheet conveying direction. A registering roller 25*b* is opposed to the registering roller 25*a*. The registering roller 25*a* cooperates with the registering roller 25*b* to temporarily stop movement of a leading edge of the sheet 18 being conveyed and then conveys the sheet 18 toward a transfer position at a predetermined timing.

The image forming unit 5 is disposed downstream of the supply unit 3 in the sheet conveying direction and configured to form an image on the sheet 18 conveyed from the supply unit 3. The image forming unit 5 includes: a process cartridge 50 configured to transfer an image onto a surface of the sheet 18 conveyed from the supply unit 3; an exposing unit 60 configured to expose a surface of a photoconductor dram 54 of the process cartridge 50; and a fixing unit 70 configured to fix the image transferred to the sheet 18 by the process cartridge 50.

The process cartridge 50 is disposed in the body housing 2 at a position located above the sheet-cassette accommodating portion 2*a*. The process cartridge 50 includes a developer storage chamber 51, a supply roller 52, a developing roller 53, the photoconductor drum 54, and a transfer roller 55.

The exposing unit 60 includes a laser diode, a polygon mirror, lenses, and a reflective mirror. The exposing unit 60 exposes a surface of the photoconductor drum 54 by emitting laser light toward the photoconductor drum 54 based on image data input to the image forming apparatus 1.

The developer storage chamber 51 contains toner as a developer. The toner contained in the developer storage chamber 51 is supplied to the supply roller 52 while being agitated by an agitator, not illustrated. The toner supplied from the developer storage chamber 51 is further supplied to the developing roller 53 by the supply roller 52.

The developing roller 53 is disposed in close contact with the supply roller 52 and configured to bear the toner supplied from the supply roller 52 and positively charged by a slider, not illustrated. Also, a positive developing bias is applied to the developing roller 53 by a bias applier, not illustrated.

The photoconductor drum 54 is disposed next to the developing roller 53. The surface of the photoconductor drum 54 is positively charged uniformly by a charging unit, not illustrated, and then exposed by the exposing unit 60. Areas of the photoconductor drum 54 that are exposed to light are lower in electric potential than the other area of the photoconductor drum 54, so that an electrostatic latent image is formed on the photoconductor drum 54 based on the image data. The positively charged toner is supplied from the developing roller 53 to the surface of the photoconductor drum 54 with the electrostatic latent image formed thereon, whereby the electrostatic latent image is made visible to form a developed image.

The transfer roller 55 is opposed to the photoconductor drum 54, and a negative transfer bias is applied to the transfer roller 55 by the bias applier, not illustrated. At the transfer position, the sheet 18 is nipped between and conveyed by the photoconductor drum 54 with the developed image formed thereon and the transfer roller 55 with the transfer bias on the surface of the transfer roller 55. As a result, the developed image formed on the surface of the photoconductor drum 54 is transferred to the surface of the sheet 18.

The fixing unit 70 includes a heat roller 71 and a pressure roller 72. The heat roller 71 is rotated by the driving force supplied from the motor 40 and is heated by electric power supplied from a power source, not illustrated. The pressure roller 72 is opposed to the heat roller 71 and rotated by the heat roller 71 in close contact therewith. When the sheet 18 on which the developed image is transferred is conveyed to the fixing unit 70, the sheet 18 is nipped and conveyed by the heat roller 71 and the pressure roller 72 to fix the developed image to the sheet 18.

A discharge unit 8 is disposed downstream of the image forming unit 5 in the sheet conveying direction and configured to discharge the sheet 18 on which the image is formed by the image forming unit 5, to an outside of the body housing 2. The discharge unit 8 includes a pair of discharge rollers 81 and a discharge tray 82. The discharge rollers 81 discharge the sheet 18 conveyed from the fixing unit 70, to the outside of the body housing 2. The discharge tray 82 is formed on an upper surface of the body housing 2 so as to support the sheets 18 discharged by the discharge rollers 81 to the outside of the body housing 2 and stacked on each other.

The image forming apparatus 1 includes a sheet sensor 9 (as one example of a detector). When the pressing plate 12 is moved upward from the first position, the sheet sensor 9 contacts the uppermost one of the sheets 18 supported on the pressing plate 12 and thereby detects that the sheets 18 have been moved to their upper position by upward movement of the pressing plate 12. As illustrated in FIGS. 4A, 4B, 4C, and 11, the sheet sensor 9 includes a contact member 91, a detector 92, and an actuator 93. The contact member 91 is pivotable about a pivot center 91*a*. When the pressing plate 12 is moved upward, the contact member 91 pivots by contacting the uppermost one of the sheets 18 supported on the pressing plate 12.

The detector 92 is a photo interrupter including a light emitter 92*a* and a light receiver 92. The light emitter 92*a* is a light emitting element which is a light source configured to emit light when electric power is supplied to the light emitter 92*a*. The light receiver 92*b* is a light receiving element configured to receive and detect the light emitted from the light emitter 92*a*. The actuator 93 is pivotable about the pivot center 91*a* with the contact member 91 and movable between a position located between the light emitter 92*a* the light receiver 92*b* and a position not located between the light emitter 92*a* and the light receiver 92*b*.

When the contact member 91 is not in contact with the uppermost one of the sheets 18 supported on the pressing plate 12, the actuator 93 is located at the position not located between the light emitter 92*a* and the light receiver 92*b*. When the contact member 91 pivots by contact with the uppermost one of the sheets 18 supported on the pressing plate 12, the actuator 93 is moved to the position located between the light emitter 92*a* and the light receiver 92*b*.

When the actuator 93 is not located between the light emitter 92*a* and the light receiver 92*b*, the light emitted from the light emitter 92*a* is received by the light receiver 92*b*, and the sheet sensor 9 does not detect the sheets 18 supported on the pressing plate 12. When the actuator 93 is located between the light emitter 92*a* and the light receiver 92*b*, the light emitted from the light emitter 92*a* is intercepted by the actuator 93, and the light emitted from the light emitter 92*a* is not received by the light receiver 92*b*. In this case, the sheet sensor 9 detects the uppermost one of the sheets 18 supported on the pressing plate 12.

That is, the actuator 93 is moved by the sheet 18 being in contact with the actuator 93, and when the actuator 93 is in contact with the sheet 18, the actuator 93 is located between the light emitter 92*a* and the light receiver 92*b* and intercepts the light emitted from the light emitter 92*a*, while when the actuator 93 is not in contact with the sheet 18, the actuator 93 is not located between the light emitter 92*a* and the light receiver 92*b* and does not intercept the light emitted from the light emitter 92*a*.

Figure 4A:
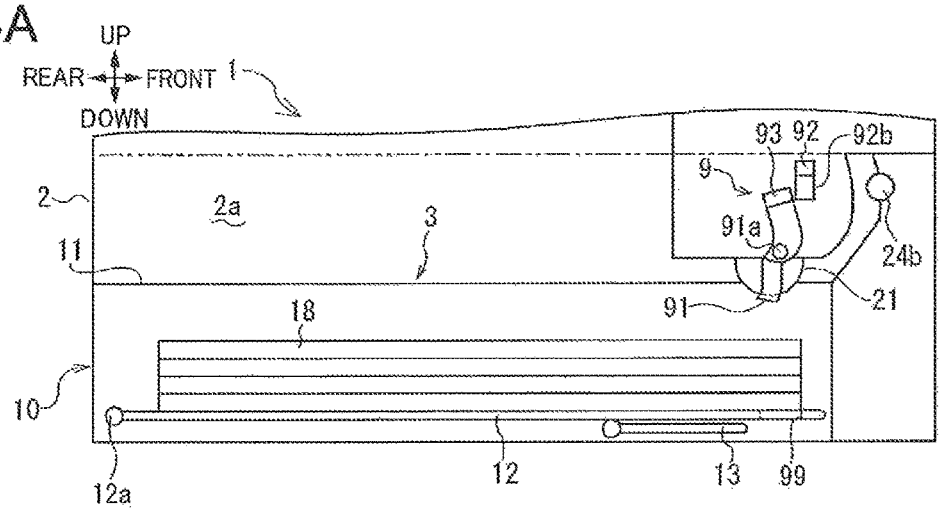
FIG. 4A is a side elevational view in cross section, illustrating the image forming apparatus in a state in which the pressing plate supporting sheets is located at a lowest position.

This configuration enables the sheet sensor 9 to detect the uppermost sheet 18 when the pressing plate 12 is moved upward. Specifically, as illustrated in FIG. 4A, when the pressing plate 12 is located at the first position, the contact member 91 does not pivot because the contact member 91 does not contact the sheets 18 supported on the pressing plate 12. Thus, the actuator 93 is located at the position not located between the light emitter 92*a* and the light receiver 92*b*. Accordingly, the light emitted from the light emitter 92*a* is received by the light receiver 92*b*, and the sheet sensor 9 does not detect any sheets 18.

Figure 4B:
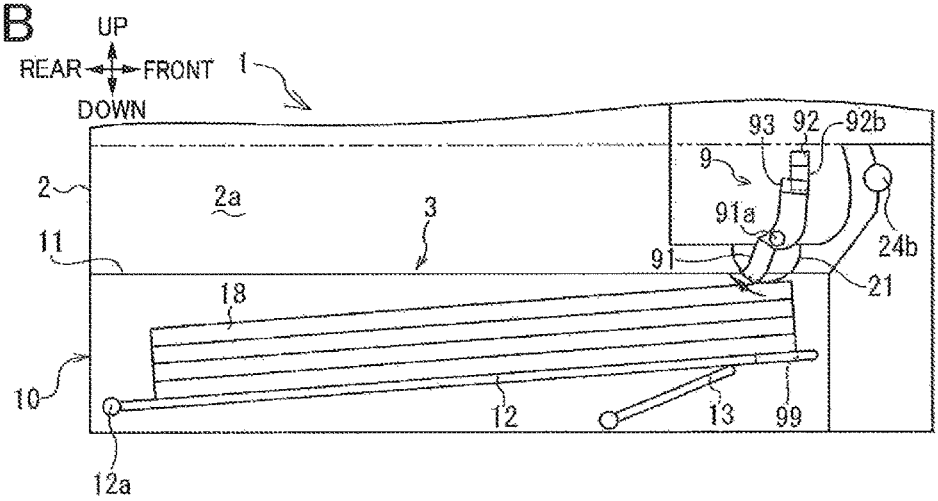
FIG. 4B is a side elevational view in cross section, illustrating the image forming apparatus in a state in which a sheet sensor is in contact with an uppermost sheet by upward movement of the pressing plate supporting the sheets.

In contrast, as illustrated in FIG. 4B, when the pressing plate 12 is moved upward from the first position, and the contact member 91 contacts the uppermost sheet 18, the contact member 91 pivots about the pivot center 91*a*, and the actuator 93 is moved to the position located between the light emitter 92*a* and the light receiver 92*b*. Accordingly, the light emitted from the light emitter 92*a* is intercepted by the actuator 93 and is not received by the light receiver 92*b*, and the sheet sensor 9 detects the uppermost sheet 18.

Figure 4C:
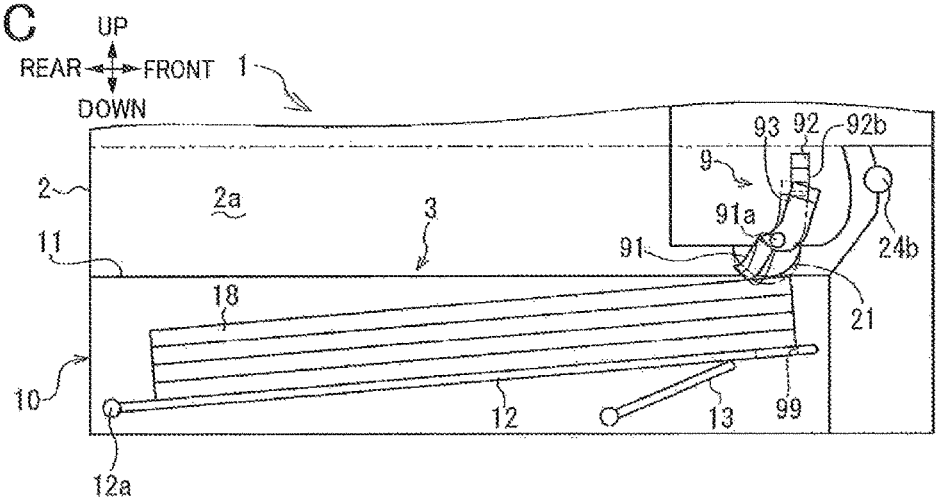
FIG. 4C is a side elevational view in cross section, illustrating the image forming apparatus in a state in which a pickup roller is in contact with the uppermost sheet by upward movement of the pressing plate supporting the sheets.

In the case where the pressing plate 12 is moved upward by the driving force of the motor 40 via the raising plate 13, the upward movement of the pressing plate 12 continues even after the contact member 91 contacts the sheet 18. As illustrated in FIG. 4C, when the pressing plate 12 is moved upward after the contact member 91 contacts the sheet 18, the upper end of the uppermost sheet of the sheets 18 supported on the pressing plate 12 contacts the pickup roller 21. The pickup roller 21 is movable upward and downward. The pickup roller 21 being in contact with the uppermost sheet 18 is moved upward by the sheets 18.

When the pickup roller 21 is pushed upward by the sheets 18, a clutch disengages transmission of the driving force from the motor 40 to the raising plate 13, so that the upward movement of the pressing plate 12 is stopped. The position of the pressing plate 12 at which the upward movement of the pressing plate 12 is stopped is the sheet suppliable position at which the sheet 18 is suppliable in the state in which the upper end of the uppermost sheet of the sheets 18 is in pressing contact with the pickup roller 21.

The image forming apparatus 1 is configured to calculate the number of sheets 18 stored in the sheet cassette 10, based on an amount of upward movement of the pressing plate 12 from the first position to a position at which the sheet sensor 9 detects the uppermost one of the sheets 18. In this calculation, the amount of upward movement of the pressing plate 12 is obtained based on the number of rotations of the motor 40, for example.

In the case where no sheets 18 are placed on the pressing plate 12, even when the pressing plate 12 is moved upward to the position of the contact member 91, the contact member 91 does not pivot, and the sheet sensor 9 does not detect any sheets 18.

Specifically, as illustrated in FIG. 2, a hole 99 is formed through the pressing plate 12. In a state in which no sheets 18 are placed on the pressing plate 12, a position of the hole 99 in the pressing plate 12 is such a position that the contact member 91 is partly located in the hole 99 and does not pivot even when the pressing plate 12 is moved upward. In the state in which a sheet 18 is placed on the pressing plate 12, the position of the hole 99 in the pressing plate 12 is such a position that the hole 99 is covered with the sheet 18, and the contact member 91 pivots by contacting the sheet 18 when the pressing plate 12 is moved upward.

Figure 5A:
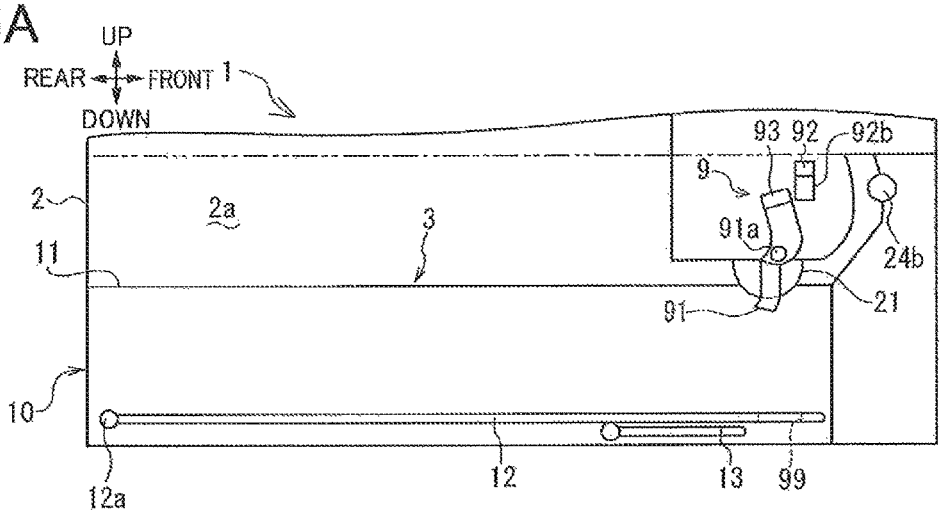
FIG. 5A is a side elevational view in cross section, illustrating the image thrilling apparatus in a state in which the pressing plate supporting no sheets is located at the lowest position.

For example, as illustrated in FIG. 5A, in a state in which the pressing plate 12 supporting no sheets 18 is located at the first position, the contact member 91 does not pivot because the contact member 91 does not contact the pressing plate 12. Thus, the actuator 93 is located at the position not located between the light emitter 92*a* and the light receiver 92*b*. In this case, the light emitted from the light emitter 92*a* is received by the light receiver 92*b*, and the sheet sensor 9 does not detect any sheets 18.

Figure 5B:
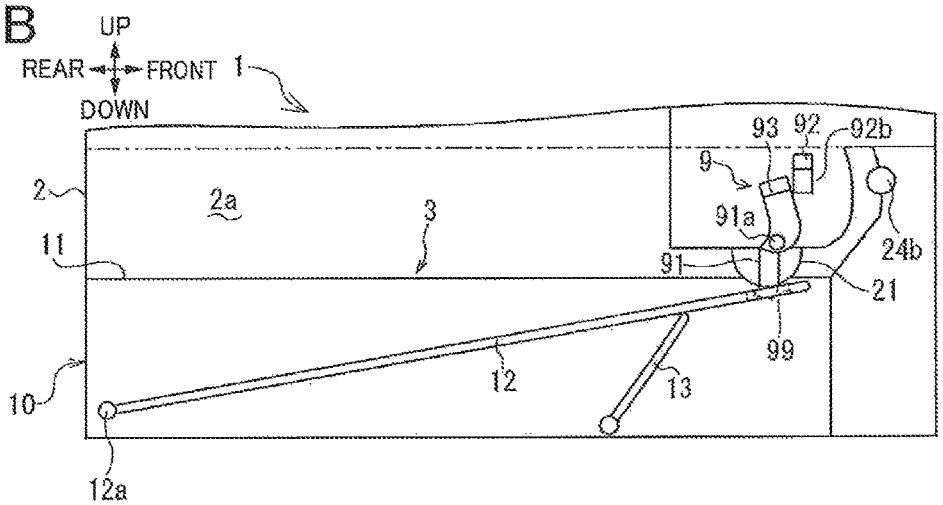
FIG. 5B is a side elevational view in cross section, illustrating the image forming apparatus in a state in which the pressing plate supporting no sheets is moved upward to a position of the sheet sensor.

In a state in which the pressing plate 12 supporting no sheets 18 is moved upward and located at a position illustrated in FIG. 5B, the front end portion of the pressing plate 12 is located above a lower end of the contact member 91, but the contact member 91 does not pivot because the contact member 91 is partly located in the hole 99 formed in the pressing plate 12. Thus, the actuator 93 is not located between the light emitter 92*a* and the light receiver 92*b*, and the light emitted from the light emitter 92*a* is received by the light receiver 92*b*. Accordingly, the sheet sensor 9 detects no sheets 18.

Figure 5C:
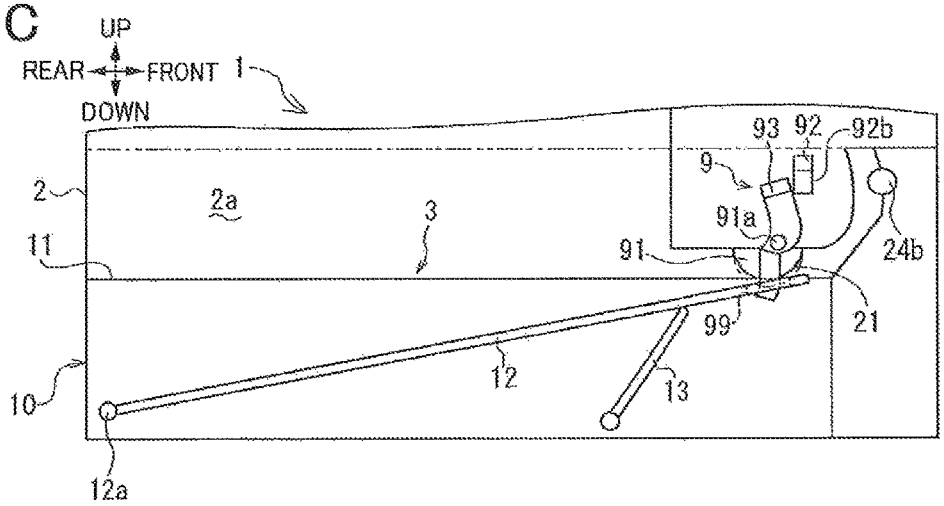
FIG. 5C is a side elevational view in cross section, illustrating the image forming apparatus in a state in which the pickup roller is in contact with the pressing plate by upward movement of the pressing plate supporting no sheets.

When the pressing plate 12 moved upward to the position illustrated in FIG. 5B is further moved upward, as illustrated in FIG. 5C, the pressing plate 12 contacts the pickup roller 21. The pressing plate 12 having contacted the pickup roller 21 pushes the pickup roller 21 upward. When the pickup roller 21 is pushed upward by the pressing plate 12, the clutch disengages the transmission of the driving force from the motor 40 to the raising plate 13, so that the upward movement of the pressing plate 12 is stopped. The upper position of the pressing plate 12 when this upward movement of the pressing plate 12 is stopped is the highest position in the movable area of the pressing plate 12 in the up and down direction.

In the configuration as described above, the pressing plate 12 has the hole 99, and the detector 92 detects the presence or absence of pivotal movement of the contact member 91 when the pressing plate 12 is moved upward. This makes it possible to determine whether a sheet or sheets 18 are placed on the pressing plate 12.

The controller 6 is provided in the body housing 2 and controls operations of the motor 40. Furthermore, when the pressing plate 12 is moved upward via the raising plate 13 by the driving force supplied from the motor 40, the controller 6 determines a rotation amount of the motor 40 such as the number of rotations of the motor 40 and calculates the number of sheets 18 stored in the sheet cassette 10, based on the determined rotation amount.

Figure 6:
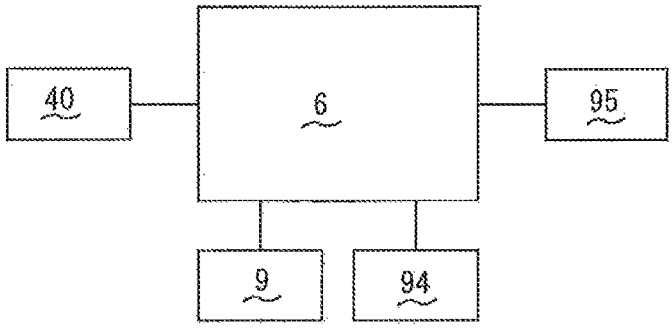
FIG. 6 is a block diagram illustrating a controller, and a motor, a sheet sensor, a cassette sensor, and a rotation-pulse-signal output device which are connected to the controller.

As illustrated in FIG. 6, the motor 40, the sheet sensor 9, and the cassette sensor 94 are connected to the controller 6. The image forming apparatus 1 includes a rotation-pulse-signal output device 95 (as one example of a second output device) configured to output a rotation pulse signal that indicates the number of rotations of the motor 40. The rotation-pulse-signal output device 95 is connected to the controller 6.

The sheet sensor 9 outputs a first signal when the light emitted from the light emitter 92*a* is received by the light receiver 92*b*. The sheet sensor 9 outputs a second signal when the light emitted from the light emitter 92*a* is not received by the light receiver 92*b*. The controller 6 is configured to receive (i) the first signal and the second signal output from the sheet sensor 9 and (ii) the rotation pulse signal output from the rotation-pulse-signal output device 95.

Configuration for Calculating the Number S of Sheets

Figure 7:
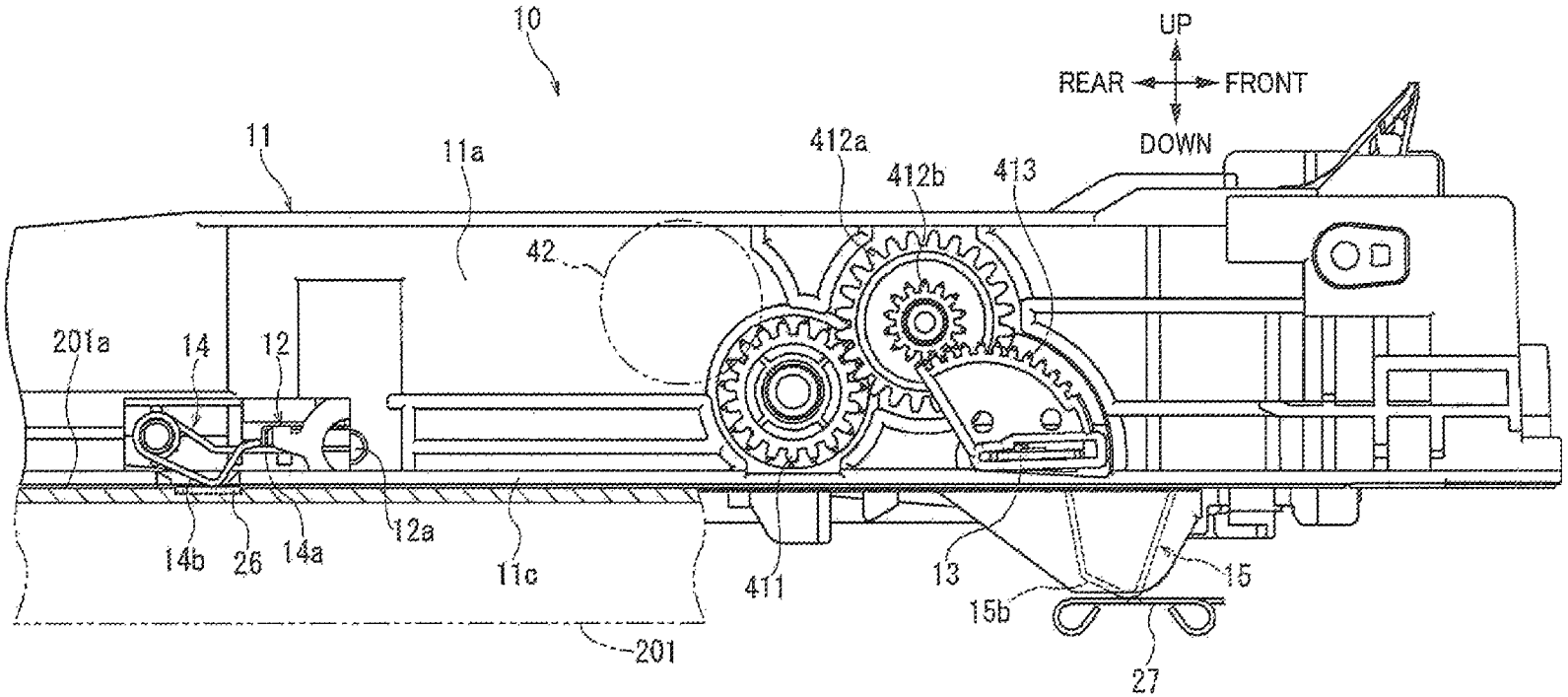
FIG. 7 is a side elevational view in cross section, illustrating the sheet cassette located at an accommodated position.
Figure 8:
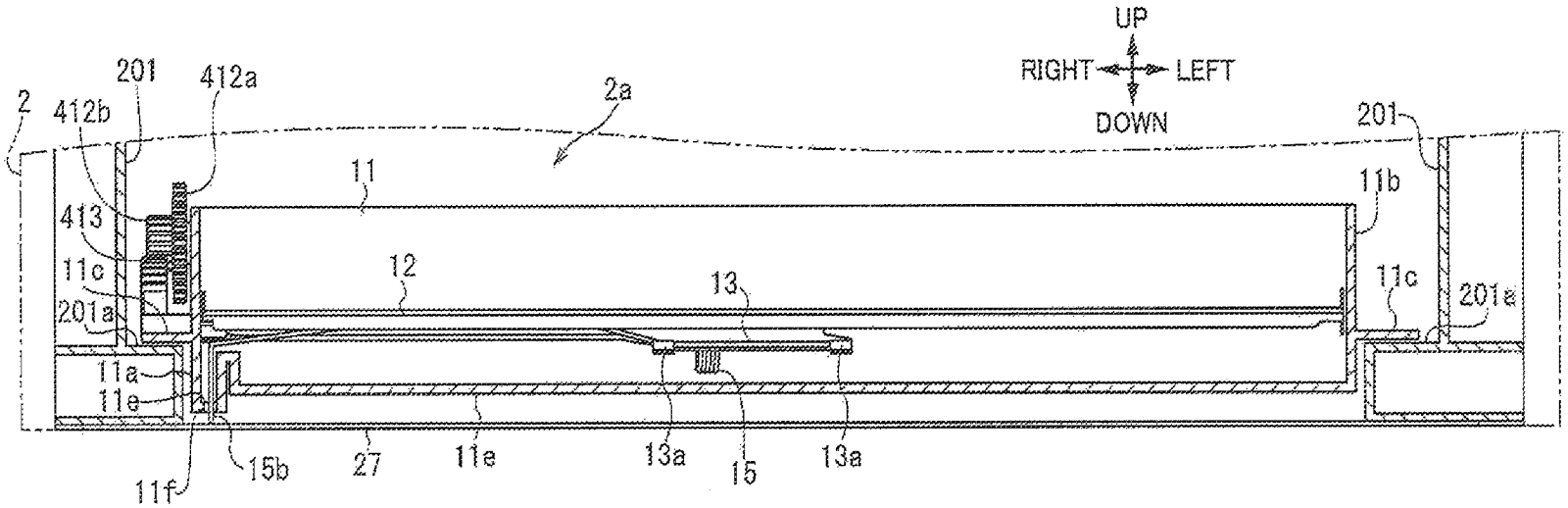
FIG. 8 is a front elevational view in cross section, illustrating the sheet cassette located at the accommodated position.

There will be next described a configuration of the sheet conveying device for calculating the number S of sheets 18 and reducing an error in calculation of the number S of sheets 18. As illustrated in FIGS. 2, 7, and 8, the sheet cassette 10 includes: a first resilient member 14 provided at the cassette body 11 and contactable with a back surface of the pressing plate 12; and a second resilient member 15 provided at the cassette body 11 and contactable with a back surface of the raising plate 13.

The first resilient member 14 is configured such that its first end portion 14*a* is separated from the pressing plate 12 when the pressing plate 12 is located at the first position and such that the first end portion 14*a* is in contact with the pressing plate 12 when the pressing plate 12 is moved in a direction directed from the first position toward the second position. The first resilient member 14 has electric conductivity and resiliency. A second end portion 14*b* of the first resilient member 14 is partially located outside the cassette body 11.

Figure 9A:
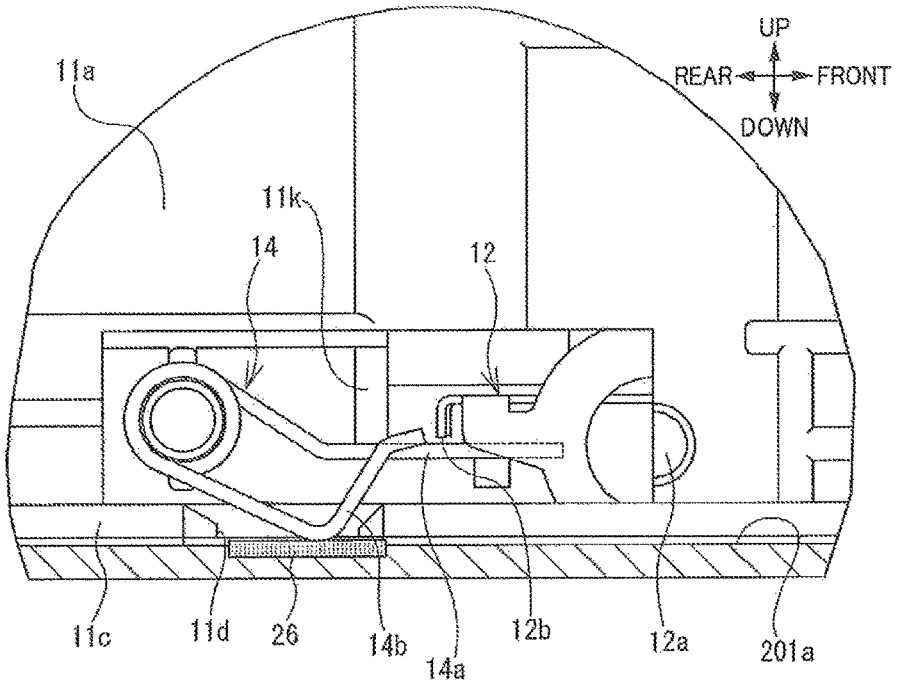
FIG. 9A is a side elevational view in cross section, illustrating an area of contact between the pressing plate and a first resilient member in a state in which an edge portion of the pressing plate and a first end of the first resilient member are separated from each other.
Figure 9B:
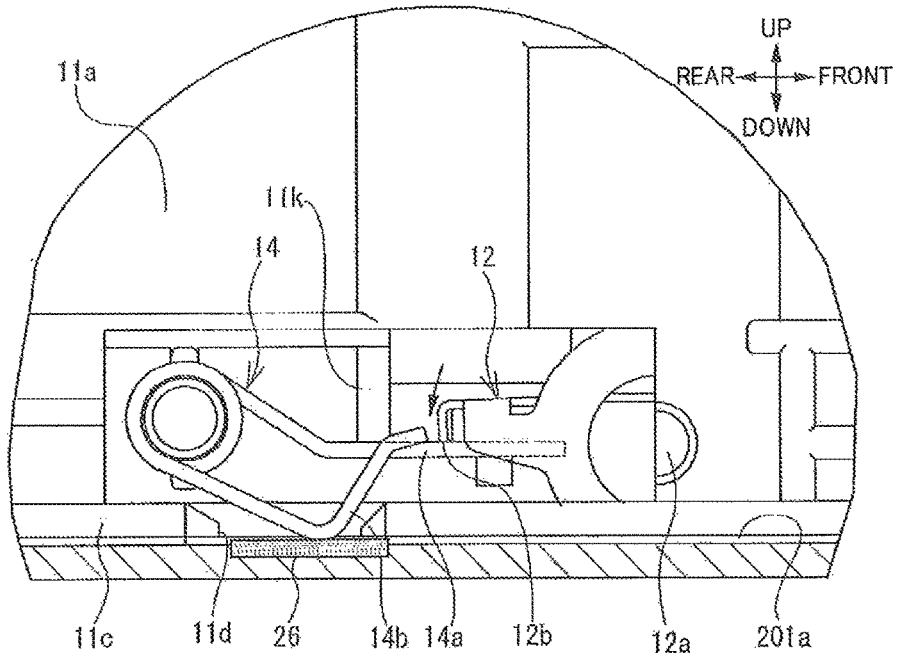
FIG. 9B is a side elevational view in cross section, illustrating the area of contact between the pressing plate and the first resilient member in a state in which the edge portion of the pressing plate and the first end of the first resilient member are in contact with each other.

Specifically, as illustrated in FIGS. 2, 9A, and 9B, the first resilient member 14 is, for example, a torsion spring disposed on a right side portion of the cassette body 11. The first end portion 14*a* of the first resilient member 14 is contactable with an edge portion 12*b* of the pressing plate 12 which is located at a rear of the pivot axis 12*a*. The first end portion 14*a* of the first resilient member 14 is urged upward by a resilient force of the first resilient member 14 and engaged with an engaging portion 11*k* formed on the cassette body 11. This engagement limits further upward movement of the first end portion 14*a*.

As illustrated in FIG. 9A, when the pressing plate 12 is located at the first position, the first resilient member 14 and the pressing plate 12 are separated from each other, forming a space between the first end portion 14*a* of the first resilient member 14 and the edge portion 12*b* of the pressing plate 12. As illustrated in FIG. 9B, when the pressing plate 12 is moved in the direction directed from the first position toward the second position, the edge portion 12*b* of the pressing plate 12 moves downward and contacts the first end portion 14*a* of the first resilient member 14. After the edge portion 12*b* contacts the first end portion 14*a*, when the pressing plate 12 is further moved toward the second position, the first end portion 14*a* of the first resilient member 14 is pressed downward by the edge portion 12*b* of the pressing plate 12 against the urging force.

When the first end portion 14*a* of the first resilient member 14 is in contact with the edge portion 12*b* of the pressing plate 12, the first resilient member 14 and the pressing plate 12 are electrically connected to each other. For example, in the case where the pressing plate 12 is formed by press forming of the galvanized sheet iron, a surface of the pressing plate 12 is coated with a material having low conductivity. However, the edge portion 12*b* of the pressing plate 12 is not coated with the material and has high conductivity because the edge portion 12*b* serves as a cutting surface in press forming. Accordingly, the contact between the first end portion 14*a* of the first resilient member 14 and the edge portion 12*b* of the pressing plate 12 ensures reliable contact between the first resilient member 14 and the pressing plate 12, resulting in stable electric connection between the first resilient member 14 and the pressing plate 12.

The second end portion 14*b* of the first resilient member 14 is located to the right of the right outer surface 11*a* of the cassette body 11. Ribs 11*c* are respectively formed on the right outer surface 11*a* and a left outer surface 11*b* of the cassette body 11 so as to protrude outward. The rib 11*c* formed on the right outer surface 11*a* has a through hole 11*d* extending through the rib 11*c* in the up and down direction. The second end portion 14*b* of the first resilient member 14 is urged downward by the resilient force of the first resilient member 14 so as to protrude through the through hole 11*d* to a position below the rib 11*c*.

As illustrated in FIG. 3, a first end portion 15*a* of the second resilient member 15 is kept in contact with the back surface of the raising plate 13 during the movement of the raising plate 13 in the up and down direction. The second resilient member 15 has electric conductivity and resiliency. For example, the second resilient member 15 is formed of a torsion spring. The second resilient member 15 is disposed in a compressed state between the raising plate 13 and a bottom surface of the cassette body 11. A second end portion 15*b* of the second resilient member 15 partially protrudes to an outside of the cassette body 11. Specifically, the second end portion 15*b* partially protrudes downward to a position located below a bottom surface 11*e* of the cassette body 11. The bottom surface lie of the cassette body 11 has a through hole 11*f* (see FIG. 8) through which the second end portion 15*b* partially protrudes to the position located below the bottom surface 11*e*.

As illustrated in FIG. 8, side frames 201 each extending in the front and rear direction are respectively provided in right and left end portions of the body housing 2. Rails 201*a* are provided at the respective right and left side frames 201 in the sheet-cassette accommodating portion 2*a* so as to protrude inward from the respective side frames 201 in the right and left direction. The ribs lie of the cassette body 11 are slidable on upper surfaces of the respective rails 201*a*. When the sheet cassette 10 is moved between the accommodated position and the separated position, the sheet cassette 10 is moved with sliding movement of the ribs 11*c* on the respective rails 201*a*. That is, when each of the rails 201*a* is a guide member for guiding the sheet cassette 10 when the sheet cassette 10 is moved between the accommodated position and the separated position.

The sheet-cassette accommodating portion 2*a* of the body housing 2 includes a first electrode 26 and a second electrode 27. The through hole 11*d* of the sheet cassette 10 and the second end portion 14*b* of the first resilient member 14 are provided at such positions that the second end portion 14*b* of the first resilient member 14 is in contact with the first electrode 26 when the sheet cassette 10 is located at the accommodated position. The through hole 11*f* of the sheet cassette 10 and the second end portion 15*b* of the second resilient member 15 are provided at such positions that the second end portion 15*b* of the second resilient member 15 is in contact with the second electrode 27 when the sheet cassette 10 is located at the accommodated position.

The first electrode 26 is plate-shaped and disposed on the right rail 201*a* in the body housing 2. The first electrode 26 is a conductor of electricity. The first electrode 26 is disposed under the through hole 11*d* that is formed in the rib 11*c* formed on the right outer surface 11*a* of the cassette body 11. When the sheet cassette 10 is located at the accommodated position, the first electrode 26 is in contact with the second end portion 14*b* of the first resilient member 14 which partially protrudes downward from the through hole 11*d*. In this state, the first electrode 26 is held in pressing contact with the second end portion 14*b* such that the first resilient member 14 is bent against the resilient force of the first resilient member 14. The second end portion 14*b* of the first resilient member 14 is configured to contact the first electrode 26 slidably in the front and rear direction coinciding with the direction of movement of the sheet cassette 10. The first electrode 26 is electrically connected to the sheet sensor 9.

The second electrode 27 is a frame extending in the right and left direction between the right and left side frames 201 in a lower portion of the sheet-cassette accommodating portion 2*a*. The second electrode 27 is a conductor of electricity and reinforces the body housing 2. When the sheet cassette 10 is located at the accommodated position, the second electrode 27 is disposed and grounded at a position which is located under the sheet cassette 10 and to which the second end portion 15*b* protrudes. The second electrode 27 is held in pressing contact with the second end portion 15*b* of the second resilient member 15 such that the second resilient member 15 is bent against a resilient force of the second resilient member 15. The second end portion 15*b* of the second resilient member 15 is configured to contact the second electrode 27 slidably in the front and rear direction in which the sheet cassette 10 is moved.

Figure 10:
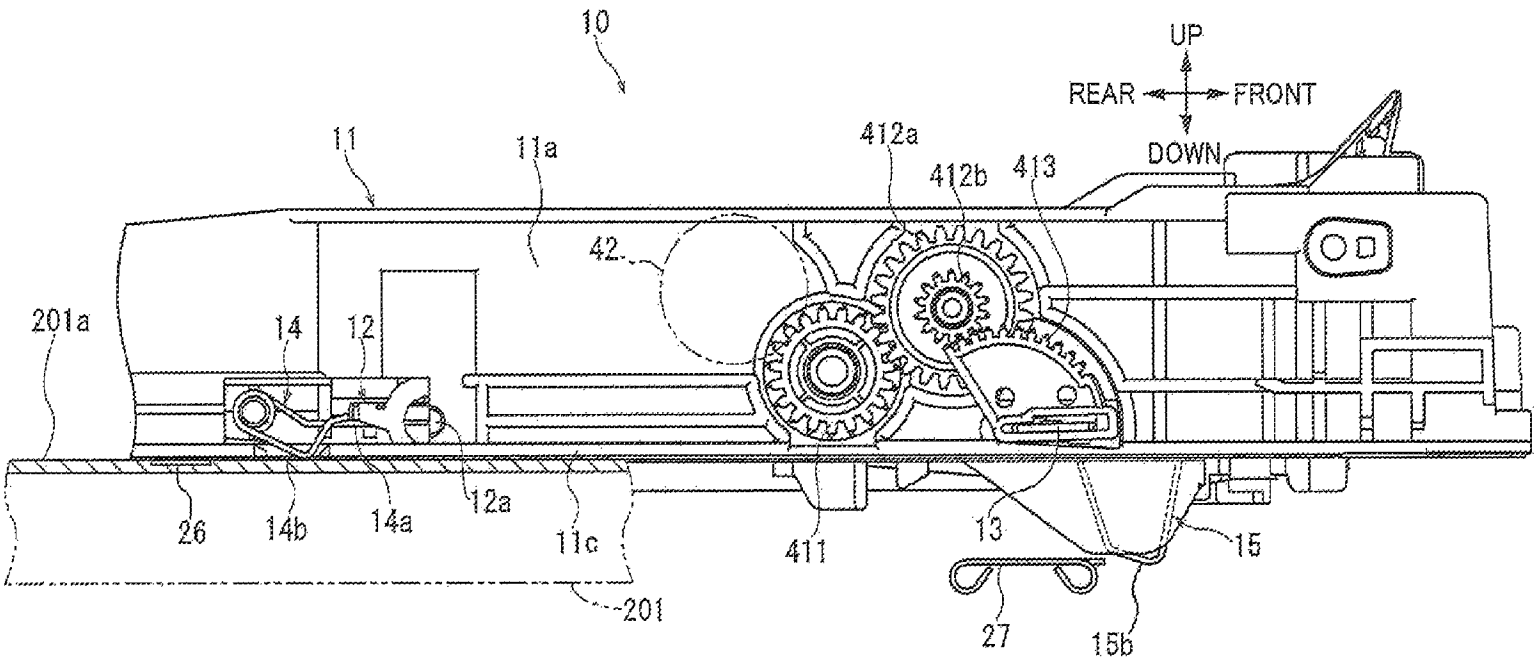
FIG. 10 is a side elevational view in cross section, illustrating the sheet cassette located at a separated position.

When the sheet cassette 10 is located at the accommodated position, as described above, the second end portion 14*b* of the first resilient member 14 is in contact with the first electrode 26 so as to be slidable in the front and rear direction, and the second end portion 15*b* of the second resilient member 15 is in contact with the second electrode 27 so as to be slidable in the front and rear direction. Thus, when the sheet cassette 10 is located at the accommodated position, as illustrated in FIG. 7, the first resilient member 14 and the second resilient member 15 are held in reliable contact with the first electrode 26 and the second electrode 27, respectively, and when the sheet cassette 10 is moved from the accommodated position toward the separated position, as illustrated in FIG. 10, the first resilient member 14 and the second resilient member 15 are reliably disconnected from the first electrode 26 and the second electrode 27, respectively.

Also, when the sheet cassette 10 is located at the accommodated position, the first end portion 14*a* of the first resilient member 14 and the edge portion 12*b* of the pressing plate 12 are in contact with each other. As a result, the first electrode 26 and the second electrode 27 are electrically connected to each other. When the first end portion 14*a* of the first resilient member 14 and the edge portion 12*b* of the pressing plate 12 are separated from each other, the first electrode 26 and the second electrode 27 are electrically disconnected from each other.

Figure 11:
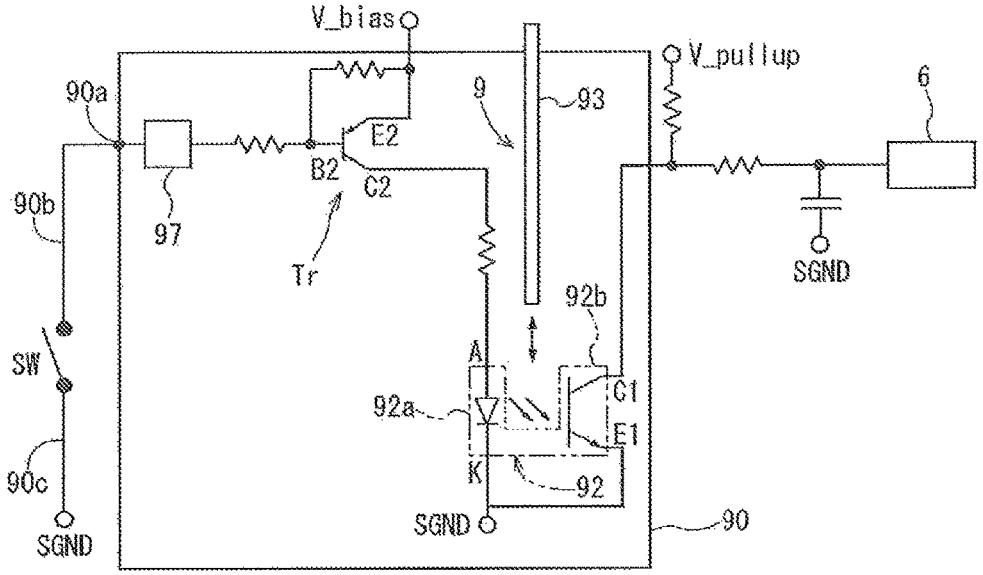
FIG. 11 is a circuit diagram of a sensor board on which a detector of the sheet sensor is mounted.

As illustrated in FIG. 11, the detector 92 of the sheet sensor 9 is mounted on a sensor board 90 (as one example of a first output device). The light emitter 92*a* of the detector 92 is, for example, a light-emitting diode (LED). A cathode K of the LED is connected to a signal ground (SGND). An anode A of the LED is connected to a collector C2 of a transistor Tr mounted on the sensor board 90. The transistor Tr is used as a switching element.

A base B2 of the transistor Tr is connected to the SGND via a switch SW. When the switch SW becomes continuous electrically, and thereby the base B2 and the SGND are connected to each other, the transistor Tr is turned on, so that electric power is supplied to the light emitter 92*a*, and the light emitter 92*a* emits light. When the switch SW is not continuous electrically, the transistor Tr is turned off, so that electric power is not supplied to the light emitter 92*a*, and the light emitter 92*a* does not emit light.

The light receiver 92*b* of the detector 92 is a phototransistor, for example. An emitter E1 of the phototransistor is connected to the SGND. A collector C1 of the phototransistor is connected to the controller 6 and pulled up to a predetermined voltage. When the light emitted from the light emitter 92*a* is received by the light receiver 92*b*, the collector C1 and the emitter E1 are electrically connected to each other, and the sheet sensor 9 outputs the first signal to the controller 6. When the light emitted from the light emitter 92*a* is not received by the light receiver 92*b*, the collector C1 and the emitter E1 are not electrically connected to each other, and the sheet sensor 9 outputs the second signal to the controller 6.

The switch SW is constituted by the first end portion 14*a* of the first resilient member 14 and the edge portion 12*b* of the pressing plate 12. The switch SW is continuous electrically when the first end portion 14*a* and the edge portion 12*b* are in contact with each other. The switch SW is not continuous electrically when the first end portion 14*a* and the edge portion 12*b* are separated from each other.

When the sheet cassette 10 is located at the accommodated position, the first electrode 26 connected to the first resilient member 14 is connected to a connection terminal 90*a* mounted on the sensor board 90. The connection terminal 90*a* is connected to the base B2 of the transistor Tr. A connection circuit 90*b* extending from the connection terminal 90*a* of the sensor board 90 to the switch SW is constituted by the first electrode 26 and the first resilient member 14 in order from a side nearer to the connection terminal 90*a*. A connection circuit 90*c* extending from the switch SW to the SGND is constituted by the pressing plate 12, the raising plate 13, the second resilient member 15, and the second electrode 27 in order from a side nearer to the switch SW. It is noted that a protecting circuit 97 for protecting the transistor Tr from, e.g., static electricity is provided between the connection terminal 90*a* and the base B2 of the transistor Tr on the sensor board 90.

In the sheet sensor 9 (the sensor board 90) configured as described above, in the case where the first electrode 26 and the second electrode 27 are electrically connected to each other by contact between the pressing plate 12 and the first end portion 14*a* of the first resilient member 14, and the sheet sensor 9 detects no sheets 18, the light emitter 92*a* of the detector 92 emits light, and the light receiver 92*b* receives the light emitted from the light emitter 92*a*. Thus, the sheet sensor 9 (the sensor board 90) outputs the first signal.

In the case where the first electrode 26 and the second electrode 27 are electrically connected to each other by contact between the pressing plate 12 and the first end portion 14*a* of the first resilient member 14, and the sheet sensor 9 detects a sheet 18, the light emitter 92*a* of the detector 92 emits light, but the light emitted from the light emitter 92*a* is intercepted by the actuator 93 and is not received by the light receiver 92*b*. Thus, the sheet sensor 9 (the sensor board 90) outputs the second signal.

In the case where the first electrode 26 and the second electrode 27 are not electrically connected to each other due to separation of the pressing plate 12 and the first end portion 14*a* of the first resilient member 14 from each other, no light is emitted from the light emitter 92*a* of the detector 92 and received by the light receiver 92*b*. Thus, the sheet sensor 9 (the sensor board 90) outputs the second signal.

It is noted that, in the present embodiment, the pressing plate 12 and the raising plate 13 are formed of galvanized sheet iron and may be formed of another conducting material such as another kind of metal and conductive resin. The pressing plate 12 and the raising plate 13 need not be formed of a conducting material entirely. For example, each of the pressing plate 12 and the raising plate 13 may be formed of a conductive material and a non-conductive material combined with each other as long as the first electrode 26 and the second electrode 27 are electrically connected to each other when the pressing plate 12 and the first end portion 14*a* of the first resilient member 14 are in contact with each other. For example, each of the pressing plate 12 and the raising plate 13 may be formed by sticking a resin plate and a metal plate to each other.

In the image forming apparatus 1, the sheet conveying device is constituted by the sheet cassette 10, the body housing 2, the sheet-cassette accommodating portion 2*a*, the first electrode 26, the second electrode 27, the sheet conveyor 20, the driver 4, the sheet sensor 9, the rotation-pulse-signal output device 95, and the controller 6.

Control for Reducing Error in Calculation of the Number S of Sheets

In the image forming apparatus 1, the controller 6 is configured to calculate the number of sheets 18 stored in the sheet cassette 10 (hereinafter may be referred to as the number S of sheets 18). To reduce an error in calculation of the number S of sheets 18, the controller 6 executes control described below.

There will be next described a process for updating the number S of sheets 18 at S100 when the sheet cassette 10 located at the separated position is inserted to the accommodated position of the sheet-cassette accommodating portion 2*a*.

Figure 12:
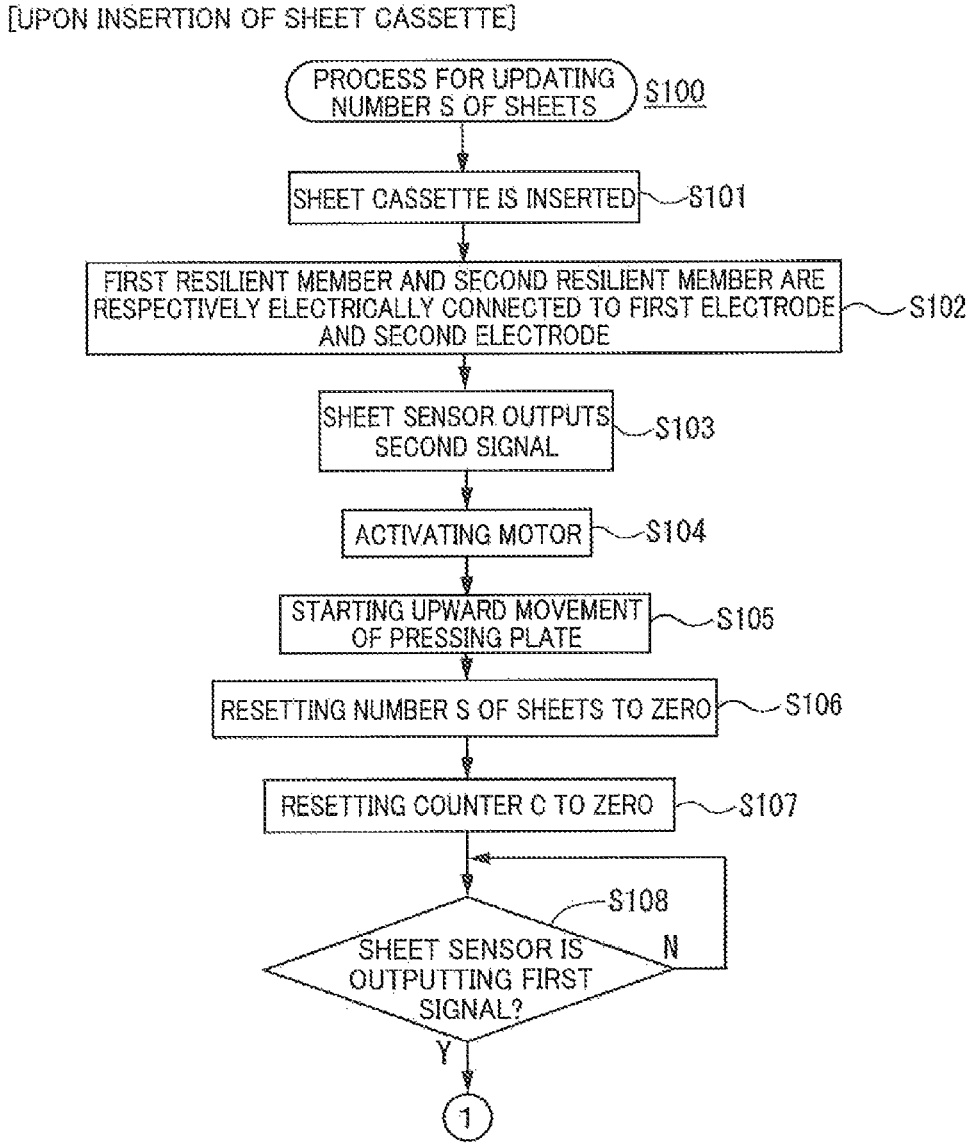
FIG. 12 is a flow chart representing steps at S101-S108 in a process for updating the number of sheets when the sheet cassette is inserted.

As illustrated in FIG. 12, when the sheet cassette 10 located at the separated position is inserted to the accommodated position (S101), the first resilient member 14 provided at the sheet cassette 10 and the first electrode 26 provided in the sheet-cassette accommodating portion 2*a* are electrically connected to each other by contact therebetween, and the second resilient member 15 provided at the sheet cassette 10 and the second electrode 27 provided in the sheet-cassette accommodating portion 2*a* are electrically connected to each other by contact therebetween (S102). At the point in time when the sheet cassette 10 is inserted to the accommodated position, the pressing plate 12 is located at the first position, and the edge portion 12*b* of the pressing plate 12 and the first end portion 14*a* of the first resilient member 14 are separated from each other. Thus, the first electrode 26 and the second electrode 27 are not electrically connected to each other, and the sheet sensor 9 (the sensor board 90) outputs the second signal at S103.

When the sheet cassette 10 is inserted to the accommodated position, the controller 6 activates the motor 40 at S104. When the motor 40 is activated, the driving force supplied from the motor 40 causes upward pivotal movement of the raising plate 13, which starts upward movement of the pressing plate 12 (S105). When the sheet cassette 10 is inserted to the accommodated position, the controller 6 at S106 resets the current number S stored in the controller 6 to zero and at S107 resets a value of a counter C to zero. The counter C is provided in the controller 6 to determine the number of rotations of the motor 40.

The controller 6 at S108 determines whether the sheet sensor 9 (the sensor board 90) is outputting the first signal. When the controller 6 determines that the sheet sensor 9 (the sensor board 90) is not outputting the first signal, that is, the sheet sensor 9 (the sensor board 90) is continuously outputting the second signal, the controller 6 executes the step at S108 again.

Figure 13:
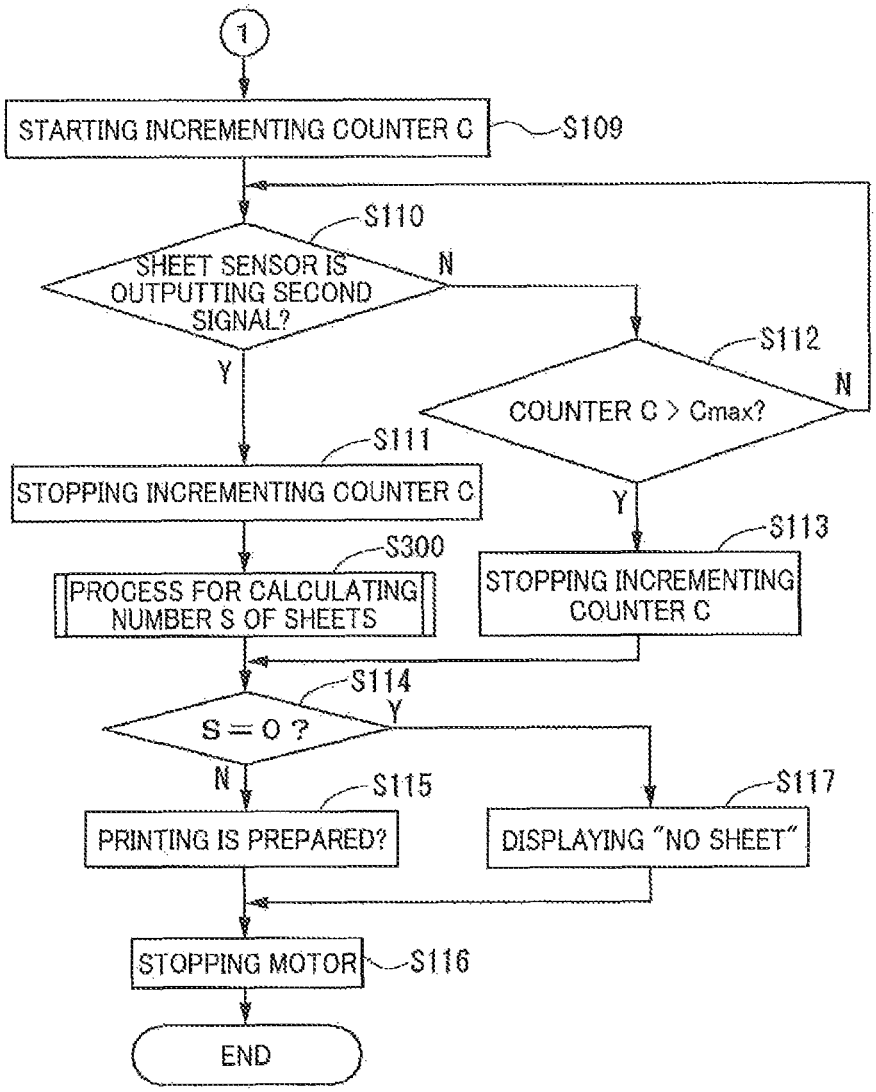
FIG. 13 is a flow chart representing steps at S109-S116 in the process for updating the number of sheets when the sheet cassette is inserted.
Figure 16:
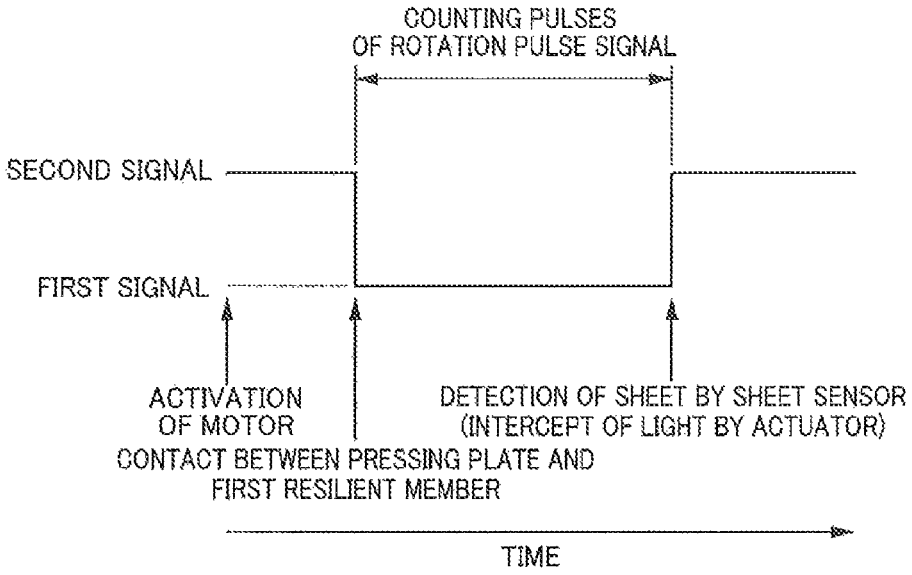
FIG. 16 is a timing chart representing signals output from the sheet sensor.

As illustrated in FIG. 13, when the controller 6 at S108 determines that the sheet sensor 9 (the sensor board 90) is outputting the first signal, the controller 6 at S109 starts incrementing the counter C to determine the number of rotations of the motor 40. That is, as illustrated in FIG. 16, the controller 6 starts counting pulses of a rotation pulse signal received from the rotation-pulse-signal output device 95, in a period extending from the point in time when the signal received from the sheet sensor 9 (the sensor board 90) is switched from the second signal to the first signal, and determines the number of pulses of the rotation pulse signal. The number of pulses of the rotation pulse signal indicates the number of rotations of the motor 40.

In this case, when the motor 40 is activated in the state in which the pressing plate 12 is located at the first position (S104), the raising plate 13 is driven by the motor 40, and upward movement of the pressing plate 12 is started. When the upward movement of the pressing plate 12 is started, the first end portion 14*a* of the first resilient member 14 and the edge portion 12*b* of the pressing plate 12 contact each other, which electrically connects the first electrode 26 and the second electrode 27 to each other. When the first electrode 26 and the second electrode 27 are electrically connected to each other, the light emitter 92*a* of the sheet sensor 9 emits light.

At startup of the motor 40, the pressing plate 12 is located at the first position, and the actuator 93 is not located between the light emitter 92*a* and the light receiver 92*b*. Thus, the light emitted from the light emitter 92*a* is received by the light receiver 92*b*. As a result, the signal output from the sheet sensor 9 (the sensor board 90) is switched from the second signal to the first signal. When the signal received from the sheet sensor 9 (the sensor board 90) is switched from the second signal to the first signal, the controller 6 starts counting rotations of the motor 40 from the switching of the signal.

It is noted that the counter C is provided in the controller 6 and configured to count rotations of the motor 40 by incrementing the count value by one each time when the controller 6 receives the rising or falling edge of a pulse of a rotation pulse signal output from the rotation-pulse-signal output device 95, for example.

After the start of counting of rotations of the motor 40, the controller 6 at S110 determines whether the sheet sensor 9 (the sensor board 90) is outputting the second signal. That is, as illustrated in FIG. 16, the controller 6 determines whether the signal received from the sheet sensor 9 (the sensor board 90) is switched from the first signal to the second signal. It is noted that the state in which the light receiver 92*b* receives the light emitted from the light emitter 92*a*, and the sheet sensor 9 (the sensor board 90) outputs the first signal is switched to the state in which the sheet sensor 9 (the sensor board 90) outputs the second signal, when the contact member 91 contacts the upper surface of the uppermost one of the sheets 18 supported on the pressing plate 12, and thereby the light emitted from the light emitter 92*a* is intercepted by the actuator 93 and is not received by the light receiver 92*b*.

When the controller 6 at S110 determines that the sheet sensor 9 (the sensor board 90) is outputting the second signal, the controller 6 stops incrementing the counter C at S111 and obtains the count value counted in a period extending from the start of the incrementing of the counter C to the stop of the incrementing. That is, as illustrated in FIG. 16, the controller 6 ends counting pulses of the rotation pulse signal when the signal received from the sheet sensor 9 (the sensor board 90) is switched from the first signal to the second signal. The controller 6 at S300 uses the obtained count value of the counter C to execute the process for calculating the number S of sheets 18, thereby calculating the updated number S of sheets 18.

When the controller 6 at S110 determines that the sheet sensor 9 (the sensor board 90) is not outputting the second signal, the controller 6 at S112 determines whether the count value of the counter C is greater than a value Cmax that is a preset maximum value. A state in which the count value of the counter C is greater than the value Cmax is a state in which the pressing plate 12 supporting no sheets 18 has been moved upward to the position at which the pressing plate 12 is in contact with the pickup roller 21.

When the controller 6 at S112 determines that the count value of the counter C is greater than the value Cmax, the controller 6 at S113 stops incrementing the counter C. It is noted that when the controller 6 at S112 determines that the count value of the counter C is greater than the value Cmax, the controller 6 does not update the number S of sheets 18 and keeps the number S at zero to which the number S is reset at S106.

When the controller 6 at S112 determines that the count value of the counter C is not greater than the value Cmax, this flow returns to S110 at which the controller 6 determines again whether the sheet sensor 9 (the sensor board 90) is outputting the second signal.

After the completion of the process for calculating the number S of sheets 18 at S300 or after the increment of the counter C is stopped at S113, the controller 6 at S114 determines whether the number S of sheets 18 stored in the controller 6 is zero.

When the controller 6 at S114 determines that the number S stored in the controller 6 is not zero, the controller 6 at S115 determines that a preparation for printing is finished, at S116 stops the motor 40, and terminates the process for updating the number S of sheets 18. When the controller 6 at S114 determines that the number S stored in the controller 6 is zero, the controller 6 at S117 controls a display of the image forming apparatus 1 to display information indicating that the image forming apparatus 1 is out of the sheets 18. The controller 6 at S116 stops the motor 40 and terminates the process for updating the number S of sheets 18.

In the case where an instruction for forming an image is input to the image forming apparatus 1 when or after the process for updating the number S of sheets 18 is terminated, the controller 6 drives the devices including the image forming unit 5 to form the image on the sheet 18. In this case, each time when one sheet 18 is taken out of the sheet cassette 10, the controller 6 determines the number S of sheets 18 to a value obtained by subtracting one from the current number S of sheets 18 (S=S−1).

In the image forming apparatus 1, as described above, when the sheet cassette 10 is located at the separated position, the pressing plate 12 is located at the first position. Accordingly, in the process for updating the number S of sheets 18 at S100, when the sheet cassette 10 is, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 26 and the second electrode 27 are electrically connected to each other by contact between the pressing plate 12 and the first end portion 14*a* of the first resilient member 14.

The first electrode 26 is plate-shaped and disposed on the rail 201*a* of the body housing 2, and the second electrode 27 is the frame disposed at the lower portion of the sheet-cassette accommodating portion 2*a*. This makes it possible to arrange the first electrode 26 and the second electrode 27 without complicating the configuration of the image firming apparatus 1, enabling size reduction of the sheet conveying device without hindrance.

Figure 14:
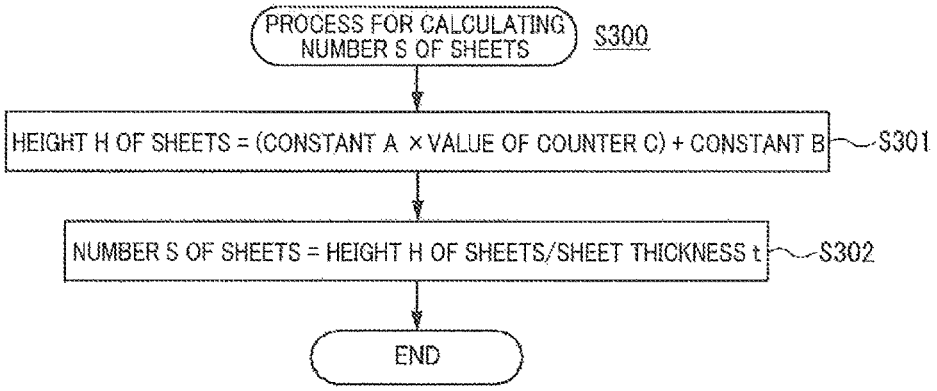
FIG. 14 is a flow chart representing a process for calculating the number of sheets.

There will be next described the process for calculating the number S of sheets 18 at S300. As illustrated in FIG. 14, the process for calculating the number S of sheets 18 at S300 begins with S301 at which the controller 6 calculates a height H of the sheets 18 in a period extending from the point in time when the signal received from the sheet sensor 9 (the sensor board 90) is switched from the second signal to the first signal, to the point in time when the signal received from the sheet sensor 9 (the sensor board 90) is switched from the first signal to the second signal. Specifically, the height H of the sheets 18 is calculated by adding a constant B to a value obtained by multiplying, by a constant A, the count value of the counter C counted in a period extending from the start of the incrementing (S109) to the stop of the incrementing (S111).

In this case, the constant A is a negative value which is a constant of proportionality between the value of the counter C and the height H of the sheets 18. The constant B is a positive value which is equal to the height of the sheets 18 in the case where the sheets 18 are placed on the upper surface of the pressing plate 12 such that the sheet sensor 9 detects the uppermost one of the sheets 18 in the state in which the pressing plate 12 is located at the lowest position (the first position).

The value of the counter C corresponds to an amount of upward movement of the pressing plate 12 in the period extending from the start of the incrementing (S109) to the stop of the incrementing (S111). The height H of the sheets 18 corresponds to the amount of upward movement of the pressing plate 12. The height H decreases with increase in the amount of upward movement of the pressing plate 12.

Figure 15:
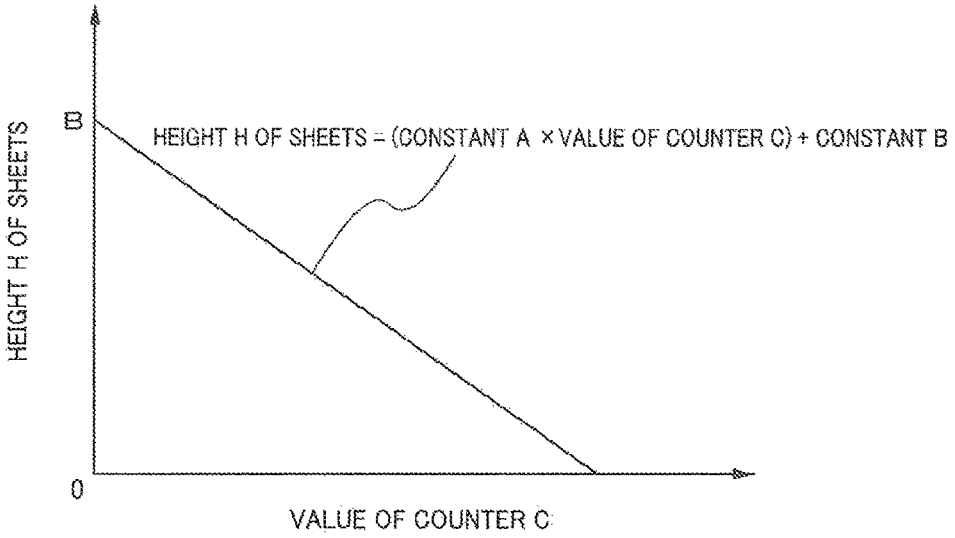
FIG. 15 is a view illustrating a relationship between a value of a counter and the height of the sheets.

In view of the above, the height H of the sheets 18 is expressed as: $H=(A\times C)+B$, where H, A, C, and B represent the height H of the sheets 18, the constant A, the value of the counter C, and the constant. B, respectively. FIG. 15 represents a relationship between the height H of the sheets 18 and the value of the counter C.

The controller 6 at S302 calculates the number S of sheets 18 corresponding to the height H of the sheets 18, by dividing the height H of the sheets 18 by the thickness t of the sheet 18. As the thickness t of the sheet 18, a value corresponding to the thickness of the sheet 18 stored in the cassette body 11 is set in advance in the controller 6.

In the sheet conveying device of the image forming apparatus 1 described above, when calculating the height H of the sheets 18 placed on the pressing plate 12 based on the number of pulses of the rotation pulse signal output from the rotation-pulse-signal output device 95, the controller 6 starts counting pulses of the rotation pulse signal received from the rotation-pulse-signal output device 95, when the signal received from the sheet sensor 9 (the sensor board 90) is switched from the second signal to the first signal. Thus, the number of rotations of the motor 40 which is determined using the counter C does not include the number of rotations of the motor 40 in a period extending from the point in time when the motor 40 starts driving the raising plate 13 to the point in time when the raising plate 13 actually starts moving.

This configuration removes, from the count value of the counter C, variations of the number of rotations of the motor 40 in a period extending from the point in time when the motor 40 starts driving to the point in time when the raising plate 13 actually starts moving. Accordingly, it is possible to reduce the error in the number S of sheets 18 when calculating the number S of sheets 18 on the pressing plate 12 based on the height H of the sheets 18. When calculating the number S of sheets 18 placed on the pressing plate 12 by calculating the height H of the sheets 18 based on the number of pulses of the rotation pulse signal, the controller 6 uses the signal received from the sheet sensor 9 (the sensor board 90), to detect the start of upward movement of the pressing plate 12. This configuration eliminates the need to use a specific sensor, resulting in simpler configuration of the image forming apparatus 1 and reduction in increased cost. Since the height H of the sheets 18 placed on the pressing plate 12 is accurately calculated, it is possible to accurately calculate the number S of sheets 18 on the pressing plate 12 which is calculated based on the height H of the sheets 18 and the sheet thickness t.

There will be next described the process for updating the number S of sheets 18 at S200 in the case where the power source of the image forming apparatus 1 is turned on (hereinafter may be simply referred to as "the image forming apparatus 1 is turned on").

Before the image forming apparatus 1 is turned on, the image forming apparatus 1 is in one of the following states: a state in which the sheet cassette 10 has not been removed from and inserted into the sheet-cassette accommodating portion 2*a* in a power-off state of the image forming apparatus 1, i.e., in a period extending from the point in time when the image forming apparatus 1 is turned off previously to the point in time when the image forming apparatus 1 is turned on at this time (that is, a state in which the sheet cassette 10 is kept inserted in the accommodated position of the sheet-cassette accommodating portion 2*a*); and a state in which the sheet cassette 10 has been removed from and inserted into the sheet-cassette accommodating portion 2*a* in the power-off state of the image forming apparatus 1 (that is, a state in which the sheet cassette 10 has been drawn from the accommodated position to the separated position and then inserted into the accommodated position again).

In the case where the sheet cassette 10 has not been removed in the power-off state, if sheets 18 are supported on the pressing plate 12, the sheets 18 supported on the pressing plate 12 are located at the sheet suppliable position, the pressing plate 12 and the first end portion 14*a* of the first resilient member 14 are in contact with each other, and the sheet sensor 9 is in a state where it is detecting the uppermost one of the sheets 18. In this case, the sheet sensor 9 (the sensor board 90) outputs the second signal at the point in time when the image forming apparatus is turned on.

In the case where the sheet cassette 10 has not been removed in the power-off state, if no sheets 18 are supported on the pressing plate 12, the pressing plate 12 is located at the highest position, the pressing plate 12 and the first end portion 14*a* of the first resilient member 14 are in contact with each other, and the sheet sensor 9 is in a state where it is detecting no sheets 18. In this case, the sheet sensor 9 (the sensor board 90) outputs the first signal at the point in time when the image forming apparatus 1 is turned on.

In the case where the sheet cassette 10 has been removed in the power-off state of the image forming apparatus 1, the pressing plate 12 is located at the first position, and the pressing plate 12 and the first end portion 14*a* of the first resilient member 14 are separated from each other. Thus, the sheet sensor 9 (the sensor board 90) outputs the second signal at the point in time when the image forming apparatus 1 is turned on.

Figure 17:
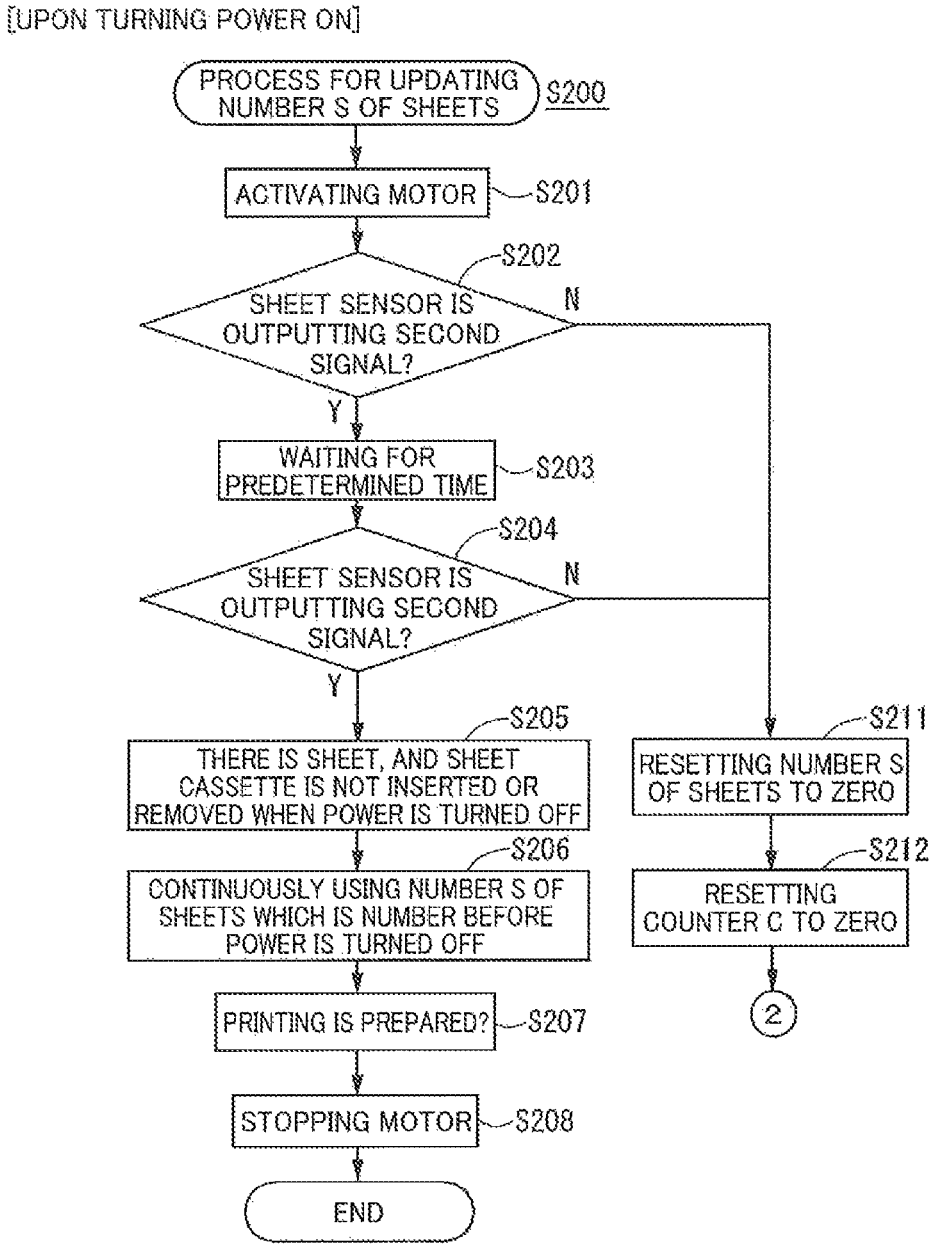

As illustrated in FIG. 17, when the image forming apparatus 1 is turned on, the controller 6 at S201 activates the motor 40 and at S202 determines whether the sheet, sensor 9 (the sensor board 90) is outputting the second signal. When the controller 6 at S202 determines that the sheet sensor 9 (the sensor board 90) is outputting the second signal, the controller 6 waits for a predetermined length of time at S203. After waiting for the predetermined length of time, the controller 6 at S204 determines whether the sheet sensor 9 (the sensor board 90) is outputting the second signal.

When the controller 6 at S204 determines that the sheet sensor 9 (the sensor board 90) is outputting the second signal, that is, when the sheet sensor 9 (the sensor board 90) has been continuously outputting the second signal in a period extending from the processing at S202 to the processing at S204, the controller 6 at S205 determines that a sheet or sheets 18 are supported on the pressing plate 12 and that the sheet cassette 10 is not inserted or removed in the power-off state of the image forming apparatus 1. In this case, without updating the number S of sheets 18, the controller 6 at S206 continuously uses the number S of sheets 18 stored in the controller 6 before the image forming apparatus 1 is turned off. The controller 6 at S207 determines that the preparation for printing is finished, at S208 stops the motor 40, and terminates the process for updating the number S of sheets 18.

Figure 18:
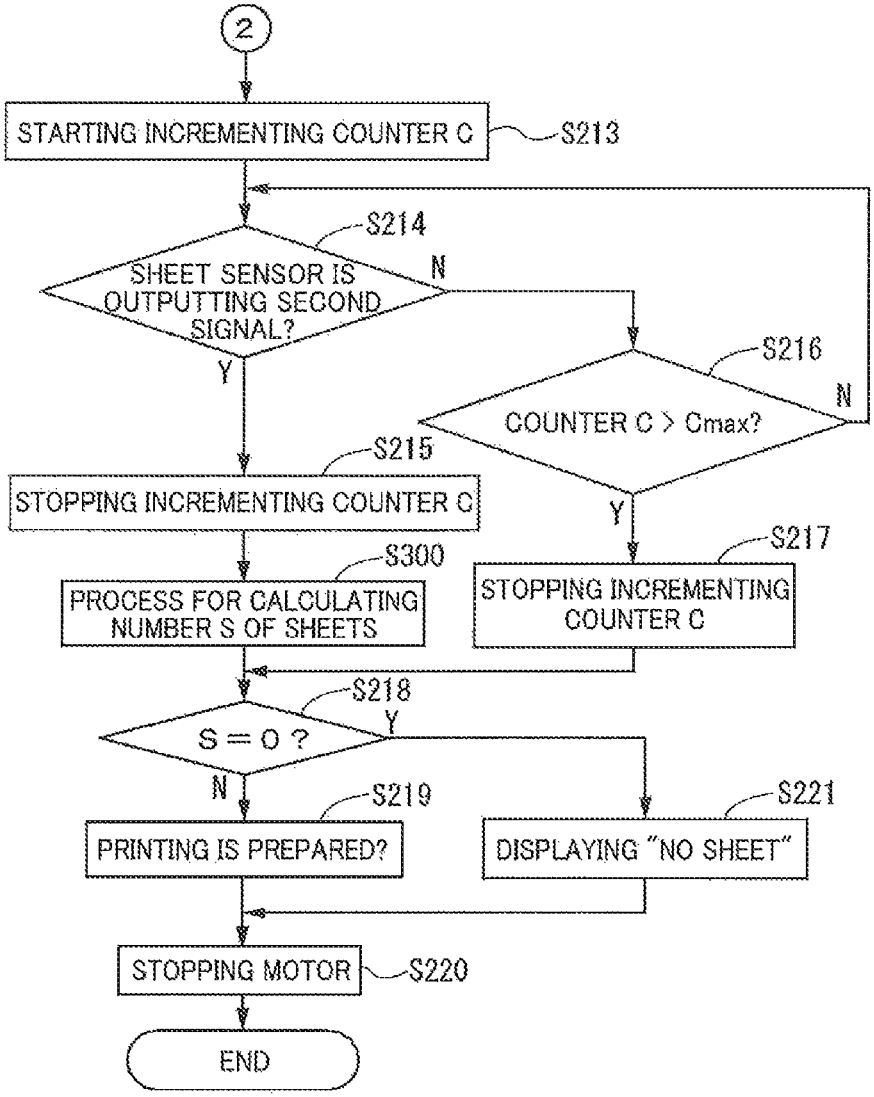

When the controller 6 at S202 determines that the sheet sensor 9 (the sensor board 90) is not outputting the second signal, that is, when the controller 6 at S202 determines that the sheet sensor 9 (the sensor board 90) is outputting the first signal when the image forming apparatus 1 is turned on, the controller 6 at S211 resets the current number S stored in the controller 6 to zero and at S212 resets, to zero, the value of the counter C provided in the controller 6 to determine the number of rotations of the motor 40. As illustrated in FIG. 18, after resetting the value of the counter C to zero, the controller 6 at S213 starts incrementing the counter C to determine the number of rotations of the motor 40.

When the controller 6 at S204 determines that the sheet sensor 9 (the sensor board 90) is not outputting the second signal, that is, when the controller 6 at S204 determines that the signal received from the sheet sensor 9 has been switched from the second signal to the first signal, the controller 6 at S211 resets the current number S stored in the controller 6 to zero and at S212 resets the value of the counter C to zero.

It is noted that the case where the signal received from the sheet sensor 9 (the sensor board 90) is switched from the second signal to the first signal at S204 is a case where the pressing plate 12 is located at the first position, and the first end portion 14*a* of the first resilient member 14 and the edge portion 12*b* of the pressing plate 12 are separated from each other at the point in time when the image forming apparatus 1 is turned on, and thereafter the first end portion 14*a* of the first resilient member 14 and the edge portion 12*b* of the pressing plate 12 contact each other by upward movement of the pressing plate 12 which is caused by activation of the motor 40.

As illustrated in FIG. 18, after resetting the value of the counter C to zero, the controller 6 at S213 starts incrementing the counter C to determine the number of rotations of the motor 40. That is, when the controller 6 at S204 determines that the signal received from the sheet sensor 9 (the sensor board 90) has been switched from the second signal to the first signal, as illustrated in FIG. 16, the controller 6 starts counting pulses of the rotation pulse signal when the signal received from the sheet sensor 9 (the sensor board 90) is switched from the second signal to the first signal.

After the start of counting rotations of the motor 40, the controller 6 at S214 determines whether the sheet sensor 9 (the sensor board 90) is outputting the second signal. That is, as illustrated in FIG. 16, the controller 6 determines whether the signal received from the sheet sensor 9 (the sensor board 90) has been switched from the first signal to the second signal. It is noted that the case where the signal received from the sheet sensor 9 (the sensor board 90) is switched from the first signal to the second signal is a case where the state of the sheet sensor 9 is switched from a state in which the sheet sensor 9 does not detect a sheet 18 to a state in which the sheet sensor 9 detects a sheet 18 when the upper surface of the uppermost sheet 18 contacts the contact member 91 by upward movement of the pressing plate 12.

When the controller 6 at S214 determines that the sheet sensor 9 (the sensor board 90) is outputting the second signal, the controller 6 stops incrementing the counter C at S215 and obtains the count value counted in a period extending from the start of the incrementing of the counter C to the stop of the incrementing. The controller 6 uses the obtained count value of the counter C to execute the process for calculating the number S of sheets 18 at S300, thereby calculating the updated number S of sheets 18.

When the controller 6 at S214 determines that the sheet sensor 9 (the sensor board 90) is not outputting the second signal, the controller 6 at S216 determines whether the count value of the counter C is greater than the value Cmax. The state in which the count value of the counter C is greater than the value Cmax is a state in which the pressing plate 12 supporting no sheets 18 has been moved upward to the position at which the pressing plate 12 is in contact with the pickup roller 21.

When the controller 6 at S216 determines that the count value of the counter C is greater than the value Cmax, the controller 6 at S217 stops incrementing the counter C. It is noted that, when the controller 6 at S216 determines that the count value of the counter C is greater than the value Cmax, the controller 6 does not update the number S of sheets 18 and keeps the number S at zero to which the number S is reset at S211.

When the controller 6 at S216 determines that the count value of the counter C is not greater than the value Cmax, this flow returns to S214 at which the controller 6 determines again whether the sheet sensor 9 (the sensor board 90) is outputting the second signal.

After the completion of the process for calculating the number S of sheets 18 at S300 or after the increment of the counter C is stopped at S217, the controller 6 at S218 determines whether the number S of sheets 18 stored in the controller 6 is zero.

When the controller 6 at S218 determines that the number S stored in the controller 6 is not zero, the controller 6 at S219 determines that a preparation for printing is finished, at S220 stops the motor 40, and terminates the process for updating the number S of sheets 18. When the controller 6 at S218 determines that the number S stored in the controller 6 is zero, the controller 6 at S221 controls the display of the image forming apparatus 1 to display the information indicating that the image forming apparatus 1 is out of the sheets 18. The controller 6 at S220 stops the motor 40 and terminates the process for updating the number S of sheets 18.

In the case where an instruction for forming an image is input to the image forming apparatus 1 when or after the process for updating the number S of sheets 18 is terminated, the controller 6 drives the devices including the image forming unit 5 to form the image on the sheet 18. In this case, each time when one sheet 18 is taken out of the sheet cassette 10, the controller 6 determines the number S of sheets 18 to a value obtained by subtracting one from the current number S of sheets 18 (S=S−1).

Thus, also in the process for updating the number S of sheets 18 at S200 in the case where the image forming apparatus 1 is turned on, when obtaining the number S of sheets 18 placed on the pressing plate 12 by calculating the height H of the sheets 18 which corresponds to the amount of upward movement of the pressing plate 12, based on the number of pulses of the rotation pulse signal, the controller 6 uses the signal received from the sheet sensor 9 (the sensor board 90), to detect the start of upward movement of the pressing plate 12. This configuration eliminates the need to use a specific sensor, resulting in simpler configuration of the image forming apparatus 1 and reduction in increased cost.

Second Embodiment

There will be next described a second embodiment for reducing an error in calculation of the number S of sheets 18. The second embodiment is different from the first embodiment in that the switch SW illustrated in FIG. 11 is constituted by the raising plate 13 and the pressing plate 12 (that the raising plate 13 is movable between a spaced position at which the raising plate 13 is spaced from the pressing plate 12 and a contact position at which the raising plate 13 is in contact with the pressing plate 12 to move the pressing plate 12 in the up and down direction), that the sheet cassette 10 includes, instead of the first resilient member 14, a first resilient member 16 that is kept in contact with the pressing plate 12 during movement of the pressing plate 12, and that the sheet-cassette accommodating portion 2*a* includes, instead of the first electrode 26, a first electrode 28 provided at the left rail 201*a* of the body housing 2 and contactable with the first resilient member 16, for example. It is noted that the second embodiment is described principally for its configuration different from that of the first embodiment, and a description of a configuration of the second embodiment which is the same as that of the first embodiment is dispensed with.

In the present embodiment, as illustrated in FIGS. 19-22, the raising plate 13 is pivotable about the pivot axis 13*a* between the spaced position (indicated in FIG. 19) at which the raising plate 13 is spaced from the pressing plate 12 and the contact position (indicated in FIG. 22) at which the raising plate 13 is in contact with the pressing plate 12 to move the pressing plate 12 in the up and down direction.

Figure 19:
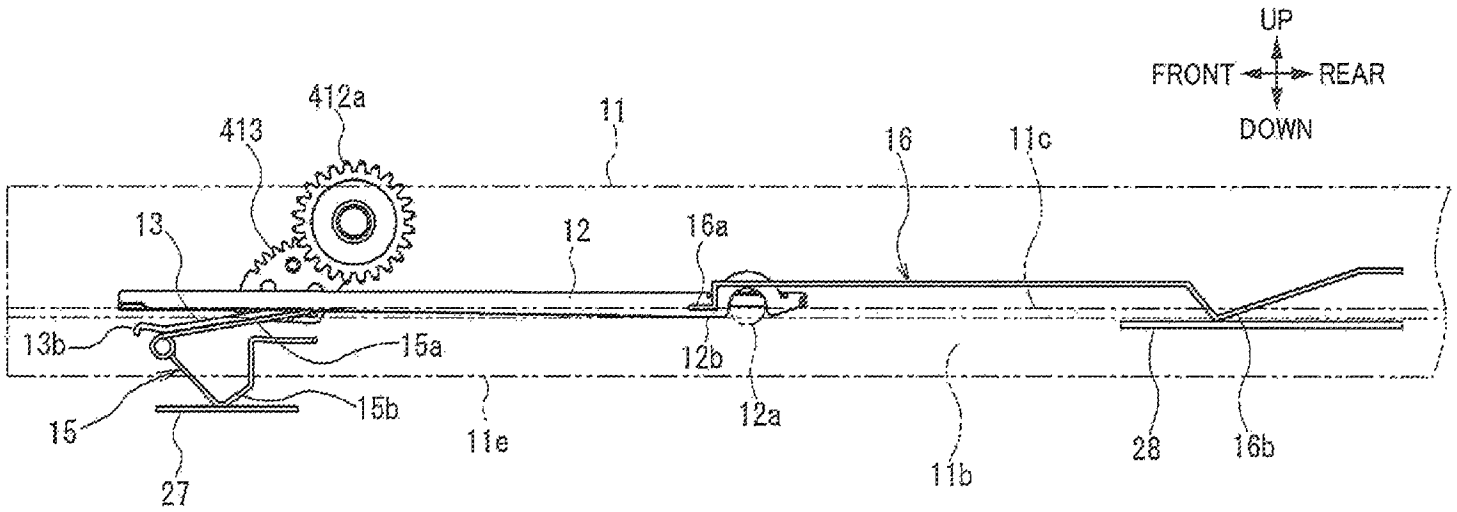
FIG. 19 is a side view of the sheet cassette located at the accommodated position with the raising plate located at a spaced position in a second embodiment for reducing an error in calculation of the number of sheets.
Figure 20:
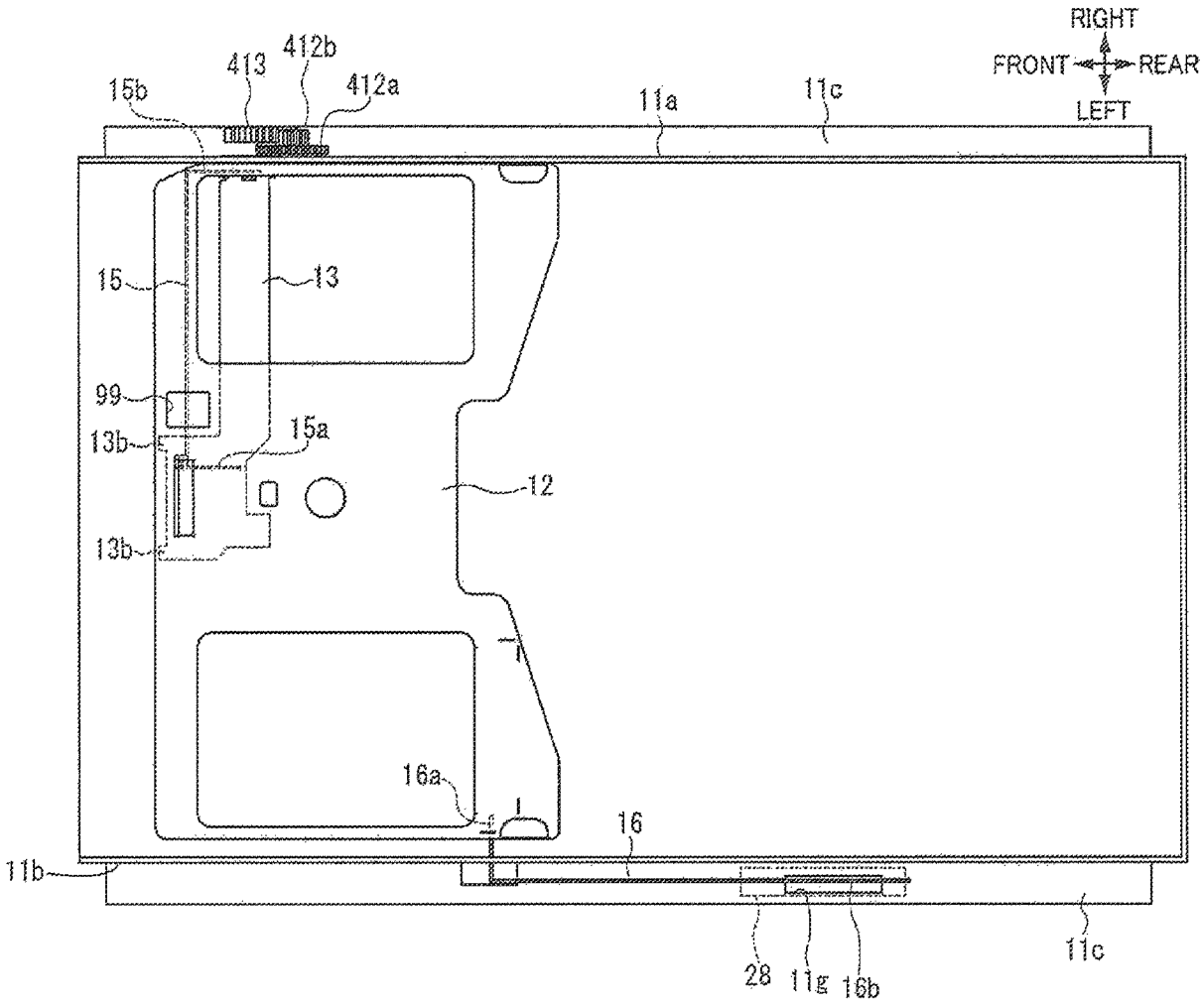
FIG. 20 is a plan view of the sheet cassette located at the accommodated position with the raising plate located at the spaced position in the second embodiment for reducing the error in calculation of the number of sheets.
Figure 21:
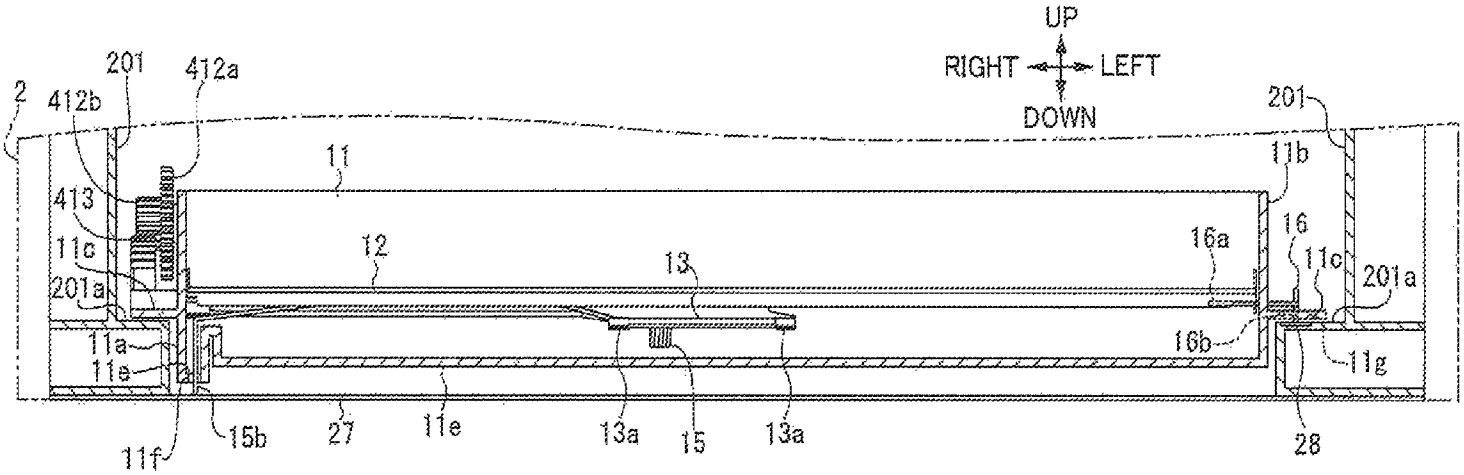
FIG. 21 is a front devotional view of the sheet cassette located at the accommodated position with the raising plate located at the spaced position in the second embodiment for reducing the error in calculation of the number of sheets.
Figure 22:
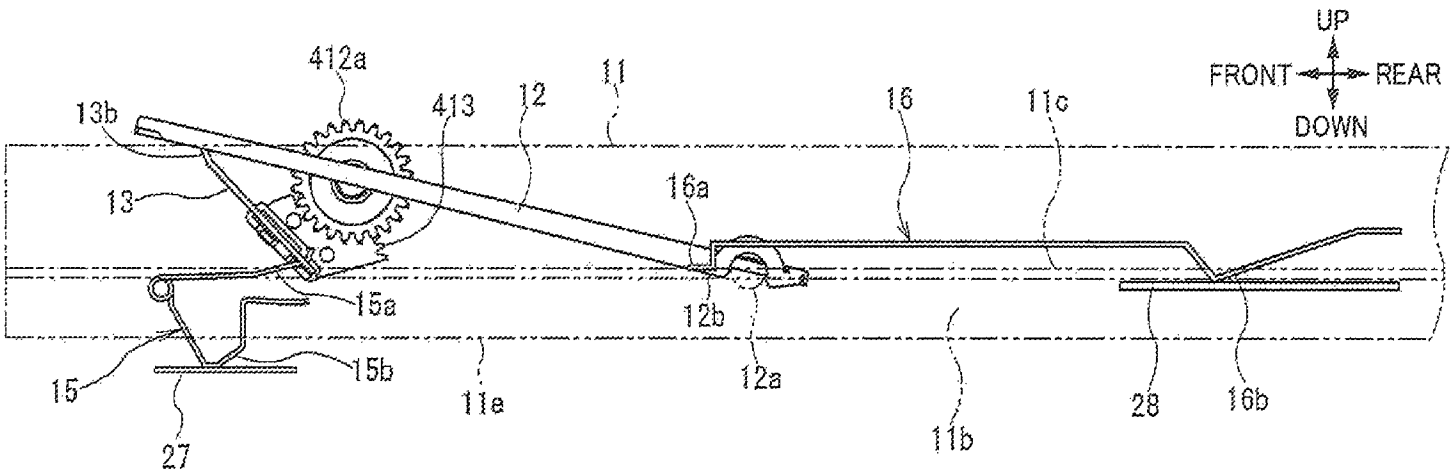
FIG. 22 is a side view of the sheet cassette located at the accommodated position with the raising plate located at a contact position in the second embodiment for reducing the error in calculation of the number of sheets.

For example, as illustrated in FIG. 19, when the raising plate 13 located at the spaced position is driven by the motor 40 and pivots upward in the state in which the pressing plate 12 is located at the first position, the raising plate 13 reaches the contact position at which the contact portion 13*b* is in contact with the pressing plate 12. After the raising plate 13 has reached the contact position, the pressing plate 12 is moved upward, with the contact portion 13*b* kept in contact with the pressing plate 12. As illustrated in FIG. 22, the pressing plate 12 located at the lowest position is moved upward by the raising plate 13 to the sheet suppliable position at which the sheets 18 supported on the pressing plate 12 become suppliable.

When the sheet cassette 10 is located at the accommodated position, after the pressing plate 12 is moved upward by the raising plate 13, reverse rotation of the pressing-plate driving gear 42 is prevented by a reverse-rotation preventing mechanism provided between the motor 40 and the pressing-plate driving gear 42. Thus, even when rotation of the motor 40 is stopped, the pressing plate 12 is kept at its upper position. In the state in which the pressing plate 12 is kept at the upper position, the pressing plate 12 and the raising plate 13 are in contact with each other.

When the sheet cassette 10 is moved from the accommodated position to the separated position in the state in which the pressing plate 12 has been moved upward by the raising plate 13, the pressing-plate driving gear 42 and the pressing-plate moving gear 411 disengage from each other. Thus, the pressing plate 12 moves downward to the lowest position, and the raising plate 13 moves downward to the spaced position. In the state in which the pressing plate 12 is located at the lowest position, and the raising plate 13 is located at the spaced position, the pressing plate 12 and the raising plate 13 are spaced from each other.

The sheet cassette 10 includes: the first resilient member 16 provided at the cassette body 11 and in contact with the back surface of the pressing plate 12; and the second resilient member 15 provided at the cassette body 11 and in contact with the back surface of the raising plate 13.

A first end portion 16*a* of the first resilient member 16 is kept in contact with the back surface of the pressing plate 12 during the movement of the pressing plate 12 in the up and down direction. The first resilient member 16 has electric conductivity and resiliency. For example, the first resilient member 16 is formed of a wire spring. The first resilient member 16 is disposed on a left side portion of the cassette body 11. The first end 16*a* of the first resilient member 16 is in contact with the back surface of the pressing plate 12 at a position near the pivot axis 12*a*.

The first end portion 16*a* of the first resilient member 16 may be located in contact with a left portion of the edge portion 12*b* (see FIG. 19) of the pressing plate 12. In the configuration in which the first end portion 16*a* of the first resilient member 16 is in contact with the edge portion 12*b* of the pressing plate 12, the first resilient member 16 and the pressing plate 12 are reliably in contact with each other, whereby the first resilient member 16 and the pressing plate 12 are electrically connected to each other stably.

A second end portion 16*b* of the first resilient member 16 is located to the left of the left outer surface 11*b* of the cassette body 11. In the present embodiment, the rib 11*c* protruding outward from the left outer surface 11*b* of the cassette body 11 has a through hole 11*g* (see FIGS. 20 and 21). The second end portion 16*b* of the first resilient member 16 partially protrudes downward through the through hole 11*g* to a position located below the rib 11*c*. The second resilient member 15 is similar in construction to that in the first embodiment, and the description thereof is dispensed with.

The sheet-cassette accommodating portion 2*a* of the body housing 2 includes the first electrode 28 and the second electrode 27. When the sheet cassette 10 is located at the accommodated position, the through hole 11*g* of the sheet cassette 10 and the second end portion 16*b* of the first resilient member 16 are provided at such positions that the second end portion 16*b* of the first resilient member 16 is in contact with the first electrode 28. When the sheet cassette 10 is located at the accommodated position, the through hole 11*f* of the sheet cassette 10 and the second end portion 15*b* of the second resilient member 15 are provided at such positions that the second end portion 15*b* of the second resilient member 15 is in contact with the second electrode 27.

The first electrode 28 is plate-shaped and disposed on the side portion of the sheet cassette 10. The first electrode 28 is a conductor of electricity. The first electrode 28 is provided at the left rail 201*a* in the body housing 2. The first electrode 28 is disposed under the rib 11*c* located on the left side of the cassette body 11. When the sheet cassette 10 is located at the accommodated position, the first electrode 28 is in contact with the second end portion 16*b* of the first resilient member 16 which partially protrudes downward from the rib 11*c*. In this state, the first electrode 28 is held in pressing contact with the second end portion 16*b* such that the first resilient member 16 is bent against a resilient force of the first resilient member 16. The second end portion 16*b* of the first resilient member 16 is configured to contact the first electrode 28 slidably in the front and rear direction coinciding with the direction of movement of the sheet cassette 10. The first electrode 28 is electrically connected to the sheet sensor 9. The second electrode 27 is similar in construction to that in the first embodiment, and the description thereof is dispensed with.

Figure 23:
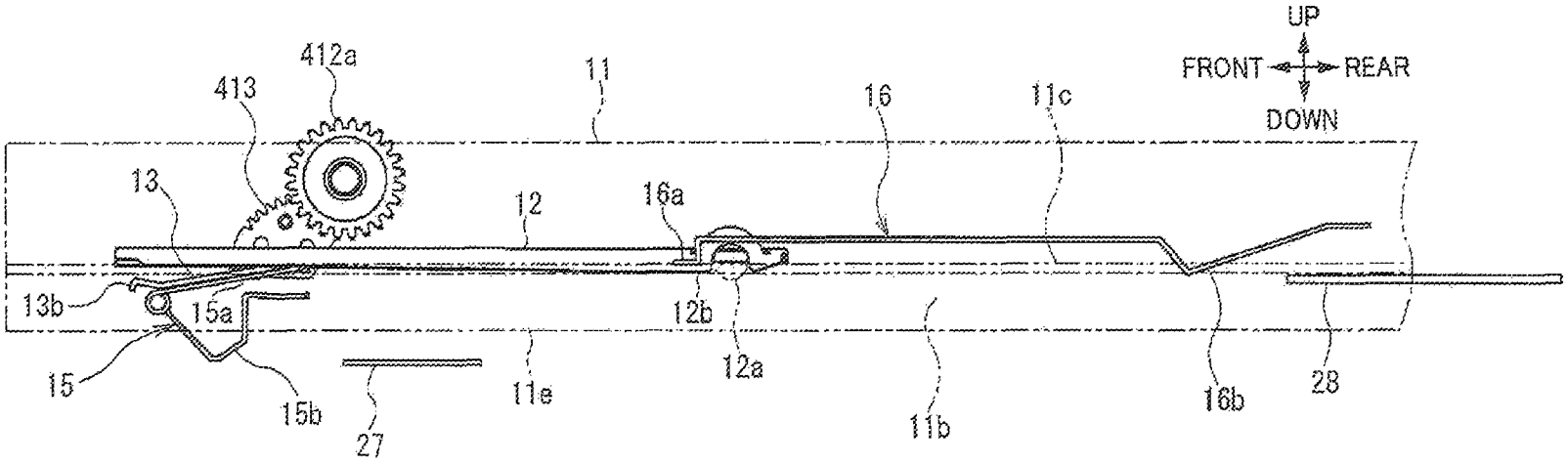
FIG. 23 is a side view of the sheet cassette located at the separated position with the raising plate located at the spaced position in the second embodiment for reducing the error in calculation of the number of sheets.

When the sheet cassette 10 is located at the accommodated position, as described above, the second end portion 16*b* of the first resilient member 16 is in contact with the first electrode 28 so as to be slidable in the front and rear direction, and the second end portion 15*b* of the second resilient member 15 is in contact with the second electrode 27 so as to be slidable in the front and rear direction. Thus, when the sheet cassette 10 is located at the accommodated position, as illustrated in FIG. 19, the first resilient member 16 and the second resilient member 15 are held in reliable contact with the first electrode 28 and the second electrode 27, respectively, and when the sheet cassette 10 is moved from the accommodated position toward the separated position, as illustrated in FIG. 23, the first resilient member 16 and the second resilient member 15 are easily disconnected from the first electrode 28 and the second electrode 27, respectively.

Also, when the sheet cassette 10 is located at the accommodated position, the pressing plate 12 and the raising plate 13 are in contact with each other. As a result, the first electrode 28 and the second electrode 27 are electrically connected to each other. When the pressing plate 12 and the raising plate 13 are separated from each other, the first electrode 28 and the second electrode 27 are electrically disconnected from each other.

In the present embodiment, the switch SW illustrated in FIG. 11 is constituted by the pressing plate 12 and the raising plate 13. The switch SW is continuous electrically when the pressing plate 12 and the raising plate 13 are in contact with each other. The switch SW is not continuous electrically when the pressing plate 12 and the raising plate 13 are separated from each other. In the present embodiment, the connection circuit 90*b* extending from the connection terminal 90*a* of the sensor board 90 to the switch SW is constituted by the first electrode 28, the first resilient member 16, and the pressing plate 12 in order from a side nearer to the connection terminal 90*a*. The connection circuit 90*c* extending from the switch SW to the SGND is constituted by the raising plate 13, the second resilient member 15, and the second electrode 27 in order from a side nearer to the switch SW.

In the present embodiment, when the first electrode 28 and the second electrode 27 are electrically connected to each other by contact between the raising plate 13 and the pressing plate 12, and the sheet sensor 9 detects no sheets 18, the light emitter 92*a* of the detector 92 emits light, and the light receiver 92*b* receives the light emitted from the light emitter 92*a*. Thus, the sheet sensor 9 (the sensor board 90) outputs the first signal.

When the first electrode 28 and the second electrode 27 are electrically connected to each other by contact between the raising plate 13 and the pressing plate 12, and the sheet sensor 9 detects a sheet or an uppermost one of the sheets 18, the light emitter 92*a* of the detector 92 emits light, but the light emitted from the light emitter 92*a* is intercepted by the actuator 93 and is not received by the light receiver 92*b*. Thus, the sheet sensor 9 (the sensor board 90) outputs the second signal.

When the raising plate 13 is separated from the pressing plate 12, and thereby the first electrode 28 and the second electrode 27 are not electrically connected to each other, no light is emitted from the light emitter 92*a* of the detector 92 and received by the light receiver 92*b*. Thus, the sheet sensor 9 (the sensor board 90) outputs the second signal.

It is noted that, in the present embodiment, the pressing plate 12 and the raising plate 13 are formed of a conductive material such as galvanized sheet iron and conductive resin and may be formed of another conducting material such as another kind of metal and conductive resin. The pressing plate 12 and the raising plate 13 need not be formed of a conducting material entirely. For example, each of the pressing plate 12 and the raising plate 13 may be formed of a conductive material and a non-conductive material combined with each other as long as the first electrode 28 and the second electrode 27 are electrically connected to each other when the pressing plate 12 and the raising plate 13 are in contact with each other.

There will be next described control for reducing an error in calculation of the number S of sheets 18. Also in the configuration in which the raising plate 13 is movable between the spaced position and the contact position, as in the first embodiment, the image forming apparatus 1 is capable of executing control for reducing the error in calculation of the number S of sheets 18, i.e., the process for updating the number S of sheets 18 at S100, the process for updating the number S of sheets 18 at S200, and the process for calculating the number S of sheets 18 at S300.

Also in the present embodiment, when moving the raising plate 13 to move the pressing plate 12 upward by controlling the driver 4, the controller 6 starts counting pulses of the rotation pulse signal received from the rotation-pulse-signal output device 95, from the point in time when the signal received from the sheet sensor 9 (the sensor board 90) is switched from the second signal to the first signal. When the signal received from the sheet sensor 9 (the sensor board 90) is thereafter switched from the first signal to the second signal, the controller 6 ends counting pulses of the rotation pulse signal, determines the number of pulses of the rotation pulse signal, and calculates the height H of the sheets 18 which corresponds to the amount of upward movement of the pressing plate 12, based on the determined number of pulses of the rotation pulse signal.

Thus, also in the present embodiment, when calculating the number S of sheets 18 placed on the pressing plate 12 by calculating the height H of the sheets 18 based on the determined number of pulses of the rotation pulse signal, the controller 6 uses the signal received from the sheet sensor 9 (the sensor board 90), to detect the start of upward movement of the pressing plate 12. This configuration eliminates the need to use a specific sensor, resulting in simpler configuration of the image forming apparatus 1 and reduction in increased cost.

In the image forming apparatus 1, as described above, when the sheet cassette 10 is located at the separated position, the pressing plate 12 is located at the first position. Accordingly, in the process for updating the number S of sheets 18 at S100, when the sheet cassette 10 is, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 28 and the second electrode 27 are electrically connected to each other by contact between the pressing plate 12 and the raising plate 13.

The first electrode 28 is plate-shaped and disposed on the rail 201*a* of the body housing 2, and the second electrode 27 is the frame disposed at the lower portion of the sheet-cassette accommodating portion 2*a*. This makes it possible to arrange the first electrode 28 and the second electrode 27 without complicating the configuration of the image forming apparatus 1, enabling size reduction of the sheet conveying device without hindrance.

In the process for updating the number S of sheets 18 at S100, the sheet sensor 9 (the sensor board 90) outputs the second signal at S103 because, at the point in time when the sheet cassette 10 is inserted to the accommodated position, the pressing plate 12 is located at the first position and the pressing plate 12 and the raising plate 13 are separated from each other, and thereby the first electrode 28 and the second electrode 27 are not electrically connected to each other. Also, the controller 6 at S108 determines that the sheet sensor 9 (the sensor board 90) is outputting the first signal, that is, the controller 6 at S108 determines that the signal received from the sheet sensor 9 (the sensor board 90) is switched from the second signal to the first signal, because upward movement of the raising plate 13 is started by activation of the motor 40, thereby the raising plate 13 contacts the pressing plate 12, and thereby the first electrode 28 and the second electrode 27 are electrically connected to each other.

In the process for updating the number S of sheets 18 at S200, in the case where the sheet cassette 10 has not been removed in the power-off state, the sheet sensor 9 (the sensor board 90) outputs the second signal at the point in time when the image forming apparatus 1 is turned on, because the sheets 18 supported on the pressing plate 12 are located at the sheet suppliable position, the pressing plate 12 and the raising plate 13 are in contact with each other, and the sheet sensor 9 is in a state where it is detecting the uppermost one of the sheets.

In the case where the sheet cassette 10 has not been removed in the power-off state, the sheet sensor 9 (the sensor board 90) outputs the first signal at the point in time when the image forming apparatus 1 is turned on, because the pressing plate 12 supporting no sheets 18 is located at the highest position, the pressing plate 12 and the raising plate 13 are in contact with each other, and the sheet sensor 9 is in a state where it is detecting no sheets 18.

In the case where the sheet cassette 10 has been removed in the power-off state of the image forming apparatus 1, the sheet sensor 9 (the sensor board 90) outputs the second signal at the point in time when the image forming apparatus 1 is turned on, because the pressing plate 12 is located at the first position, and the pressing plate 12 and the raising plate 13 are separated from each other.

The controller 6 at S204 determines that the sheet sensor 9 (the sensor board 90) is not outputting the second signal, that is, the controller 6 at S204 determines that the signal received from the sheet sensor 9 (the sensor board 90) has been switched from the second signal to the first signal, because upward movement of the raising plate 13 is started by activation of the motor 40, thereby the raising plate 13 contacts the pressing plate 12, and thereby the first electrode 28 and the second electrode 27 are electrically connected to each other.

Effects in First and Second Embodiments

In the first embodiment, as described above, the sheet conveying device of the image forming apparatus 1 includes: the sheet cassette 10 including the cassette body 11, the pressing plate 12, the raising plate 13, the first resilient member 14, and the second resilient member 15; the body housing 2; the sheet-cassette accommodating portion 2*a*; the first electrode 26; the second electrode 27; the sheet conveyor 20; the driver 4; the sheet sensor 9; the rotation-pulse-signal output device 95; and the controller 6. The raising plate 13 moves the pressing plate 12 between the first position and the second position while kept in contact with the pressing plate 12. The sheet sensor 9 (the sensor board 90) outputs the first signal when the first electrode 26 and the second electrode 27 are electrically connected to each other by contact between the pressing plate 12 and the first end portion 14*a* of the first resilient member 14, and the sheet sensor 9 detects no sheets 18. The sheet sensor 9 (the sensor board 90) outputs the second signal when the first electrode 26 and the second electrode 27 are electrically connected to each other by contact between the pressing plate 12 and the first end portion 14*a* of the first resilient member 14, and the sheet sensor 9 detects a sheet 18. The sheet sensor 9 (the sensor board 90) outputs the second signal when the first electrode 26 and the second electrode 27 are not electrically connected to each other due to separation of the pressing plate 12 and the first end portion 14*a* of the first resilient member 14 from each other. The controller 6 is configured to receive the first signal, the second signal, and the rotation pulse signal. When moving the raising plate 13 to move the pressing plate 12 upward by controlling the driver 4, the controller 6 starts counting pulses of the rotation pulse signal received from the rotation-pulse-signal output device 95, from the point in time when the signal received from the sheet sensor 9 (the sensor board 90) has been switched from the second signal to the first signal. When the signal received from the sheet sensor 9 (the sensor board 90) is thereafter switched from the first signal to the second signal, the controller 6 ends counting pulses of the rotation pulse signal, determines the number of pulses of the rotation signal, and calculates the amount of upward movement of the pressing plate 12 based on the determined number of pulses of the rotation pulse signal.

When calculating the number S of sheets 18 placed on the pressing plate 12 by calculating the height H of the sheets 18 which corresponds to the amount of upward movement of the pressing plate 12, based on the determined number of pulses of the rotation pulse signal, the controller 6 uses the signal received from the sheet sensor 9 (the sensor board 90), to detect the start of upward movement of the pressing plate 12. This configuration eliminates the need to use a specific sensor, resulting in simpler configuration of the image forming apparatus 1 and reduction in increased cost.

The sheet conveying device according to the second embodiment includes: the sheet cassette 10 including the cassette body 11, the pressing plate 12, the raising plate 13, the first resilient member 16, and the second resilient member 15; the body housing 2; the sheet-cassette accommodating portion 2*a*; the first electrode 28; the second electrode 27; the sheet conveyor 20; the driver 4; the sheet sensor 9; the rotation-pulse-signal output device 95; and the controller 6. The raising plate 13 is movable between the spaced position at which the raising plate 13 is spaced from the pressing plate 12 and the contact position at which the raising plate 13 is in contact with the pressing plate 12 to move the pressing plate 12 in the up and down direction between the first position and the second position. The sheet sensor 9 (the sensor board 90) outputs the first signal when the first electrode 28 and the second electrode 27 are electrically connected to each other by contact between the raising plate 13 and the pressing plate 12, and the sheet sensor 9 detects no sheets 18. The sheet sensor 9 (the sensor board 90) outputs the second signal when the first electrode 28 and the second electrode 27 are electrically connected to each other by contact between the raising plate 13 and the pressing plate 12, and the sheet sensor 9 (the sensor board 90) detects a sheet 18. The sheet sensor 9 (the sensor board 90) outputs the second signal when the raising plate 13 is separated from the pressing plate 12, and thereby the first electrode 28 and the second electrode 27 are not electrically connected to each other. The controller 6 is configured to receive the first signal, the second signal, and the rotation pulse signal. When moving the raising plate 13 to move the pressing plate 12 upward by controlling the driver 4, the controller 6 starts counting pulses of the rotation pulse signal received from the rotation-pulse-signal output device 95, from the point in time when the signal received from the sheet sensor 9 (the sensor board 90) is switched from the second signal to the first signal. When the signal received from the sheet sensor 9 (the sensor board 90) is thereafter switched from the first signal to the second signal, the controller 6 ends counting pulses of the rotation pulse signal, determines the number of pulses of the rotation pulse signal, and calculates the amount of upward movement of the pressing plate 12 based on the determined number of pulses of the rotation pulse signal.

When calculating the number S of sheets 18 placed on the pressing plate 12 by calculating the height H of the sheets 18 which corresponds to the amount of upward movement of the pressing plate 12, based on the determined number of pulses of the rotation pulse signal, the controller 6 uses the signal received from the sheet sensor 9 (the sensor board 90), to detect the start of upward movement of the pressing plate 12. This configuration eliminates the need to use a specific sensor, resulting in simpler configuration of the image forming apparatus 1 and reduction in increased cost.

The sheet cassette 10 is movable between the accommodated position at which the sheet cassette 10 is accommodated in the body housing 2 and the separated position at which the sheet cassette 10 is separated from the body housing 2. When the sheet cassette 10 is located at the separated position, the pressing plate 12 is located at the first position.

With this configuration, when the sheet cassette 10 is, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 26 and the second electrode 27 are electrically connected to each other by contact between the pressing plate 12 and the first end portion 14*a* of the first resilient member 14. When the sheet cassette 10 is, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 28 and the second electrode 27 are electrically connected to each other by contact between the pressing plate 12 and the raising plate 13.

In the first embodiment, the second end portion 14*b* of the first resilient member 14 is configured to contact the first electrode 26 slidably in the direction of movement of the sheet cassette 10, and the second end portion 15*b* of the second resilient member 15 is configured to contact the second electrode 27 slidably in the direction of movement of the sheet cassette 10. With this configuration, when the sheet cassette 10 is located at the accommodated position, the first resilient member 14 and the second resilient member 15 are held in reliable contact with the first electrode 26 and the second electrode 27, respectively, and when the sheet cassette 10 is moved from the accommodated position toward the separated position, the first resilient member 14 and the second resilient member 15 are easily disconnected from the first electrode 26 and the second electrode 27, respectively.

The rails 201*a* for guiding the sheet cassette 10 are provided in the sheet-cassette accommodating portion 2*a*. The first electrode 26 is plate-shaped and disposed on the rail 201*a*. The second electrode 27 is the frame disposed at the lower portion of the sheet-cassette accommodating portion 2*a*. This makes it possible to arrange the first electrode 26 and the second electrode 27 without complicating the configuration of the image forming apparatus 1, enabling size reduction of the sheet conveying device without hindrance.

The first resilient member 14 is contactable with the edge portion 12*b* of the pressing plate 12. This ensures reliable contact between the first resilient member 14 and the pressing plate 12, resulting in stable electric connection between the first resilient member 14 and the pressing plate 12.

The pressing plate 12 is coated with the conductive grease 121, and the raising plate 13 is held in contact with the portion of the pressing plate 12 to which the conductive grease 121 is applied. Since the portion of the pressing plate 12 which is in contact with the raising plate 13 is coated with the conductive grease 121, the pressing plate 12 and the raising plate 13 are electrically connected to each other stably. In the second embodiment, the second end portion 16*b* of the first resilient member 16 is configured to contact the first electrode 28 slidably in the direction of movement of the sheet cassette 10, and the second end portion 15*b* of the second resilient member 15 is configured to contact the second electrode 27 slidably in the direction of movement of the sheet cassette 10. With this configuration, when the sheet cassette 10 is located at the accommodated position, the first resilient member 16 and the second resilient member 15 are held in reliable contact with the first electrode 28 and the second electrode 27, respectively, and when the sheet cassette 10 is moved from the accommodated position toward the separated position, the first resilient member 16 and the second resilient member 15 are easily disconnected from the first electrode 28 and the second electrode 27, respectively. The rails 201*a* for guiding the sheet cassette 10 are provided in the sheet-cassette accommodating portion 2*a*. The first electrode 28 is plate-shaped and disposed on the rail 201*a*. The second electrode 27 is the frame disposed at the lower portion of the sheet-cassette accommodating portion 2*a*. This makes it possible to arrange the first electrode 28 and the second electrode 27 without complicating the configuration of the image forming apparatus 1, enabling size reduction of the sheet conveying device without hindrance. When the sheet cassette 10 is located at the accommodated position, the first resilient member 16 is in contact with the edge portion 12*b* of the pressing plate 12. Thus, the first resilient member 16 and the pressing plate 12 are electrically connected to each other stably.

Third Embodiment

Figure 24:
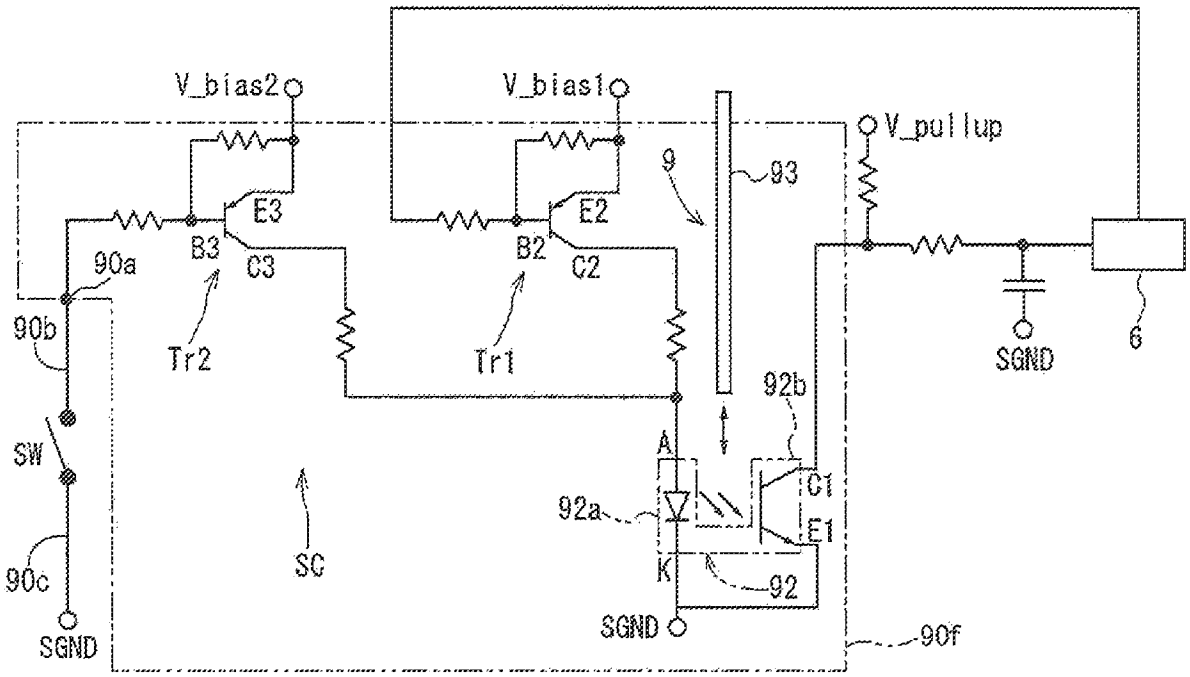
FIG. 24 is a circuit diagram of a power supply circuit and the sensor board on which the detector of the sheet sensor is mounted.

There will be next described a third embodiment. It is noted that the same reference numerals as used in the first embodiment are used to designate the corresponding elements of the third embodiment, and the description thereof is dispensed with. As illustrated in FIG. 24, the detector 92 of the sheet sensor 9 is mounted on a sensor board 90*f*. The light emitter 92*a* of the detector 92 is, for example, the LED. The cathode K of the LED is connected to the SGND.

A first transistor Tr1 and a second transistor Tr2 are mounted on the sensor board 90*f*. The collector C2 of the first transistor Tr1 and a collector C3 of the second transistor Tr2 are connected to the anode A of the LED. The first transistor Tr1 and the second transistor Tr2 are used as switching elements. A voltage V_bias1 is applied to an emitter E2 of the first transistor Tr1, and a voltage V_bias2 is applied to an emitter E3 of the second transistor Tr2. Each of the voltage V_bias1 and the voltage V_bias2 is set at 3.3 V, for example.

The base B2 or the first transistor Tr1 is connected to the controller 6. The controller 6 is configured to output a supply command. The supply command output from the controller 6 is input to the base B2 of the first transistor Tr1. The first transistor Tr1 is turned on when the supply command is input to the base B2. When the first transistor Tr1 is turned on, electric power is supplied to the light emitter 92*a*, causing the light emitter 92*a* to emit light. That is, the supply command output from the controller 6 is an instruction for supplying electric power to the light emitter 92*a* of the sheet sensor 9.

A base B3 of the second transistor Tr2 is connected to the SGND via the switch SW. When the switch SW is closed, and the base B3 and the SGND are connected to each other, the second transistor Tr2 is turned on. When the second transistor Tr2 is turned on, electric power is supplied to the light emitter 92*a*, causing the light emitter 92*a* to emit light. When the switch SW is opened, the second transistor Tr2 is turned off, and electric power is not supplied to the light emitter 92*a*, causing the light emitter 92*a* to emit no light.

The light receiver 92*b* of the detector 92 is a phototransistor, for example. The emitter E1 of the phototransistor is connected to the SGND. The collector C1 of the phototransistor is connected to the controller 6 and pulled up to a predetermined voltage. When light emitted from the light emitter 92*a* is received by the light receiver 92*b*, the collector C1 and the emitter E1 are electrically connected to each other, and the sheet sensor 9 (the sensor board 90*f*) outputs the first signal to the controller 6. When light emitted from the light emitter 92*a* is not received by the light receiver 92*b*, the collector C1 and the emitter E1 are not electrically connected to each other, and the sheet sensor 9 (the sensor board 90*f*) outputs the second signal to the controller 6.

The switch SW is constituted by the first end portion 14*a* of the first resilient member 14 and the edge portion 12*b* of the pressing plate 12. When the first end portion 14*a* and the edge portion 12*b* contacts each other, the switch SW is closed. When the first end portion 14*a* and the edge portion 12*b* are separated from each other, the switch SW is opened.

When the sheet cassette 10 is located at the accommodated position, the first electrode 26 connected to the first resilient member 14 is connected to the connection terminal 90*a* of the sensor board 90*f* which is connected to the base B3 of the second transistor Tr2. The connection circuit 90*b* extending from the connection terminal 90*a* of the sensor board 90*f* to the switch SW is constituted by the first electrode 26 and the first resilient member 14 in order from a side nearer to the connection terminal 90*a*. The connection circuit 90*c* extending from the switch SW to the SGND is constituted by the pressing plate 12, the raising plate 13, the second resilient member 15, and the second electrode 27 in order from a side nearer to the switch SW. The connection circuit 90*b*, the switch SW, and the connection circuit 90*c* constitute a switch mechanism, which extends from the connection terminal 90*a* of the sensor board 90*f* to the SGND.

In the sheet sensor 9 configured as described above, when electric power is received by the light emitter 92*a* and when the actuator 93 is not located between the light emitter 92*a* and the light receiver 92*b* and the sheet sensor 9 detects no sheets 18, the light emitter 92*a* of the detector 92 emits light, and the light receiver 92*b* receives the light emitted from the light emitter 92*a*. Thus, the sheet sensor 9 (the sensor board 90*f*) outputs the first signal.

When electric power is received by the light emitter 92*a* and when the actuator 93 is located between the light emitter 92*a* and the light receiver 92*b* and the sheet sensor 9 detects a sheet 18, the light emitter 92*a* of the detector 92 emits light, but the light emitted from the light emitter 92*a* is intercepted by the actuator 93 and is not received by the light receiver 92*b*. Thus, the sheet sensor 9 (the sensor board 90*f*) outputs the second signal.

When no electric power is received by the light emitter 92*a*, no light is emitted from the light emitter 92*a* of the detector 92 and received by the light receiver 92*b*. Thus, the sheet sensor 9 (the sensor board 90*f*) outputs the second signal.

The case where electric power is received by the light emitter 92*a* includes: a case where the supply command output from the controller 6 is received by the first transistor Tr1 in the state in which the first electrode 26 and the second electrode 27 are not electrically connected to each other due to separation between the pressing plate 12 and the first end portion 14*a* of the first resilient member 14; and a case where the first electric 26 and the second electrode 27 are electrically connected to each other by contact between the pressing plate 12 and the first end portion 14*a* of the first resilient member 14. It is noted that, in the case where the first electrode 26 and the second electrode 27 are electrically connected to each other, the light emitter 92*a* receives the supplied electric power regardless of whether the first transistor Tr1 receives the supply command from the controller 6.

The case where no electric power is received by the light emitter 92*a* is a case where the first transistor Tr1 receives no supply command from the controller 6 in the state in which the first electrode 26 and the second electrode 27 are not electrically connected to each other due to separation between the pressing plate 12 and the first end portion 14*a* of the first resilient member 14.

In the image forming apparatus 1, a power supply circuit SC configured to supply electric power to the light emitter 92*a* of the sheet sensor 9 is constituted by the circuit including the first transistor Tr1, the second transistor Tr2, and the switch SW. In the image forming apparatus 1, the sheet conveying device is constituted by the sheet cassette 10, the body housing 2, the sheet-cassette accommodating portion 2*a*, the first electrode 26, the second electrode 27, the sheet conveyor 20, the driver 4, the sheet sensor 9, the rotation-pulse-signal output device 95, the controller 6, and the power supply circuit SC.

It is noted that, also in the present embodiment, the pressing plate 12 and the raising plate 13 are formed of galvanized sheet iron and may be formed of another conducting material such as another kind of metal and conductive resin. The pressing plate 12 and the raising plate 13 need not be formed of a conducting material entirely. For example, each of the pressing plate 12 and the raising plate 13 may be formed of a conductive material and a non-conductive material combined with each other as long as the first electrode 26 and the second electrode 27 are electrically connected to each other when the pressing plate 12 and the first end portion 14*a* of the first resilient member 14 are in contact with each other. For example, each of the pressing plate 12 and the raising plate 13 may be formed by sticking a resin plate and a metal plate to each other.

Control for Calculating Number S of Sheets

In the image forming apparatus 1, the controller 6 is configured to calculate the number S of sheets 18 accommodated in the sheet cassette 10. To calculate the number S of sheets 18, the controller 6 executes control described below. In the control for calculating the number S of sheets 18, it is possible to reduce the error in calculation of the number S of sheets 18 and to detect whether there is a failure in a mechanism for moving the raising plate 13 and the pressing plate 12 when calculating the number S of sheets 18. This mechanism may be hereinafter referred to as "pressing-plate moving mechanism".

There will be next described a process for updating the number S of sheets 18 at S400 when the sheet cassette 10 located at the separated position is inserted to the accommodated position of the sheet-cassette accommodating portion 2*a*.

Figure 25:
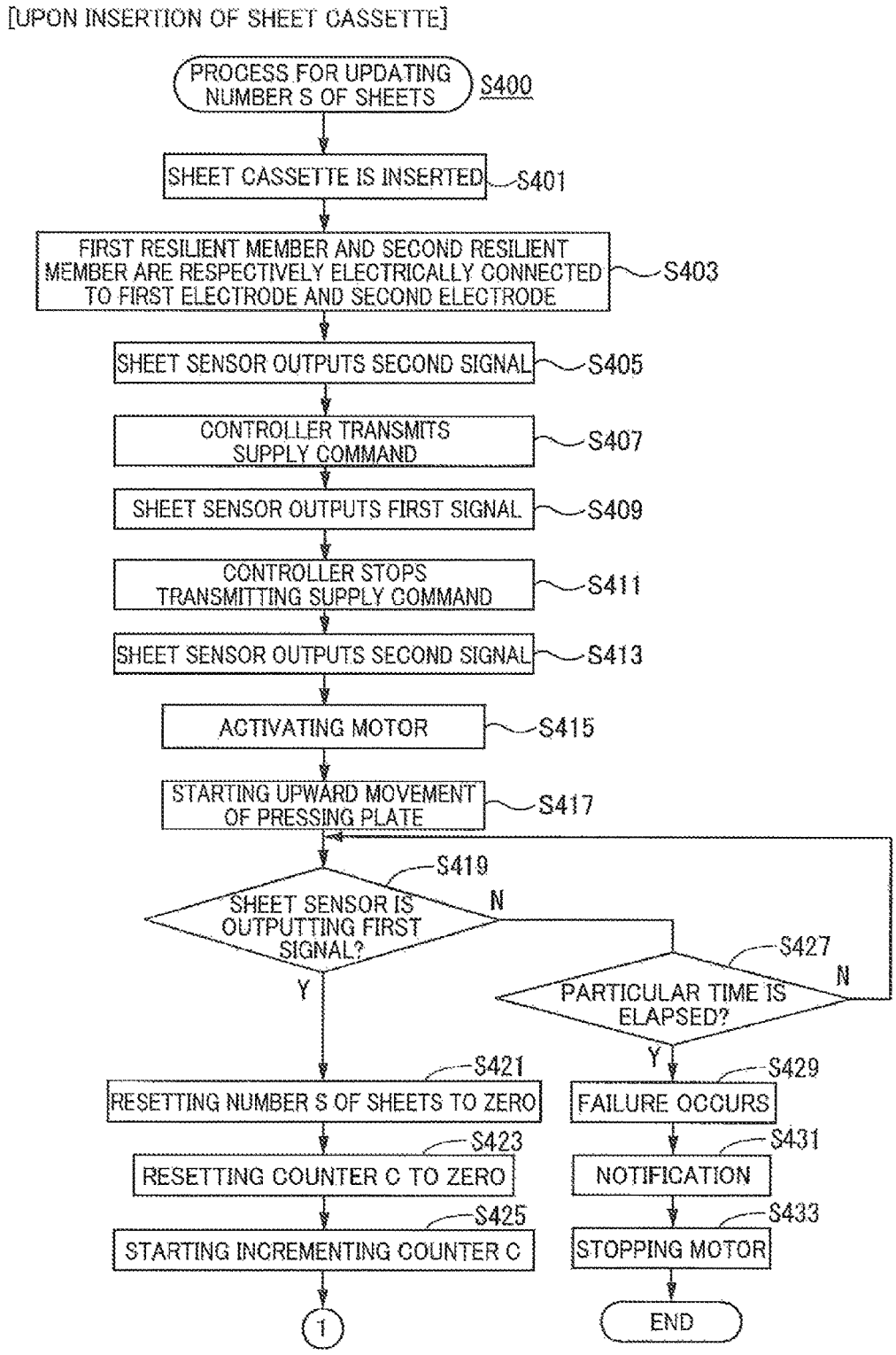
FIG. 25 is a flow chart representing steps at S401-S433 in a process for updating the number of sheets when the sheet cassette is inserted.

As illustrated in FIG. 25, when the sheet cassette 10 located at the separated position is inserted to the accommodated position (S401), the first resilient member 14 provided at the sheet cassette 10 and the first electrode 26 provided in the sheet-cassette accommodating portion 2*a* are electrically connected to each other by contact therebetween, and the second resilient member 15 provided at the sheet cassette 10 and the second electrode 27 provided in the sheet-cassette accommodating portion 2*a* are electrically connected to each other by contact therebetween (S403). At the point in time when the sheet cassette 10 is inserted to the accommodated position, the pressing plate 12 is located at the first position, and the edge portion 12*b* of the pressing plate 12 and the first end portion 14*a* of the first resilient member 14 are separated from each other. Thus, the first electrode 26 and the second electrode 27 are not electrically connected to each other, and the sheet sensor 9 (the sensor board 90*f*) outputs the second signal at S405. At S405, the controller 6 receives the second signal output from the sheet sensor 9 (the sensor board 90*f*).

Here, the state of the sheet cassette 10 inserted from the separated position to the accommodated position includes: a first state in which the sheet cassette 10 has been removed from and inserted into the sheet-cassette accommodating portion 2*a*, sheets 18 are supported on the pressing plate 12, and no failure occurs in the pressing-plate moving mechanism; a second state in which the sheet cassette 10 has been removed from and inserted into the sheet-cassette accommodating portion 2*a*, no sheets 18 are supported on the pressing plate 12, and no failure occurs in the pressing-plate moving mechanism; and a third state in which the sheet cassette 10 has been removed from and inserted into the sheet-cassette accommodating portion 2*a*, a sheet or sheets 18 are supported or not supported on the pressing plate 12, and a failure occurs in the pressing-plate moving mechanism.

The state in which a failure occurs in the pressing-plate moving mechanism is a state in which there is a non-electrically-connected portion in at least a portion of the switch mechanism extending from the connection terminal 90*a* of the sensor board 90*f* to the SGND via the connection circuit 90*b*, the switch SW, and the connection circuit 90*c*, for the reason why the pressing plate 12 is not moved normally when the motor 40 is driven to move the pressing plate 12 upward, for example.

One example of this state is a state in which the driving force supplied from the motor 40 is not transmitted to the transmission mechanism 41, and the pressing plate 12 is not moved upward because the pressing-plate driving gear 42 connected to the motor 40 and the pressing-plate moving gear 411 are not engaged with each other normally due to breakage or loss of the pressing-plate moving gear 411 of the transmission mechanism 41. Another example of this state is a state in which the first resilient member 14 and the pressing plate 12 are not electrically connected to each other, and the switch SW does not become the closed state when the pressing plate 12 is moved in the direction directed from the first position toward the second position because the first resilient member 14 does not contact the pressing plate 12 due to deformation or loss of the first resilient member 14.

Figure 27:
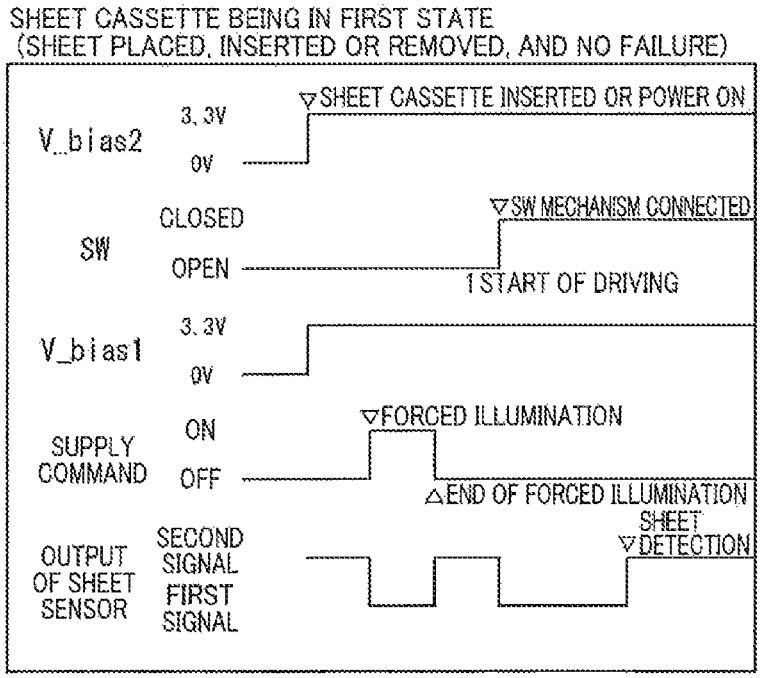
FIG. 27 is a timing chart representing outputs of the sheet sensor and so on when the sheet cassette is in a first state.
Figure 28:
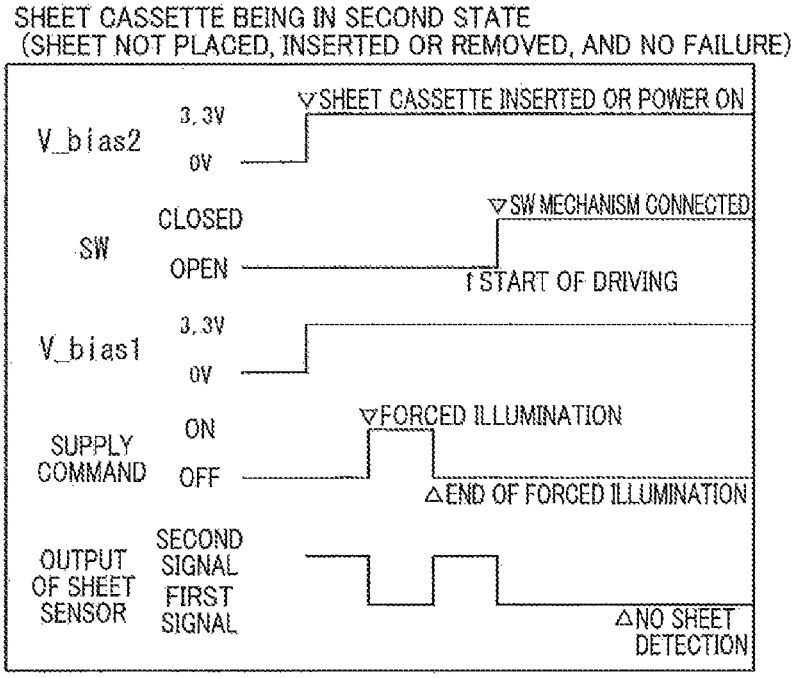
FIG. 28 is a timing chart representing outputs of the sheet sensor and so on when the sheet cassette is in a second state.
Figure 29:
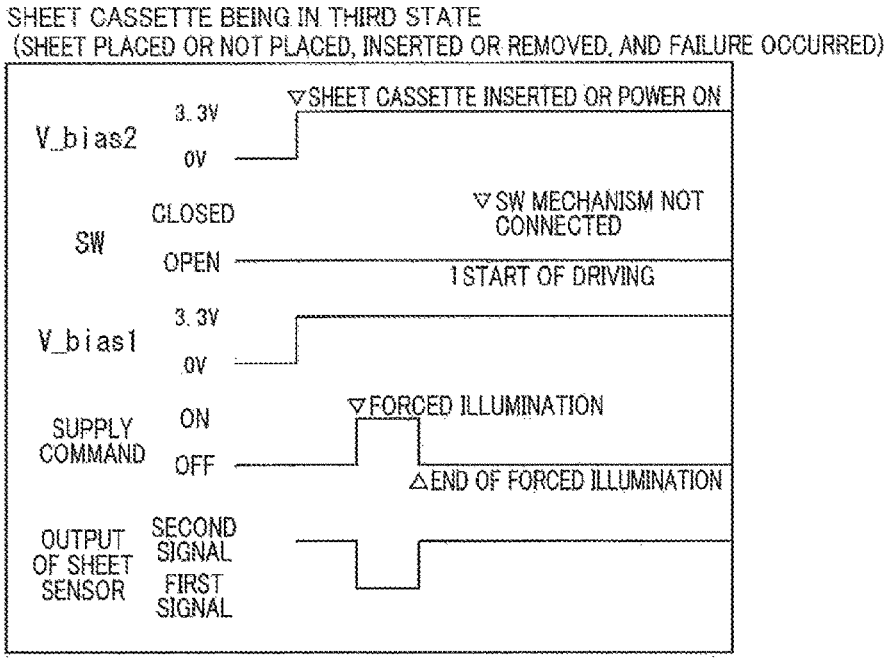
FIG. 29 is a timing chart representing outputs of the sheet sensor and so on when the sheet cassette is in a third state.

FIGS. 27, 28, and 29 are timing charts when the controller 6 calculates the number S of sheets 18 in the case where the sheet cassette 10 is in a corresponding one of the first state, the second state, and the third state. Each timing chart represents: a state of application of the voltage V_bias1 to the first transistor Tr1; an open or closed state of the switch SW; a state of application of the voltage V_bias2 to the second transistor Tr2; a state of output of the supply command from the controller 6; and a state of output of the first and second signals from the sheet sensor 9 (the sensor board 90*f*).

As illustrated in FIGS. 27, 28, and 29 the sheet sensor 9 (the sensor board 90*f*) outputs the second signal (S405) at the point in time when the sheet cassette 10 is inserted to the accommodated position in the case where the sheet cassette 10 is in any of the first state, the second state, and the third state. The controller 6 at S407 transmits a supply command to the first transistor Tr1 in this state. When the supply command is transmitted from the controller 6, electric power is supplied to the light emitter 92*a* of the sheet sensor 9, and the light emitter 92*a* emits light. That is, when the switch SW is in the open state with the pressing plate 12 located at the first position, the controller 6 outputs the supply command to forcibly cause the light emitter 92*a* to illuminate.

Since the pressing plate 12 is located at the first position, and the actuator 93 is detecting no sheets 18, when the light emitter 92*a* emits light, the light emitted from the light emitter 92*a* is received by the light receiver 92*b*, and the sheet sensor 9 (the sensor board 90*f*) outputs the first signal at S409. In this case, the sheet sensor 9 (the sensor board 90*f*) outputs the first signal in the case where the sheet cassette 10 is in any of the first state, the second state, and the third state. At S409, the controller 6 receives the first signal output from the sheet sensor 9 (the sensor board 90*f*).

The controller 6 at S411 stops transmitting the supply command in response to receiving the first signal from the sheet sensor 9 (the sensor board 90*f*). When the transmission of the supply command is stopped, the light emitter 92*a* emits no light. That is, the controller 6 stops transmitting the supply command to end the forcible illumination of the light emitter 92*a*. When no light is emitted from the light emitter 92*a*, the light receiver 92*b* receives no light. Thus, the sheet sensor 9 (the sensor board 90*f*) outputs the second signal at S413. In this case, the sheet sensor 9 (the sensor board 90*f*) outputs the second signal in the case where the sheet cassette 10 is in any of the first state, the second state, and the third state. At S413, the controller 6 receives the second signal output from the sheet sensor 9 (the sensor board 90*f*) in response to stopping transmitting the supply command.

After the controller 6 stops transmitting the supply command, and the sheet sensor 9 (the sensor board 90*f*) outputs the second signal, the controller 6 activates the motor 40 at S415. When the motor 40 is activated, the driving force supplied from the motor 40 causes upward pivotal movement of the raising plate 13, which starts upward movement of the pressing plate 12 at S417. After activating the motor 40, the controller 6 at S419 determines whether the sheet sensor 9 (the sensor board 90*f*) is outputting the first signal.

When the controller 6 at S419 determines that the sheet sensor 9 (the sensor board 90*f*) is outputting the first signal, the controller 6 at S421 resets the current number S stored in the controller 6 to zero and at S423 resets the value of the counter C to zero.

Figure 32:
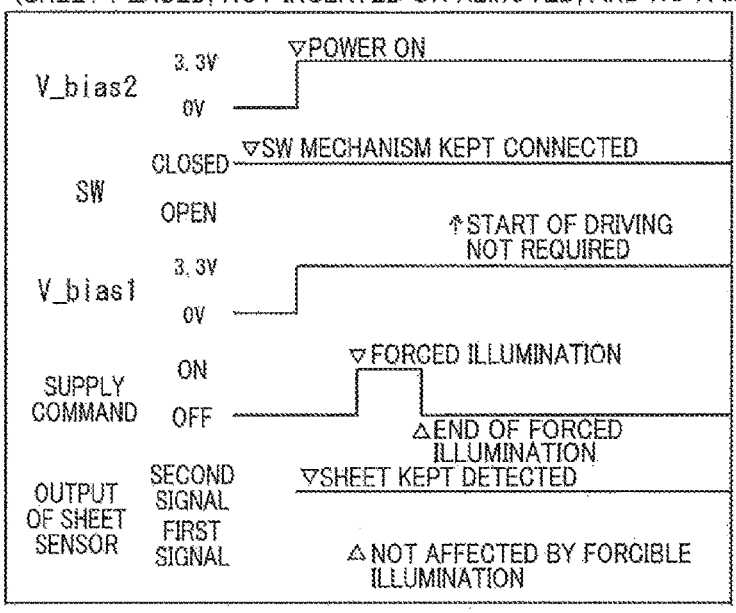
FIG. 32 is a timing chart representing outputs of the sheet sensor and so on when the sheet cassette is in a fourth state.

After the controller 6 at S419 determines that the sheet sensor 9 (the sensor board 90*f*) is outputting the first signal and resets the number S of sheets 18 and the value of the counter C at S421 and S423, the controller 6 at S425 starts incrementing the counter C to determine the number of rotations of the motor 40. That is, the controller 6 starts counting pulses of the rotation pulse signal from the point in time when the signal received from the sheet sensor 9 (the sensor board 90*f*) is switched from the second signal to the first signal as illustrated in FIG. 32.

In this case, when the motor 40 is activated in the state in which the pressing plate 12 is located at the first position (S415), the raising plate 13 is driven by the motor 40, and upward movement of the pressing plate 12 is started. When the upward movement of the pressing plate 12 is started, the first end portion 14*a* of the first resilient member 14 and the edge portion 12*b* of the pressing plate 12 contact each other, which electrically connects the first electrode 26 and the second electrode 27 to each other. When the first electrode 26 and the second electrode 27 are electrically connected to each other, the light emitter 92*a* of the sheet sensor 9 emits light.

At startup of the motor 40, the pressing plate 12 is located at the first position, and the actuator 93 is not located between the light emitter 92*a* and the light receiver 92*b*. Thus, the light emitted from the light emitter 92*a* is received by the light receiver 92*b*. As a result, the signal output from the sheet sensor 9 (the sensor board 90*f*) is switched from the second signal to the first signal. When the signal received from the sheet sensor 9 (the sensor board 90*f*) is switched from the second signal to the first signal, the controller 6 starts counting rotations of the motor 40 from the switching of the signal.

It is noted that in the case where the controller 6 at S419 determines that the sheet sensor 9 (the sensor board 90*f*) is outputting the first signal, the sheet cassette 10 is in the first state or the second state. Also, the counter C is provided in the controller 6 and configured to count rotations of the motor 40 by incrementing the count value by one each time when the controller 6 receives the rising or falling edge of a pulse of a rotation pulse signal output from the rotation-pulse-signal output device 95, for example.

When the controller 6 at S419 determines that the sheet sensor 9 (the sensor board 90*f*) is not outputting the first signal, the controller 6 at S427 determines whether a particular length of time is elapsed from the stop of the transmission of the supply command to the first transistor Tr1. When the controller 6 at S427 determines that the particular length of time is not elapsed, the controller 6 executes the step at S419 again.

When the controller 6 at S427 determines that the particular length of time is elapsed, the controller 6 at S429 determines that a failure occurs in the pressing-plate moving mechanism, for example, the pressing plate 12 has not been moved upward. That is, in the case where the sheet sensor 9 (the sensor board 90*f*) is not outputting the first signal even when the particular length of time is elapsed from the stop of the transmission of the supply command to the first transistor Tr1, the controller 6 determines that a failure occurs in the pressing-plate moving mechanism because the light emitter 92*a* of the sheet sensor 9 does not emit light for a reason that, even when the motor 40 is activated, the pressing plate 12 is not moved upward normally, and the switch SW is not switched to the closed state, for example. Thus, in the case where the controller 6 determines that a failure occurs in the pressing-plate moving mechanism, the sheet cassette 10 is in the third state.

When the controller 6 determines that a failure occurs in the pressing-plate moving mechanism, the controller 6 at S431 notifies an outside of information indicating that the failure occurs in the pressing-plate moving mechanism. This notification may be, for example, provided by controlling the display of the image forming apparatus 1 to display the information or by controlling a speaker of the image forming apparatus 1 to output a voice. After providing this notification, the controller 6 stops the motor 40 at S433 and terminates the process for updating the number S of sheets 18 at S400.

Figure 26:
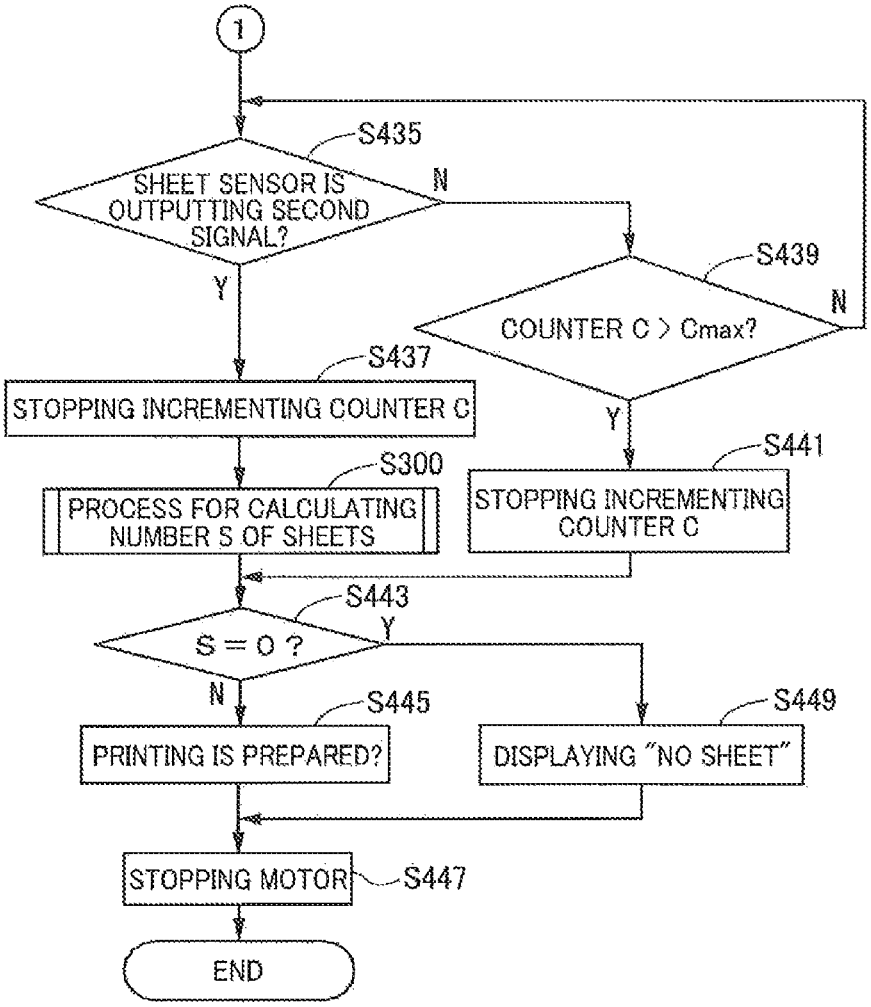
FIG. 26 is a flow chart representing steps at S435-S449 in the process for updating the number of sheets when the sheet cassette is inserted.

As illustrated in FIG. 26, after starting counting rotations of the motor 40, the controller 6 at S435 determines whether the sheet sensor 9 (the sensor board 90*f*) is outputting the second signal. That is, the controller 6 determines whether the signal received from the sheet sensor 9 (the sensor board 90*f*) is switched from the first signal to the second signal as illustrated in FIG. 32.

When the controller 6 at S435 determines that the sheet sensor 9 (the sensor board 90*f*) is outputting the second signal, the controller 6 stops incrementing the counter C at S437 and obtains the count value counted in a period extending from the start of the incrementing of the counter C to the stop of the incrementing. The controller 6 at S300 uses the obtained count value of the counter C to execute the process for calculating the number S of sheets 18, thereby calculating the updated number S of sheets 18.

It is noted that the state in which the light receiver 92*b* receives the light emitted from the light emitter 92*a*, and the sheet sensor 9 (the sensor board 90*f*) outputs the first signal is switched to the state in which the sheet sensor 9 (the sensor board 90*f*) outputs the second signal, when the upper surface of the uppermost one of the sheets 18 supported on the pressing plate 12 contacts the contact member 91, and thereby the light emitted from the light emitter 92*a* is intercepted by the actuator 93 and is not received by the light receiver 92*b*. That is, in the case where the controller 6 at S435 determines that the sheet sensor 9 (the sensor board 90*f*) is outputting the second signal, the sheet cassette 10 is in the first state.

When the controller 6 at S435 determines that the sheet sensor 9 (the sensor board 90*f*) is not outputting the second signal, the controller 6 at S439 determines whether the count value of the counter C is greater than the value Cmax. When the controller 6 at S439 determines that the count value of the counter C is greater than the value Cmax, the controller 6 at S441 stops incrementing the counter C.

The state in which the count value of the counter C is greater than the value Cmax is a state in which the pressing plate 12 supporting no sheets 18 and moved upward is located at a position at which the pressing plate 12 is in contact with the pickup roller 21. That is, in the case where the controller 6 at S439 determines that the count value of the counter C is greater than the value Cmax, the sheet cassette 10 is in the second state. It is noted that when the controller 6 at S439 determines that the count value of the counter C is greater than the value Cmax, the controller 6 does not update the number S of sheets 18 and keeps the number S at zero to which the number S is reset at S421.

When the controller 6 at S439 determines that the count value of the counter C is not greater than the value Cmax, this flow returns to S435 at which the controller 6 determines again whether the sheet sensor 9 (the sensor board 90*f*) is outputting the second signal.

After the completion of the process for calculating the number S of sheets 18 at S300 or after the increment of the counter C is stopped at S441, the controller 6 at S443 determines whether the number S of sheets 18 stored in the controller 6 is zero.

When the controller 6 at S443 determines that the number S stored in the controller 6 is not zero, the controller 6 at S445 determines that a preparation for printing is finished, at S447 stops the motor 40, and terminates the process for updating the number S of sheets 18 at S400. When the controller 6 at S443 determines that the number S stored in the controller 6 is zero, the controller 6 at S449 controls the display of the image forming apparatus 1 to display the information indicating that the image forming apparatus 1 is out of the sheets 18. The controller 6 at S447 stops the motor 40 and terminates the process for updating the number S of sheets 18 at S400.

In the process for updating the number S of sheets 18 at S400, as described above, in the case where the controller 6 receives the first signal from the sheet sensor 9 (the sensor board 90*f*) in response to transmitting the supply command to the power supply circuit SC before controlling the driver 4 to move the raising plate 13 to move the pressing plate 12 upward, and in the case where the controller 6 stops transmitting the supply command and controls the driver 4 to move the raising plate 13 upward and the controller 6 does not receive the first signal from the sheet sensor 9 (the sensor board 90*f*) even when the particular length of time is elapsed from the point in time when the controller 6 stops transmitting the supply command to the power supply circuit SC, the controller 6 determines that a failure occurs in the pressing-plate moving mechanism and provides the notification. This configuration enables the controller 6 to detect whether a failure occurs in the pressing-plate moving mechanism, before calculating the number S of sheets 18 based on the amount of upward movement of the pressing plate 12.

In the case where an instruction for forming an image is input to the image forming apparatus 1 when or after the process for updating the number S of sheets 18 is terminated, the controller 6 drives the devices including the image forming unit 5 to form the image on the sheet 18. In this case, each time when one sheet 18 is taken out of the sheet cassette 10, the controller 6 determines the number S of sheets 18 to a value obtained by subtracting one from the current number S of sheets 18 (S=S−1).

In the image forming apparatus 1, as described above, when the sheet cassette 10 is located at the separated position, the pressing plate 12 is located at the first position. Accordingly, in the process for updating the number S of sheets 18 at S400, when the sheet cassette 10 has been, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 26 and the second electrode 27 are electrically connected to each other by contact between the pressing plate 12 and the first end portion 14*a* of the first resilient member 14.

The first electrode 26 is plate-shaped and disposed on the rail 201*a* of the body housing 2, and the second electrode 27 is the frame disposed at the lower portion of the sheet-cassette accommodating portion 2*a*. This makes it possible to arrange the first electrode 26 and the second electrode 27 without complicating the configuration of the image forming apparatus 1, enabling size reduction of the sheet conveying device without hindrance.

There will be next described the process for updating the number S of sheets 18 at S500 in the case where the image forming apparatus 1 is turned on.

Before the image forming apparatus 1 is turned on, the image forming apparatus 1 in one of the following states: a state in which the sheet cassette 10 has not been removed from and inserted into the sheet-cassette accommodating portion 2*a* in the power-off state of the image forming apparatus 1, i.e., in a period extending from the point in time when the image forming apparatus 1 is turned off previously to the point in time when the image forming apparatus 1 is turned on at this time (that is, a state in which the sheet cassette 10 is kept inserted in the accommodated position of the sheet-cassette accommodating portion 2*a*); and a state in which the sheet cassette 10 has been removed from and inserted into the sheet-cassette accommodating portion 2*a* in the power-off state of the image forming apparatus 1 (that is, a state in which the sheet cassette 10 has been drawn from the accommodated position to the separated position and then inserted into the accommodated position again).

In the case where the sheet cassette 10 has not been removed in the power-off state, if sheets 18 are supported on the pressing plate 12, the sheets 18 supported on the pressing plate 12 are located at the sheet suppliable position, the pressing plate 12 and the first end portion 14*a* of the first resilient member 14 are in contact with each other, and the sheet sensor 9 is in a state where it is detecting the uppermost one of the sheets 18. In this case, the sheet sensor 9 (the sensor board 90) outputs the second signal at the point in time when the image forming apparatus is turned on.

In this case, the sheet cassette 10 is in a fourth state in which the sheet cassette 10 has not been removed from and inserted into the sheet-cassette accommodating portion 2*a*, a sheet or sheets 18 are supported on the pressing plate 12, and no failure occurs in the pressing-plate moving mechanism. FIG. 32 is a timing chart when the controller 6 calculates the number S of sheets 18 in the case where the sheet cassette 10 is in the fourth state. The timing chart represents the state of application of the voltage V_bias1 to the first transistor Tr1, the open or closed state of the switch SW, the state of application of the voltage V_bias2 to the second transistor Tr2, the state of output of the supply command from the controller 6, and the state of output of the first and second signals from the sheet sensor 9 (the sensor board 90*f*).

In the case where the sheet cassette 10 has not been removed in the power-off state, if no sheets 18 are supported on the pressing plate 12, the pressing plate 12 is moved upward to the highest position, the pressing plate 12 and the first end portion 14*a* of the first resilient member 14 are in contact with each other, and the sheet sensor 9 is in a state where it is detecting no sheets 18. In this case, the sheet sensor 9 (the sensor board 90*f*) outputs the first signal at the point in time when the image forming apparatus 1 is turned on.

Figure 33:
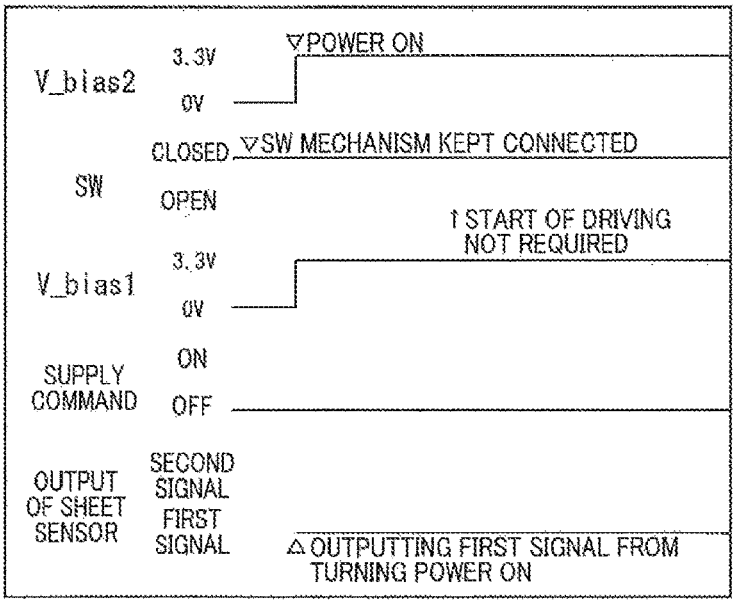
FIG. 33 is a timing chart representing outputs of the sheet sensor and so on when the sheet cassette is in a fifth state.

In this case, the sheet cassette 10 is in a fifth state in which the sheet cassette 10 has not been removed from and inserted into the sheet-cassette accommodating portion 2*a*, no sheets 18 are supported on the pressing plate 12, and no failure occurs in the pressing-plate moving mechanism. FIG. 33 is a timing chart when the controller 6 calculates the number S of sheets 18 in the case where the sheet cassette 10 is in the fifth state. The timing chart represents the state of application of the voltage V_bias1 to the first transistor Tr1, the open or closed state of the switch SW, the state of application of the voltage V_bias2 to the second transistor Tr2, the state of output of the supply command from the controller 6, and the state of output of the first and second signals from the sheet sensor 9 (the sensor board 90*f*).

In the case where the sheet cassette 10 has been removed in the power-off state of the image forming apparatus 1, the pressing plate 12 is located at the first position, and the pressing plate 12 and the first end portion 14*a* of the first resilient member 14 are separated from each other. Thus, the sheet sensor 9 (the sensor board 90*f*) outputs the second signal at the point in time when the image forming apparatus 1 is turned on. In this case, the sheet cassette 10 is in the first state, the second state, or the third state.

Figure 30:
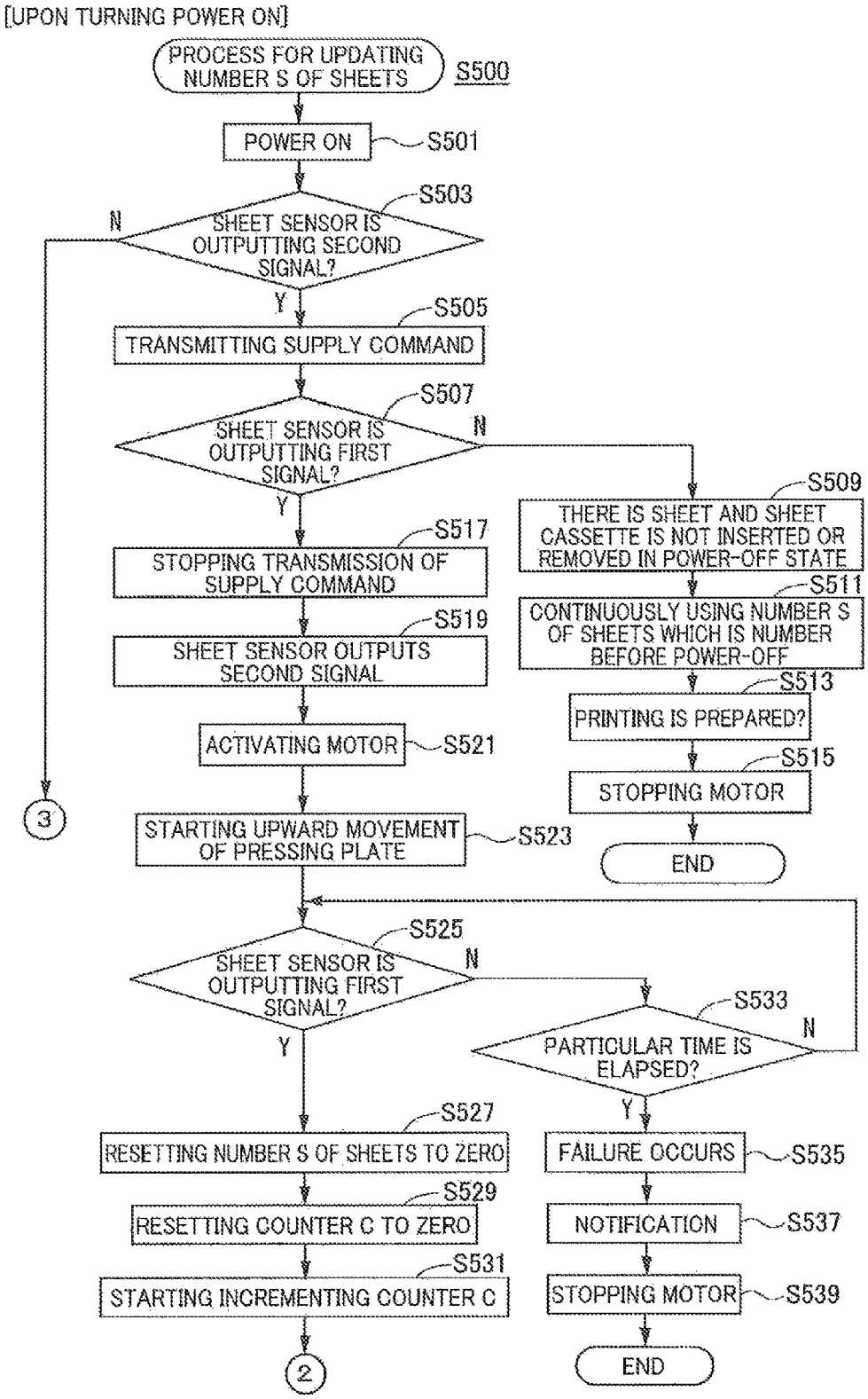
Figure 31:
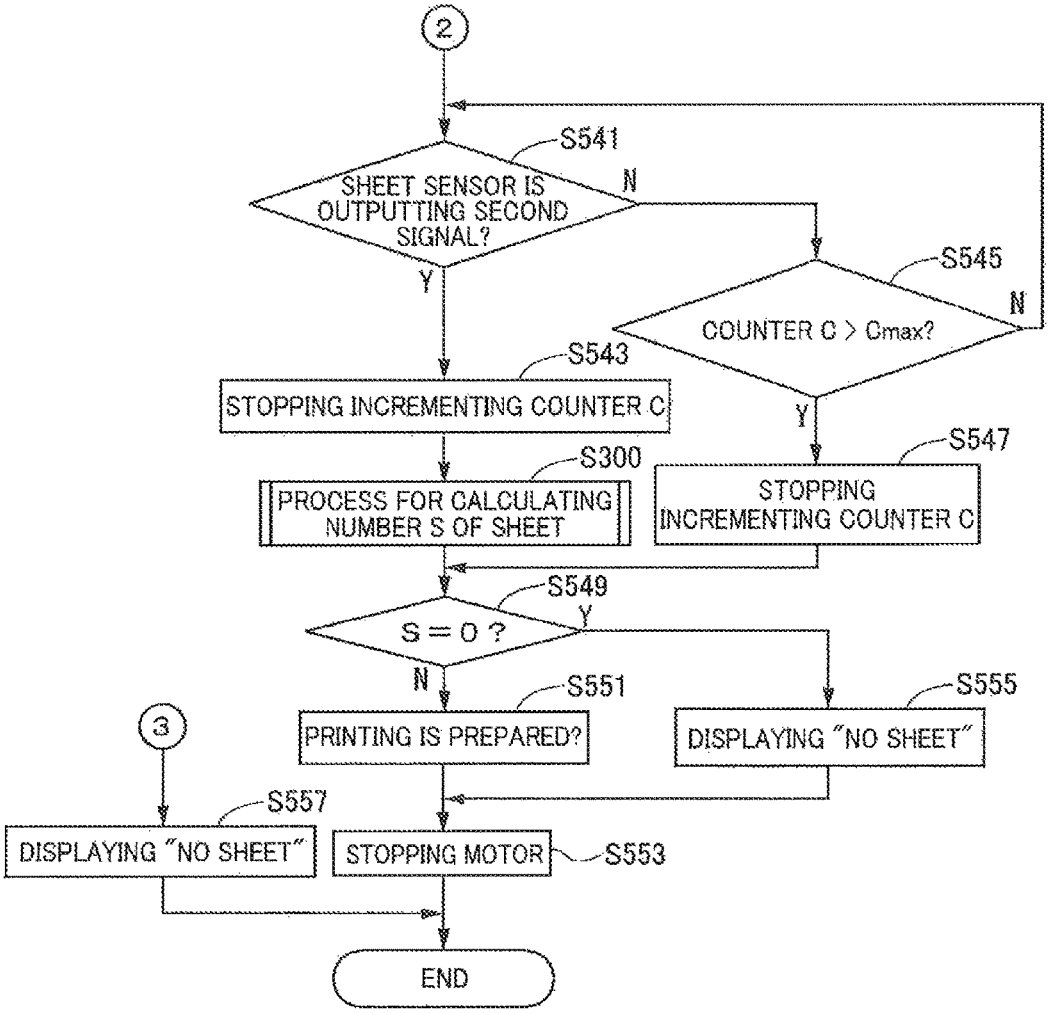

As illustrated in FIG. 30, when the image forming apparatus 1 is turned on at S501, the controller 6 at S503 determines whether the sheet sensor 9 (the sensor board 90*f*) is outputting the second signal. When the controller 6 at S503 determines that the sheet sensor 9 (the sensor board 90*f*) is not outputting the second signal, that is, when the controller 6 at S503 determines that the sheet sensor 9 (the sensor board 90*f*) is outputting the first signal, the controller 6 determines that the sheet cassette 10 is in the fifth state, and, as illustrated in FIG. 31, the controller 6 at S557 controls the display of the image forming apparatus 1 to display the information indicating that the image forming apparatus 1 is out of the sheets 18 and terminates the process for updating the number S of sheets 18 at S500.

When the controller 6 at S503 determines that the sheet sensor 9 (the sensor board 90*f*) is outputting the second signal, the controller 6 at S505 transmits the supply command to the first transistor Tr1. After transmitting the supply command, the controller 6 at S507 determines whether the sheet sensor 9 (the sensor board 90*f*) is outputting the first signal. When the supply command is transmitted by the controller 6, the light emitter 92*a* of the sheet sensor 9 forcibly emits light. When the light emitted from the light emitter 92*a* is received by the light receiver 92*b*, the sheet sensor 9 (the sensor board 90*f*) outputs the first signal. When the light emitted from the light emitter 92*a* is not received by the light receiver 92*b*, the sheet sensor 9 (the sensor board 90*f*) outputs the second signal.

When the controller 6 at S507 determines that the sheet sensor 9 (the sensor board 90*f*) is not outputting the first signal, the controller 6 at S509 determines that a sheet or sheets 18 are supported on the pressing plate 12 and that the sheet cassette 10 is not inserted or removed in the power-off state of the image forming apparatus 1. In the case where the supply command is transmitted by the controller 6, the sheet sensor 9 (the sensor board 90*f*) outputs the second signal without outputting the first signal, because the light emitted from the light emitter 92*a* is intercepted by the actuator 93 and not received by the light receiver 92*b* though the light emitter 92*a* of the sheet sensor 9 emits the light. That is, the sheet cassette 10 is in the fourth state, and the controller 6 determines that a sheet or sheets 18 are supported on the pressing plate 12 and that the sheet cassette 10 has not been removed in the power-cuff state of the image forming apparatus 1.

In this case, without updating the number S of sheets 18, the controller 6 at S511 continuously uses the number S of sheets 18 stored in the controller 6 before the image forming apparatus 1 is turned off. The controller 6 at S513 determines that the preparation for printing is finished, at S515 stops the motor 40, and terminates the process for updating the number S of sheets 18 at S500.

When the controller 6 at S507 determines that the sheet sensor 9 (the sensor board 90*f*) is outputting the first signal, the controller 6 at S517 stops transmitting the supply command. When the controller 6 at S507 determines that the sheet sensor 9 (the sensor board 90*f*) is outputting the first signal, the sheet cassette 10 is in the first state, the second state, or the third state.

When the controller 6 at S517 stops transmitting the supply command, the controller 6 ends the forcible illumination of the light emitter 92*a*. Since the light receiver 92*b* receives no light from the light emitter 92*a*, the sheet sensor 9 (the sensor board 90*f*) outputs the second signal at S519. In this case, the sheet sensor 9 (the sensor board 90*f*) outputs the second signal in the case where the sheet cassette 10 is in any of the first state, the second state, and the third state.

After the controller 6 stops the transmission of the supply command, and the sheet sensor 9 (the sensor board 90*f*) outputs the second signal, the controller 6 activates the motor 40 at S521. When the motor 40 is activated, the driving force supplied from the motor 40 causes upward pivotal movement of the raising plate 13, which starts upward movement of the pressing plate 12 at S523. After activating the motor 40, the controller 6 at S525 determines whether the sheet sensor 9 (the sensor board 90*f*) is outputting the first signal.

When the controller 6 at S525 determines that the sheet sensor 9 (the sensor board 90*f*) is outputting the first signal, the controller 6 at S527 resets the current number S stored in the controller 6 to zero and at S529 resets the value of the counter C to zero.

Upon completion of the step at S529, the controller 6 at S531 starts incrementing the counter C to determine the number of rotations of the motor 40. That is, the controller 6 starts counting pulses of the rotation pulse signal from the point in time when the signal received from the sheet sensor 9 (the sensor board 90*f*) is switched from the second signal to the first signal as illustrated in FIG. 32. It is noted that, in the case where the controller 6 at S525 determines that the sheet sensor 9 (the sensor board 90*f*) is outputting the first signal, the sheet cassette 10 is in the first state or the second state.

When the controller 6 at S525 determines that the sheet sensor 9 (the sensor board 90*f*) is not outputting the first signal, the controller 6 at S533 determines whether a particular length of time is elapsed from the stop of the transmission of the supply command to the first transistor Tr1. When the controller 6 at S533 determines that the particular length of time is not elapsed, the controller 6 executes the step at S525 again.

When the controller 6 at S533 determines that the particular length of time is elapsed, the controller 6 at S535 determines that a failure occurs in the pressing-plate moving mechanism, for example, the pressing plate 12 has not been moved upward. In the case where the controller 6 determines that the failure occurs in the pressing-plate moving mechanism, the sheet cassette 10 is in the third state.

When the controller 6 determines that a failure occurs in the pressing-plate moving mechanism, the controller 6 at S537 notifies an outside of information indicating that the failure occurs in the pressing-plate moving mechanism. This notification may be, for example, provided by controlling the display of the image forming apparatus 1 to display the information or by controlling a speaker of the image forming apparatus 1 to output a voice. After providing this notification, the controller 6 stops the motor 40 at S539 and terminates the process for updating the number S of sheets 18 at S500.

As illustrated in FIG. 31, after starting counting rotations of the motor 40, the controller 6 at S541 determines whether the sheet sensor 9 (the sensor board 90*f*) is outputting the second signal. That is, the controller 6 determines whether the signal received from the sheet sensor 9 (the sensor board 90*f*) is switched from the first signal to the second signal as illustrated in FIG. 32.

When the controller 6 at S541 determines that the sheet sensor 9 (the sensor board 90*f*) is outputting the second signal, the controller 6 stops incrementing the counter C at S543 and obtains the count value counted in a period extending from the start of the incrementing of the counter C to the stop of the incrementing. The controller 6 at S300 uses the obtained count value of the counter C to execute the process for calculating the number S of sheets 18, thereby calculating the updated number S of sheets 18. It is noted that, in the case where the controller 6 at S541 determines that the sheet sensor 9 (the sensor board 90*f*) is outputting the second signal, the sheet cassette 10 is in the first state.

When the controller 6 at S541 determines that the sheet sensor 9 (the sensor board 90*f*) is not outputting the second signal, the controller 6 at S545 determines whether the count value of the counter C is greater than the value Cmax. When the controller 6 at S545 determines that the count value of the counter C is greater than the value Cmax, the controller 6 at S547 stops incrementing the counter C.

In the case where the controller 6 at S545 determines that the count value of the counter C is greater than the value Cmax, the sheet cassette 10 is in the second state. When the controller 6 at S545 determines that the count value of the counter C is greater than the value Cmax, the controller 6 does not update the number S of sheets 18 and keeps the number S at zero to which the number S is reset at S527.

When the controller 6 at S545 determines that the count value of the counter C is not greater than the value Cmax, this flow returns to S541 at which the controller 6 determines again whether the sheet sensor 9 (the sensor board 90*f*) is outputting the second signal.

After the completion of the process for calculating the number S of sheets 18 at S300 or after the increment of the counter C is stopped at S547, the controller 6 at S549 determines whether the number S of sheets 18 stored in the controller 6 is zero.

When the controller 6 at S549 determines that the number S stored in the controller 6 is not zero, the controller 6 at S551 determines that a preparation for printing is finished, at S553 stops the motor 40, and terminates the process for updating the number S of sheets 18 at S500. When the controller 6 at S549 determines that the number S stored in the controller 6 is zero, the controller 6 at S555 controls the display of the image forming apparatus 1 to display the information indicating that the image forming apparatus 1 is out of the sheets 18. The controller 6 at S553 stops the motor 40 and terminates the process for updating the number S of sheets 18 at S500.

In the case where an instruction for forming an image is input to the image forming apparatus 1 when or after the process for updating the number S of sheets 18 is terminated, the controller 6 drives the devices including the image forming unit 5 to form the image on the sheet 18. In this case, each time when one sheet 18 is taken out of the sheet cassette 10, the controller 6 determines the number S of sheets 18 to a value obtained by subtracting one from the current number S of sheets 18 (S=S−1).

Thus, also in the process for updating the number S of sheets 18 at S500 in the case where the image forming apparatus 1 is turned on, it is possible to detect whether a failure occurs in the pressing-plate moving mechanism, before calculating the number S of sheets 18 based on the amount of upward movement of the pressing plate 12. When obtaining the number S of sheets 18 placed on the pressing plate 12 by calculating the height H of the sheets 18 which corresponds to the amount of upward movement of the pressing plate 12, based on the determined number of pulses of the rotation pulse signal, the signal received from the sheet sensor 9 (the sensor board 90*f*) is used to detect the start of upward movement of the pressing plate 12. This configuration eliminates the need to use a specific sensor, resulting in simpler configuration of the image forming apparatus 1 and reduction in increased cost.

Fourth Embodiment

There will be next described a fourth embodiment for calculating the number S of sheets 18. The fourth embodiment is different from the third embodiment in that a device to which the base B2 of the first transistor Tr1 of the sensor board 90*f* is connected is not the controller 6 but a clock-pulse-signal output device 96 (as one example of a third output device) of the image forming apparatus 1. It is noted that the fourth embodiment is described principally for its configuration different from that of the third embodiment, and a description of a configuration of the third embodiment which is the same as that of the third embodiment is dispensed with.

Figure 34:
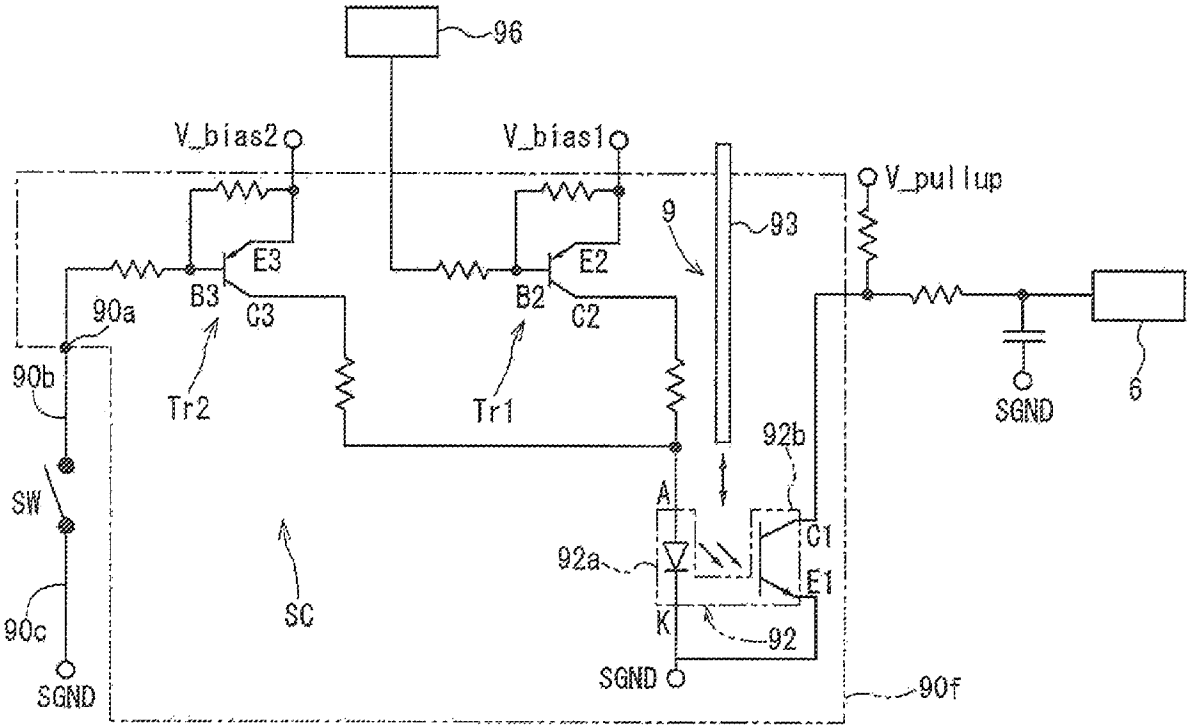
FIG. 34 is a circuit diagram of a sensor board and a power supply circuit in a fourth embodiment.
Figure 35:
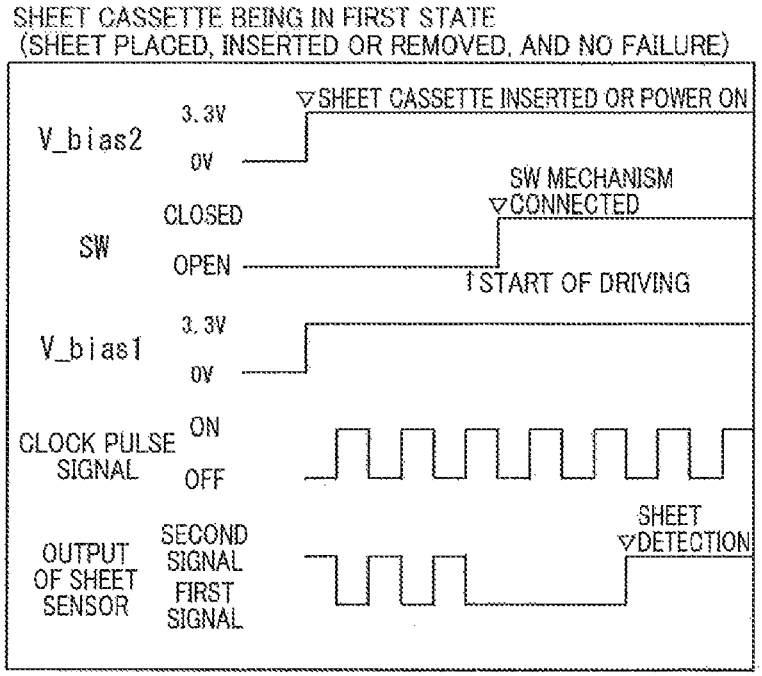
FIG. 35 is a timing chart representing outputs of the sheet sensor and so on when the sheet cassette is in the first state in a fourth embodiment.

As illustrated in FIG. 34, the image forming apparatus 1 includes the clock-pulse-signal output device 96 that is connected to the base B2 of the first transistor Tr1. The clock-pulse-signal output device 96 is a signal output device configured to output a clock pulse signal on a particular cycle. As illustrated in FIG. 35, the clock pulse signal output from the clock-pulse-signal output device 96 is a pulse signal in which an OFF signal with a predetermined electric potential and an ON signal with an electric potential higher than that of the OFF signal appear on the particular cycle. The output clock pulse signal is input to the base 132 of the first transistor Tr1.

The first transistor Tr1 is turned on when the ON signal of the clock pulse signal is input to the base B2. When the first transistor Tr1 is turned on, electric power is supplied to the light emitter 92*a*, so that the light emitter 92*a* emits light. The first transistor Tr1 is turned off when the OFF signal of the clock pulse signal is input to the base B2. When the first transistor Tr1 is turned off, no electric power is supplied to the light emitter 92*a*, so that the light emitter 92*a* does not emit light.

With this configuration, the clock pulse signal in which the ON signal and the OFF signal are output repeatedly on the particular cycle is input to the first transistor Tr1, whereby electric power is supplied to the light emitter 92*a* in synchronization with the clock pulse signal, and the light emitter 92*a* intermittently emits light in synchronization with the clock pulse signal.

In the present embodiment, the power supply circuit SC is capable of receiving the clock pulse signal output from the clock-pulse-signal output device 96. In the state in which the first electrode 26 and the second electrode 27 are not electrically connected to each other due to separation between the pressing plate 12 and the first end portion 14*a* of the first resilient member 14, when the power supply circuit SC receives the clock pulse signal, the power supply circuit SC supplies electric power to the light emitter 92*a* in synchronization with the clock pulse signal to cause the light emitter 92*a* to emit light intermittently, and when the power supply circuit SC does not receive the clock pulse signal, the power supply circuit SC does not supply electric power to the light emitter 92*a*. When the pressing plate 12 contacts the first end portion 14*a* of the first resilient member 14, and thereby the first electrode 26 and the second electrode 27 are electrically connected to each other, the power supply circuit SC supplies electric power to the light emitter 92*a*.

In the present embodiment, the sheet conveying device is constituted by the sheet cassette 10, the body housing 2, the sheet-cassette accommodating portion 2*a*, the first electrode 26, the second electrode 27, the sheet conveyor 20, the driver 4, the sheet sensor 9, the rotation-pulse-signal output device 95, the clock-pulse-signal output device 96, the controller 6, and the power supply circuit SC.

Control for Calculating Number S of Sheets 18

Also in the configuration in which the clock-pulse-signal output device 96 is connected to the base B2 of the first transistor Tr1, and the clock pulse signal output from the clock-pulse-signal output device 96 is input to the base B2 of the first transistor Tr1, the image forming apparatus 1 is, as in the first embodiment, capable of executing the control for calculating the number S of sheets 18, i.e., the process for updating the number S of sheets 18 at S400, the process for updating the number S of sheets 18 at S500, and the process for calculating the number S of sheets 18 at S300.

Figure 36:
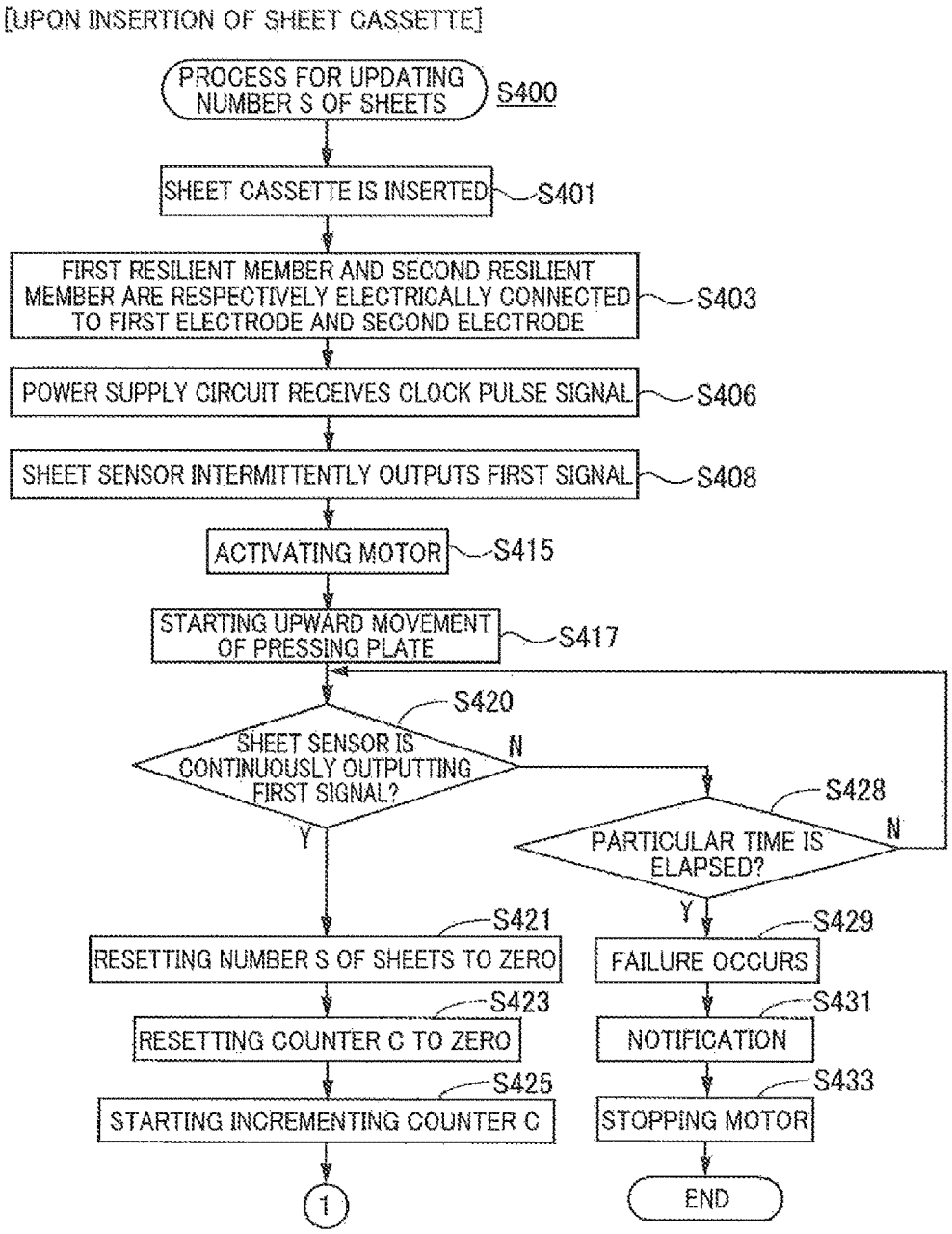
FIG. 36 is a flow chart representing steps at S401-S433 in a process for updating the number of sheets when the sheet cassette is inserted in the fourth embodiment.

In the present embodiment, the controller 6 executes the process for updating the number S of sheets 18 at S400 as follows. As illustrated in FIG. 36, when the sheet cassette 10 located at the separated position is inserted to the accommodated position (S401), the first resilient member 14 provided at the sheet cassette 10 and the first electrode 26 provided in the sheet-cassette accommodating portion 2*a* are electrically connected to each other by contact therebetween, and the second resilient member 15 provided at the sheet cassette 10 and the second electrode 27 provided in the sheet-cassette accommodating portion 2*a* are electrically connected to each other by contact therebetween (S403).

When the sheet cassette 10 is located at the accommodated position, the power supply circuit SC at S406 receives the clock pulse signal output from the clock-pulse-signal output device 96, and, as illustrated in FIG. 35, the sheet sensor 9 (the sensor board 90*f*) intermittently outputs the first signal at S408. At S408, the controller 6 intermittently receives the first signal from the sheet sensor 9 (the sensor board 90*f*). Here, the wording "the sheet sensor 9 (the sensor board 90*f*) intermittently outputs the first signal" means that the sheet sensor 9 (the sensor board 90*f*) outputs the first signal and the second signal repeatedly on the particular cycle in synchronization with the ON signal and the OFF signal of the clock pulse signal.

FIG. 35 is a timing chart when the controller 6 calculates the number S of sheets 18 in the case where the sheet cassette 10 is in the first state. The timing chart represents the state of application of the voltage V_bias1 to the first transistor Tr1, the open or closed state of the switch SW, the state of application of the voltage V_bias2 to the second transistor Tr2, a state of output of the clock pulse signal from the clock-pulse-signal output device 96, and the state of output of the first and second signals from the sheet sensor 9 (the sensor board 90*f*). When the sheet cassette 10 is inserted from the separated position to the accommodated position, the sheet cassette 10 is in any of the first state, the second state, and the third state, and the sheet sensor 9 (the sensor board 90*f*) intermittently outputs the first signal at S408 in any of the first state, the second state, and the third state.

After the sheet sensor 9 (the sensor board 90*f*) intermittently outputs the first signal, the controller 6 activates the motor 40 at S415. When the motor 40 is activated, the driving force supplied from the motor 40 causes upward pivotal movement of the raising plate 13, which starts upward movement of the pressing plate 12 at S417. After activating the motor 40, the controller 6 at S420 determines whether the sheet sensor 9 (the sensor board 90*f*) is continuously outputting the first signal. Here, the wording "the sheet sensor 9 (the sensor board 90*f*) continuously outputs the first signal" means that the sheet sensor 9 (the sensor board 90*f*) continuously outputs the first signal for a length of time considerably longer than a length of the ON signal of the clock pulse signal, for example, for a length of time that is a plurality of times as long as the length of the ON signal of the clock pulse signal.

When the controller 6 at S420 determines that the sheet sensor 9 (the sensor board 90*f*) is continuously outputting the first signal, as in the third embodiment, the controller 6 at S421 resets the current number S stored in the controller 6 to zero and at S423 resets the value of the counter C to zero. The controller 6 at S425 starts incrementing the counter C to determine the number of rotations of the motor 40.

After the start of counting of rotations of the motor 40, the controller 6 executes the steps at S435-S449 (see FIG. 26) as in the third embodiment. However, the decision at S435 in which the controller 6 determines whether the sheet sensor 9 (the sensor board 90*f*) is outputting the second signal is, more specifically, a decision in which the controller 6 determines whether the sheet sensor 9 (the sensor board 90*f*) is continuously outputting the second signal, i.e., a decision in which the controller 6 determines whether the state of the sheet sensor 9 (the sensor board 90*f*) is switched from the state in which the sheet sensor 9 (the sensor board 90*f*) is continuously outputting the first signal to the state in which the sheet sensor 9 (the sensor board 90*f*) is continuously outputting the second signal.

When the controller 6 at S420 determines that the sheet sensor 9 (the sensor board 90*f*) is not continuously outputting the first signal, the controller 6 at S428 determines whether a particular length of time is elapsed from the point in time when upward movement of the raising plate 13 is started by activation of the motor 40. When the controller 6 at S428 determines that the particular length of time is not elapsed, the controller 6 executes the decision at S420 again.

When the controller 6 at S428 determines that the particular length of time is elapsed, the controller 6 at S429 determines that a failure occurs in the pressing-plate moving mechanism, for example, the pressing plate 12 has not been moved upward. That is, in the case where the sheet sensor 9 (the sensor board 90*f*) is not continuously outputting the first signal even when the particular length of time is elapsed from the point in time when upward movement of the raising plate 13 is started by activation of the motor 40, the light emitter 92*a* of the sheet sensor 9 is not continuously emitting light for a reason that, even when the motor 40 is activated, the pressing plate 12 is not moved upward normally, and the switch SW is not switched to the closed state, for example. Accordingly, the controller 6 determines that a failure occurs in the pressing-plate moving mechanism. Thus, in the case where the controller 6 determines that a failure occurs in the pressing-plate moving mechanism, the sheet cassette 10 is in the third state.

When the controller 6 at S429 determines that a failure occurs in the pressing-plate moving mechanism, as in the third embodiment, the controller 6 at S431 notifies the outside that the failure occurs in the pressing-plate moving mechanism, at S433 stops the motor 40, and terminates the process for updating the number S of sheets 18 at S400.

In the present embodiment, the controller 6 executes the process for updating the number S of sheets 18 at S500 as follows. At the point in time when the image forming apparatus 1 is turned on, the power supply circuit SC is receiving the clock pulse signal output from the clock-pulse-signal output device 96, and the sheet, cassette 10 is in any of the first to fifth states. When the sheet cassette 10 is in the first state, the second state, or the third state, the pressing plate 12 is located at the first position, and the pressing plate 12 and the first end portion 14*a* of the first resilient member 14 are separated from each other. At the point in time when the image forming apparatus 1 is turned on, electric power is supplied to the sheet sensor 9 in synchronization with the clock pulse signal, and the sheet sensor 9 (the sensor board 90*f*) intermittently outputs the first signal.

When the sheet cassette 10 is in the fourth state, the sheet sensor 9 is detecting the uppermost sheet 18 supported on the pressing plate 12 moved upward, and the sheet sensor 9 (the sensor board 90*f*) continuously outputs the second signal at the point in time when the image forming apparatus 1 is turned on. When the sheet cassette 10 is in the fifth state, the pressing plate 12 is located at the highest position, the switch SW is in the closed state, and no sheets 18 are being detected by the sheet sensor 9. At the point in time when the image forming apparatus 1 is turned on, the sheet sensor 9 (the sensor board 90*f*) continuously outputs the first signal.

Figure 37:
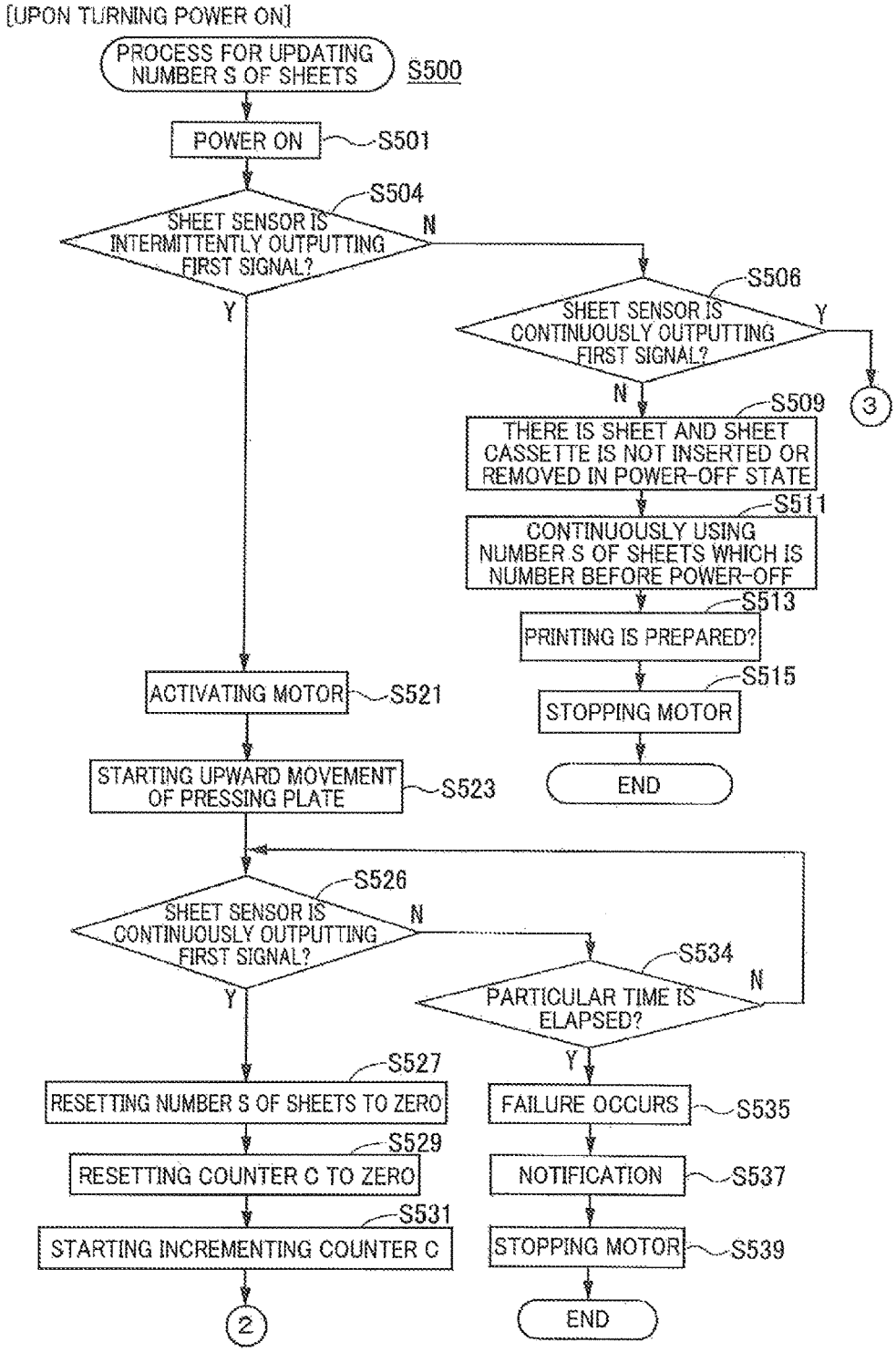
FIG. 37 is a flow chart representing steps at S501-S539 in the process for updating the number of sheets when the power source is turned on in the fourth embodiment.

As illustrated in FIG. 37, when the image forming apparatus 1 is turned on (S501), the controller 6 at S504 determines whether the sheet sensor 9 (the sensor board 90*f*)

is intermittently outputting the first signal. When the controller 6 at S504 determines that the sheet sensor 9 (the sensor board 90*f*) is not intermittently outputting the first signal, the controller 6 at S506 determines whether the sheet sensor 9 (the sensor board 90*f*) is continuously outputting the first signal. When the controller 6 at S506 determines that the sheet sensor 9 (the sensor board 90*f*) is continuously outputting the first signal, the controller 6 determines that the sheet cassette 10 is in the fifth state, and, as illustrated in FIG. 31, the controller 6 at S557 controls the display of the image forming apparatus 1 to display the information indicating that the image forming apparatus 1 is out of the sheets 18 and terminates the process for updating the number S of sheets 18 at S500.

When the controller 6 at S506 determines that the sheet sensor 9 (the sensor board 90*f*) is not continuously outputting the first signal, the controller 6 at S509 determines that a sheet or sheets 18 are supported on the pressing plate 12 and that the sheet cassette 10 is not inserted or removed in the power-off state of the image forming apparatus 1. That is, the controller 6 determines that the sheet cassette 10 is in the fourth state. In this case, as in the third embodiment, without updating the number S of sheets 18, the controller 6 at S511 continuously uses the number S of sheets 18 stored in the controller 6 before the image forming apparatus 1 is turned off. The controller 6 at S513 determines that the preparation for printing is finished, at S515 stops the motor 40, and terminates the process for updating the number S of sheets 18 at S500.

When the controller 6 at S504 determines that the sheet sensor 9 (the sensor board 90*f*) is intermittently outputting the first signal, the controller 6 at S521 activates the motor 40. In the case where the controller 6 at S504 determines that the sheet sensor 9 (the sensor board 90*f*) is intermittently outputting the first signal, the sheet cassette 10 is in the first state, the second state, or the third state.

When the motor 40 is activated, the driving force supplied from the motor 40 causes upward pivotal movement of the raising plate 13, which starts upward movement of the pressing plate 12 at S523. After activating the motor 40, the controller 6 at S526 determines whether the sheet sensor 9 (the sensor board 90*f*) is continuously outputting the first signal.

When the controller 6 at S526 determines that the sheet sensor 9 (the sensor board 90*f*) is continuously outputting the first signal, as in the third embodiment, the controller 6 at S527 resets the current number S stored in the controller 6 to zero and at S529 resets the value of the counter C to zero. The controller 6 at S531 starts incrementing the counter C to determine the number of rotations of the motor 40.

After the start of counting of rotations of the motor 40, the controller 6 executes the steps at S541-S555 and S300 (see FIG. 31) as in the third embodiment. However, the processing at S541 in which the controller 6 determines whether the sheet sensor 9 (the sensor board 90*f*) is outputting the second signal is, more specifically, a decision in which the controller 6 determines whether the sheet sensor 9 (the sensor board 90*f*) is continuously outputting the second signal, i.e., a decision in which the controller 6 determines whether the state of the sheet sensor 9 (the sensor board 90*f*) is switched from the state in which the sheet sensor 9 (the sensor board 90*f*) is continuously outputting the first signal to the state in which the sheet sensor 9 (the sensor board 90*f*) is continuously outputting the second signal.

When the controller 6 at S526 determines that the sheet sensor 9 (the sensor board 90*f*) is not continuously outputting the first signal, the controller 6 at S534 determines whether the particular length of time is elapsed from the point in time when upward movement of the raising plate 13 is started by activation of the motor 40. When the controller 6 at S534 determines that the particular length of time is not elapsed, the controller 6 executes the step at S526.

When the controller 6 at S534 determines that the particular length of time is elapsed, the controller 6 at S535 determines that a failure occurs in the pressing-plate moving mechanism, for example, the pressing plate 12 has not been moved upward. That is, in the case where the sheet sensor 9 (the sensor board 90*f*) is not continuously outputting the first signal even when the particular length of time is elapsed from the point in time when upward movement of the raising plate 13 is started by activation of the motor 40, the light emitter 92*a* of the sheet sensor 9 does not continuously emit light for a reason that, even when the motor 40 is activated, the pressing plate 12 is not moved upward normally, and the switch SW is not switched to the closed state, for example. Accordingly, the controller 6 determines that a failure occurs in the pressing-plate moving mechanism. Thus, in the case where the controller 6 determines that a failure occurs in the pressing-plate moving mechanism, the sheet cassette 10 is in the third state.

When the controller 6 at S535 determines that a failure occurs in the pressing-plate moving mechanism, as in the third embodiment, the controller 6 at S537 notifies the outside that the failure occurs in the pressing-plate moving mechanism, at S539 stops the motor 40, and terminates the process for updating the number S of sheets 18 at S500.

In the present embodiment, the controller 6 is configured to receive the first signal and the second signal output from the sheet sensor 9 (the sensor board 90*f*). Furthermore, the controller 6 indicates a failure in the case where the controller 6 intermittently receives the first signal from the sheet sensor 9 (the sensor board 90*f*) in accordance with the clock pulse signal received by the power supply circuit SC before controlling the driver 4 to move the raising plate 13 to move the pressing plate 12 upward and the controller 6 does not continuously receive the first signal from the sheet sensor 9 (the sensor board 90*f*) even when the particular length of time is elapsed from the start of the upward movement of the raising plate 13 after the controller 6 controls the driver 4 to move the raising plate 13 upward.

This configuration enables the controller 6 to detect whether a failure occurs in the pressing-plate moving mechanism, before calculating the number of sheets 18 supported on the pressing plate 12 based on the amount of upward movement of the pressing plate 12. Also, the power supply circuit SC is configured to supply electric power to the light emitter 92*a* of the sheet sensor 9 upon receiving the clock pulse signal from the clock-pulse-signal output device 96 of the sheet conveying device. This configuration simplifies the configuration of the controller 6 when compared with a case where the power supply circuit SC supplies electric power to the light emitter 92*a* of the sheet sensor 9 upon receiving the power supply command from the controller 6.

In the present embodiment, the controller 6 is configured to receive the rotation pulse signal. Also, when the controller 6 controls the driver 4 to move the raising plate 13 to move the pressing plate 12 upward, the controller 6 starts counting pulses of the rotation pulse signal received from the rotation-pulse-signal output device 95, from the point in time when the state of the sheet sensor 9 (the sensor board 90*f*) is switched from the state in which the controller 6 intermittently receives the first signal from the sheet sensor 9 (the sensor board 90*f*), to the state in which the controller 6 continuously receives the first signal. When the state of the sheet sensor 9 (the sensor board 90*f*) is thereafter switched from the state in which the controller 6 continuously receives the first signal from the sheet sensor 9 (the sensor board 90*f*) to the state in which the controller 6 continuously receives the second signal, the controller 6 ends counting pulses of the rotation pulse signal, determines the number of pulses of the rotation pulse signal, and calculates the height H of the sheets 18 which corresponds to the amount of upward movement of the pressing plate 12, based on the determined number of pulses of the rotation pulse signal.

This configuration reduces the error in calculation of the number S of sheets 18. Also, when calculating the number S of sheets 18 placed on the pressing plate 12 by calculating the height H of the sheets 18 based on the determined number of pulses of the rotation pulse signal, the controller 6 uses the signal received from the sheet sensor 9 (the sensor board 90*f*) to detect the start of upward movement of the pressing plate 12. This configuration eliminates the need to use a specific sensor, resulting in simpler configuration of the image forming apparatus 1 and reduction in increased cost.

Effects in Third and Fourth Embodiments

In the third and fourth embodiments, the sheet conveying device of the image forming apparatus 1 includes: the sheet cassette 10 including the cassette body 11, the pressing plate 12, the raising plate 13, the first resilient member 14, and the second resilient member 15; the body housing 2; the sheet-cassette accommodating portion 2*a*; the first electrode 26; the second electrode 27; the sheet conveyor 20; the driver 4; the sheet sensor 9; the controller 6; and the power supply circuit SC. The controller 6 is configured to receive the first signal and the second signal output from the sheet sensor 9 (the sensor board 90*f*) and transmit the supply command to the power supply circuit SC. Furthermore, the controller 6 indicates a failure in the case where the controller 6 receives the first signal from the sheet sensor 9 (the sensor board 90*f*) in response to transmitting the supply command to the power supply circuit SC before controlling the driver 4 to move the raising plate 13 to move the pressing plate 12 upward and in the case where, when the controller 6 stops transmitting the supply command and controls the driver 4 to move the raising plate 13 upward, the controller 6 does not receive the first signal from the sheet sensor 9 (the sensor board 90*f*) even when the particular length of time is elapsed from the stop of the transmission of the supply command to the power supply circuit SC.

This configuration enables the controller 6 to detect whether the failure occurs in the pressing-plate moving mechanism, before calculating the number of sheets 18 based on the amount of upward movement of the pressing plate 12.

Also, the sheet conveying device includes the rotation-pulse-signal output device 95 configured to output the rotation pulse signal indicating the rotation amount of the motor 40. The controller 6 is configured to receive the rotation pulse signal. When moving the raising plate 13 to move the pressing plate 12 upward by controlling the driver 4, the controller 6 starts counting pulses of the rotation pulse signal received from the rotation-pulse-signal output device 95, from the point in time when the signal received from the sheet sensor 9 (the sensor board 90*f*) is switched from the second signal to the first signal. When the signal received from the sheet sensor 9 (the sensor board 90*f*) is thereafter switched from the first signal to the second signal, the controller 6 ends counting pulses of the rotation pulse signal, determines the number of pulses of the rotation pulse signal, and calculates the amount of upward movement of the pressing plate 12 based on the determined number of pulses of the rotation pulse signal.

This configuration reduces the error in calculation of the number S of sheets 18. When calculating the number S of sheets 18 placed on the pressing plate 12 by calculating the height H of the sheets 18 based on the determined number of pulses of the rotation pulse signal, the controller 6 uses the signal received from the sheet sensor 9 (the sensor board 90*f*) to detect the start of upward movement of the pressing plate 12. This configuration eliminates the need to use a specific sensor, resulting in simpler configuration of the image forming apparatus 1 and reduction in increased cost.

The sheet conveying device includes: the sheet cassette 10 including the cassette body 11, the pressing plate 12, the raising plate 13, the first resilient member 14, and the second resilient member 15; the body housing 2; the sheet-cassette accommodating portion 2*a*; the first electrode 26; the second electrode 27; the sheet conveyor 20; the driver 4; the sheet sensor 9; the clock-pulse-signal output device 96; the controller 6; and the power supply circuit SC. The controller 6 is configured to receive the first signal and the second signal output from the sheet sensor 9 (the sensor board 90*f*). Furthermore, the controller 6 indicates a failure in the case where the controller 6 intermittently receives the first signal from the sheet sensor 9 (the sensor board 90*f*) in accordance with the clock pulse signal received by the power supply circuit SC before controlling the driver 4 to move the raising plate 13 to move the pressing plate 12 upward and the controller 6 does not continuously receive the first signal from the sheet sensor 9 (the sensor board 90*f*) even when the particular length of time is elapsed from the start of the upward movement of the raising plate 13 after the controller 6 controls the driver 4 to move the raising plate 13 upward.

This configuration enables the controller 6 to detect whether a failure occurs in the pressing-plate moving mechanism, before calculating the number of sheets 18 based on the amount of upward movement of the pressing plate 12. Also, the power supply circuit SC is configured to supply electric power to the light emitter 92*a* of the sheet sensor 9 upon receiving the clock pulse signal from the clock-pulse-signal output device 96 of the sheet conveying device. This configuration simplifies the configuration of the controller 6 when compared with the case where the power supply circuit SC supplies electric power to the light emitter 92*a* of the sheet sensor 9 upon receiving the power supply command from the controller 6.

The sheet conveying device includes the rotation-pulse-signal output device 95 configured to output the rotation pulse signal indicating the rotation amount of the motor 40. The controller 6 is configured to receive the rotation pulse signal. Also, when the controller 6 controls the driver 4 to move the raising plate 13 to move the pressing plate 12 upward, the controller 6 starts counting pulses of the rotation pulse signal received from the rotation-pulse-signal output device 95, from the point in time when the state of the sheet sensor 9 (the sensor board 90*f*) is switched from the state in which the controller 6 intermittently receives the first signal from the sheet sensor 9 (the sensor board 90*f*), to the state in which the controller 6 continuously receives the first signal. When the state of the sheet sensor 9 (the sensor board 90*f*) is thereafter switched from the state in which the controller 6 continuously receives the first signal from the sheet sensor 9 (the sensor board 90*f*) to the state in which the controller 6 continuously receives the second signal, the controller 6 ends counting pulses of the rotation pulse signal, determines the number of pulses of the rotation pulse signal, and calculates the amount of upward movement of the pressing plate 12 based on the determined number of pulses of the rotation pulse signal.

This configuration reduces the error in calculation of the number S of sheets 18. When calculating the number S of sheets 18 placed on the pressing plate 12 by calculating the height H of the sheets 18 which corresponds to the amount of upward movement of the pressing plate 12, based on the determined number of pulses of the rotation pulse signal, the controller 6 uses the signal received from the sheet sensor 9 (the sensor board 90*f*), to detect the start of upward movement of the pressing plate 12. This configuration eliminates the need to use a specific sensor, resulting in simpler configuration of the image forming apparatus 1 and reduction in increased cost.

The sheet cassette 10 is movable between the accommodated position at which the sheet cassette 10 is accommodated in the body housing 2 and the separated position at which the sheet cassette 10 is separated from the body housing 2. When the sheet cassette 10 is located at the separated position, the pressing plate 12 is located at the first position.

With this configuration, when the sheet cassette 10 has been, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 26 and the second electrode 27 are electrically connected to each other by contact between the pressing plate 12 and the first end portion 14*a* of the first resilient member 14.

The second end portion 14*b* of the first resilient member 14 is configured to contact the first electrode 26 slidably in the direction of movement of the sheet cassette 10, and the second end portion 15*b* of the second resilient member 15 is configured to contact the second electrode 27 slidably in the direction of movement of the sheet cassette 10. With this configuration, when the sheet cassette 10 is located at the accommodated position, the first resilient member 14 and the second resilient member 15 are held in reliable contact with the first electrode 26 and the second electrode 27, respectively, and when the sheet cassette 10 is moved from the accommodated position toward the separated position, the first resilient member 14 and the second resilient member 15 are easily disconnected from the first electrode 26 and the second electrode 27, respectively.

The rails 201*a* for guiding the sheet cassette 10 are provided in the sheet-cassette accommodating portion 2*a*. The first electrode 26 is plate-shaped and disposed on the rail 201*a*. The second electrode 27 is the frame disposed at the lower portion of the sheet-cassette accommodating portion 2*a*. This makes it possible to arrange the first electrode 26 and the second electrode 27 without complicating the configuration of the image forming apparatus 1, enabling size reduction of the sheet conveying device without hindrance.

The first resilient member 14 is contactable with the edge portion 12*b* of the pressing plate 12. This ensures reliable contact between the first resilient member 14 and the pressing plate 12, resulting in stable electric connection between the first resilient member 14 and the pressing plate 12.

The pressing plate 12 is coated with the conductive grease 121, and the raising plate 13 is held in contact with the portion of the pressing plate 12 to which the conductive grease 121 is applied. Since the portion of the pressing plate 12 which is in contact with the raising plate 13 is coated with the conductive grease 121, the pressing plate 12 and the raising plate 3 are electrically connected to each other stably.

What is claimed is:

1. A sheet conveying device, comprising:

a sheet cassette including:

(i) a first housing configured to accommodate sheets;

(ii) a pressing plate formed of a conductive material, provided at the first housing, and movable between a first position and a second position while supporting the sheets, the first position being a lowest position of the pressing plate, the second position being located above the first position;

(iii) a raising plate formed of a conductive material, provided at the first housing, and configured to move the pressing plate between the first position and the second position while being in constant contact with the pressing plate;

(iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing;

a second housing;

a sheet-cassette accommodating portion provided at the second housing and configured to accommodate the sheet cassette;

a first electrode provided at the sheet-cassette accommodating portion and configured to be in contact with the second end portion of the first resilient member when the sheet cassette is accommodated in the sheet-cassette accommodating portion;

a second electrode provided at the sheet-cassette accommodating portion and configured to be in contact with the second end portion of the second resilient member when the sheet cassette is accommodated in the sheet-cassette accommodating portion;

a sheet conveyor provided at the second housing and configured to convey the sheets from the pressing plate;

a driver provided at the second housing and configured to move the raising plate, the driver including (a) a motor configured to supply a driving force and (b) a transmission mechanism configured to transmit the driving force supplied from the motor to the raising plate when the sheet cassette is accommodated in the sheet-cassette accommodating portion;

a first output device including a detector configured to detect that an uppermost sheet of the sheets supported on the pressing plate reaches a particular position by upward movement of the pressing plate, the first output device being configured to:

output a first signal when the first electrode and the second electrode are electrically connected to each other by contact between the pressing plate and the first end portion of the first resilient member and the detector does not detect that the uppermost sheet reaches the particular position;

output a second signal when the first electrode and the second electrode are electrically connected to each other by contact between the pressing plate and the first end portion of the first resilient member, and the detector detects that the uppermost sheet reaches the particular position; and output the second signal when the first electrode and the second electrode are not electrically connected to each other by separation between the pressing plate and the first end portion of the first resilient member;

a second output device configured to output a rotation pulse signal indicating an amount of rotation of the motor; and a controller configured to receive the first signal, the second signal, and the rotation pulse signal, wherein the controller is configured to:

start counting pulses of the rotation pulse signal received from the second output device at a first timing when a signal received from the first output device is switched from the second signal to the first signal;

end counting pulses of the rotation pulse signal received from the second output device at a second timing when the signal received from the first output device is switched from the first signal to the second signal;

determine a number of pulses of the rotation pulse signal counted between the first timing and the second timing; and determine an amount of upward movement of the pressing plate based on the number of pulses of the rotation pulse signal.

2. The sheet conveying device according to claim 1, wherein the sheet cassette is movable between an accommodated position at which the sheet cassette is accommodated in the second housing and a separated position at which the sheet cassette is separated from the second housing, and wherein, when the sheet cassette is located at the separated position, the pressing plate is located at the first position.

3. The sheet conveying device according to claim 2, wherein the second end portion of the first resilient member is configured to contact the first electrode slidably in a direction of movement of the sheet cassette, and wherein the second end portion of the second resilient member is configured to contact the second electrode slidably in the direction of movement of the sheet cassette.

4. The sheet conveying device according to claim 1, wherein the sheet-cassette accommodating portion includes a rail configured to guide the sheet cassette, wherein the first electrode is plate-shaped and disposed on the rail, and wherein the second electrode is a frame disposed at a lower portion of the sheet-cassette accommodating portion.

5. The sheet conveying device according to claim 1, wherein the first end portion of the first resilient member is configured to contact an edge portion of the pressing plate.

6. The sheet conveying device according to claim 1, wherein the pressing plate is coated with conductive grease, and wherein the raising plate is configured to contact a portion of the pressing plate which is coated with the conductive grease.

7. An image forming apparatus comprising:

the sheet conveying device according to claim 1; and an image former provided at the second housing of the sheet conveying device and configured to form an image on a sheet conveyed from the sheet conveying device.

8. A sheet conveying device, comprising:

a sheet cassette including:

(i) a first housing configured to accommodate sheets;

(ii) a pressing plate formed of a conductive material, provided at the first housing, and movable between a first position and a second position while supporting the sheets, the first position being a lowest position of the pressing plate, the second position being located above the first position;

(iii) a raising plate formed of a conductive material, provided at the first housing, and configured to move the pressing plate between the first position and the second position while being in constant contact with the pressing plate;

(iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing;

a second housing;

a sheet-cassette accommodating portion provided at the second housing and configured to accommodate the sheet cassette;

a first electrode provided at the sheet-cassette accommodating portion and configured to be in contact with the second end portion of the first resilient member when the sheet cassette is accommodated in the sheet-cassette accommodating portion;

a second electrode provided at the sheet-cassette accommodating portion and configured to be in contact with the second end portion of the second resilient member when the sheet cassette is accommodated in the sheet-cassette accommodating portion;

a sheet conveyor provided at the second housing and configured to convey the sheets from the pressing plate;

a driver provided at the second housing and configured to move the raising plate, the driver including (i) a motor configured to supply a driving force and (ii) a transmission mechanism configured to transmit the driving force supplied from the motor to the raising plate when the sheet cassette is accommodated in the sheet-cassette accommodating portion;

a first output device including a detector configured to detect that an uppermost sheet of the sheets supported on the pressing plate reaches a particular position by upward movement of the pressing plate, the detector including (i) a light emitter configured to emit light when receiving electric power, (ii) a light receiver configured to receive the light emitted from the light emitter, and (iii) an actuator being located between the light emitter and the light receiver to intercept the light emitted from the light emitter when the actuator is being moved in contact with the sheet supported on the pressing plate, the actuator being not located between the light emitter and the light receiver to allow the light receiver to receive the light emitted from the light emitter when the actuator is not in contact with the sheet, the first output device being configured to:

output a first signal when the light emitter is receiving electric power and the actuator is not located between the light emitter and the light receiver;

output a second signal when the light emitter is receiving electric power and the actuator is located between the light emitter and the light receiver; and output the second signal when the light emitter is not receiving electric power;

a controller configured to receive the first signal and the second signal, the controller being configured to output a supply command to supply electric power to the light emitter of the first output device; and a power supply circuit configured to:

receive the supply command from the controller when the first electrode and the second electrode are not electrically connected to each other by separation between the pressing plate and the first end portion of the first resilient member;

supply electric power to the light emitter of the first output device when the power supply circuit receives the supply command from the controller;

supply no electric power to the light emitter when the power supply circuit does not receive the supply command from the controller; and supply electric power to the light emitter when the first electrode and the second electrode are electrically connected to each other by contact between the pressing plate and the first end portion of the first resilient member, wherein the controller is configured to:

receive the first signal from the first output device in response to transmitting the supply command to the power supply circuit;

stop transmitting the supply command to the power supply circuit in response to receiving the first signal from the first output device;

receive the second signal from the first output device in response to stopping transmitting the supply command to the power supply circuit; and provide a notification about a failure when the controller does not receive the first signal when a particular length of time is elapsed from a stop of transmission of the supply command.

9. The sheet conveying device according to claim 8, wherein the controller is configured to control the driver to move the raising plate to move the pressing plate upward in response to receiving the second signal output from the first output device.

10. The sheet conveying device according to claim 8, further comprising a second output device configured to output a rotation pulse signal indicating an amount of rotation of the motor, wherein the controller is configured to:

start counting pulses of the rotation pulse signal received from the second output device at a first timing when a signal received from the first output device is switched from the second signal to the first signal;

end counting pulses of the rotation pulse signal received from the second output device at a second timing when the signal received from the first output device is switched from the first signal to the second signal;

determine a number of pulses of the rotation pulse signal counted between the first timing and the second timing; and determine an amount of upward movement of the pressing plate based on the number of pulses of the rotation pulse signal.

11. The sheet conveying device according to claim 8, wherein the sheet cassette is movable between an accommodated position at which the sheet cassette is accommodated in the second housing and a separated position at which the sheet cassette is separated from the second housing, and wherein, when the sheet cassette is located at the separated position, the pressing plate is located at the first position.

12. The sheet conveying device according to claim 8, wherein the second end portion of the first resilient member is configured to contact the first electrode slidably in a direction of movement of the sheet cassette, and wherein the second end portion of the second resilient member is configured to contact the second electrode slidably in the direction of movement of the sheet cassette.

13. The sheet conveying device according to claim 8, wherein the sheet-cassette accommodating portion includes a rail configured to guide the sheet cassette, wherein the first electrode is plate-shaped and disposed on the rail, and wherein the second electrode is a frame disposed at a lower portion of the sheet-cassette accommodating portion.

14. The sheet conveying device according to claim 8, wherein the pressing plate is coated with conductive grease, and wherein the raising plate is configured to contact a portion of the pressing plate which is coated with the conductive grease.

15. An image forming apparatus comprising:

the sheet conveying device according to claim 8; and an image former provided at the second housing of the sheet conveying device and configured to form an image on a sheet conveyed from the sheet conveying device.

16. A sheet conveying device, comprising:

a sheet cassette including:

(i) a first housing configured to accommodate sheets;

(ii) a pressing plate formed of a conductive material, provided at the first housing, and movable between a first position and a second position while supporting the sheets, the first position being a lowest position of the pressing plate, the second position being located above the first position;

(iii) a raising plate formed of a conductive material, provided at the first housing, and configured to move the pressing plate between the first position and the second position while being in constant contact with the pressing plate;

(iv) a first resilient member formed of a conductive material and provided at the first housing, the first resilient member including a first end portion and a second end portion, the first end portion being configured to contact the pressing plate when the pressing plate is located above the first position, the second end portion being partially located outside the first housing; and (v) a second resilient member provided at the first housing, the second resilient member including a first end portion and a second end portion, the first end portion being in contact with the raising plate during movement of the raising plate, the second end portion being partially exposed to an outside of the first housing;

a second housing;

a sheet-cassette accommodating portion provided at the second housing and configured to accommodate the sheet cassette;

a first electrode provided at the sheet-cassette accommodating portion and configured to be in contact with the second end portion of the first resilient member when the sheet cassette is accommodated in the sheet-cassette accommodating portion;

a second electrode provided at the sheet-cassette accommodating portion and configured to be in contact with the second end portion of the second resilient member when the sheet cassette is accommodated in the sheet-cassette accommodating portion;

a sheet conveyor provided at the second housing and configured to convey the sheets from the pressing plate;

a driver provided at the second housing and configured to move the raising plate, the driver including (i) a motor configured to supply a driving force and (ii) a transmission mechanism configured to transmit the driving force supplied from the motor, to the raising plate when the sheet cassette is accommodated in the sheet-cassette accommodating portion;

a first output device including a detector configured to detect that an uppermost sheet of the sheets supported on the pressing plate reaches a particular position by upward movement of the pressing plate, the detector including (i) a light emitter configured to emit light when receiving electric power, (ii) a light receiver configured to receive the light emitted from the light emitter, and (iii) an actuator being located between the light emitter and the light receiver to intercept the light emitted from the light emitter when the actuator is being moved in contact with the sheet supported on the pressing plate, the actuator being not located between the light emitter and the light receiver to allow the light receiver to receive the light emitted from the light emitter when the actuator is not in contact with the sheet, the first output device being configured to:

output a first signal when the light emitter is receiving electric power and the actuator is not located between the light emitter and the light receiver;

output a second signal when the light emitter is receiving electric power, and the actuator is located between the light emitter and the light receiver; and output the second signal when the light emitter is not receiving electric power;

a third output device configured to output a clock pulse signal on a particular cycle;

a controller configured to receive the first signal and the second signal; and a power supply circuit configured to:

receive the clock pulse signal from the third output device when the first electrode and the second electrode are not electrically connected to each other by separation between the pressing plate and the first end portion of the first resilient member;

supply electric power to the light emitter in synchronization with the clock pulse signal to cause the light emitter to intermittently emit light when the power supply circuit receives the clock pulse signal;

supply no electric power to the light emitter when the power supply circuit does not receive the clock pulse signal; and supply electric power to the light emitter when the first electrode and the second electrode are electrically connected to each other by contact between the pressing plate and the first end portion of the first resilient member, wherein the controller is configured to:

intermittently receive the first signal from the first output device in accordance with the clock pulse signal received by the power supply circuit;

control the driver to move the raising plate to move the pressing plate upward in response to intermittently receiving the first signal from the first output device; and provide a notification about a failure when the controller does not continuously receive the first signal from the first output device even when a particular length of time is elapsed from a start of upward movement of the pressing plate.

17. The sheet conveying device according to claim 16, further comprising a second output device configured to output a rotation pulse signal indicating an amount of rotation of the motor, wherein the controller is configured to:

start counting pulses of the rotation pulse signal received from the second output device at a first timing when a state of the controller is switched from a state in which the controller is intermittently receiving the first signal from the first output device to a state in which the controller is continuously receiving the first signal;

end counting pulses of the rotation pulse signal received from the second output device at a second timing when the state of the controller is switched from the state in which the controller is continuously receiving the first signal from the first output device to a state in which the controller is continuously receiving the second signal;

determine a number of pulses of the rotation pulse signal counted between the first timing and the second timing; and determine an amount of upward movement of the pressing plate based on the number of pulses of the rotation pulse signal.

18. The sheet conveying device according to claim 16, wherein the sheet cassette is movable between an accommodated position at which the sheet cassette is accommodated in the second housing and a separated position at which the sheet cassette is separated from the second housing, and wherein, when the sheet cassette is located at the separated position, the pressing plate is located at the first position.

19. The sheet conveying device according to claim 16, wherein the second end portion of the first resilient member is configured to contact the first electrode slidably in a direction of movement of the sheet cassette, and wherein the second end portion of the second resilient member is configured to contact the second electrode slidably in the direction of movement of the sheet cassette.

20. The sheet conveying device according to claim 16, wherein the sheet-cassette accommodating portion comprises a rail configured to guide the sheet cassette, wherein the first electrode is plate-shaped and disposed on the rail, and wherein the second electrode is a frame disposed at a lower portion of the sheet-cassette accommodating portion.

21. The sheet conveying device according to claim 16, wherein the pressing plate is coated with conductive grease, and wherein the raising plate is configured to contact a portion of the pressing plate which is coated with the conductive grease.

* * * * *